US012043451B2

(12) United States Patent
Steenblock et al.

(10) Patent No.: US 12,043,451 B2
(45) Date of Patent: Jul. 23, 2024

(54) MULTI-FILM THERMOPLASTIC BAGS HAVING CONJOINED HEM CHANNELS AND METHODS OF MAKING THE SAME

(71) Applicant: THE GLAD PRODUCTS COMPANY, Oakland, CA (US)

(72) Inventors: Sarah J Steenblock, Cincinnati, OH (US); Edward B Tucker, Willowbrook, IL (US); Matthew W Waldron, West Chester, OH (US); Lehai Minh Pham Vu, Cincinnati, OH (US); John Prusinski, Mason, OH (US); Shaun T Broering, Cincinnati, OH (US); Deborah K Fix, Maineville, OH (US); Justin Zickus, Willowbrook, IL (US); David A Bailey, Cincinnati, OH (US); Jason R Maxwell, Willowbrook, IL (US); Michael G Borchardt, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 11 days.

(21) Appl. No.: 17/570,142

(22) Filed: Jan. 6, 2022

(65) Prior Publication Data

US 2022/0219864 A1 Jul. 14, 2022

Related U.S. Application Data

(60) Provisional application No. 63/136,288, filed on Jan. 12, 2021.

(51) Int. Cl.
*B65D 33/28* (2006.01)
*B65D 30/08* (2006.01)

(52) U.S. Cl.
CPC ..... *B65D 33/28* (2013.01); *B65D 31/02* (2013.01)

(58) Field of Classification Search
CPC ..... B65D 33/28; B65D 31/02
See application file for complete search history.

(56) References Cited

U.S. PATENT DOCUMENTS

| | | | |
|---|---|---|---|
| 3,097,787 | A | 7/1963 | Schur |
| 3,224,574 | A | 12/1965 | McConnell et al. |
| 4,558,463 | A | 12/1985 | Boyd |

(Continued)

OTHER PUBLICATIONS

International Search Report & Written Opinion as received in PCT/US2022/011485 dated May 13, 2022.

*Primary Examiner* — Derek J Battisti
(74) *Attorney, Agent, or Firm* — Keller Preece PLLC

(57) ABSTRACT

One or more implementations of a multi-film thermoplastic bag with a conjoined hem channel. For example, the multi-film thermoplastic bag includes a multi-film hem channel. Bonds secure the layers of the hem channel together so as to prevent a drawtape from inverting or bunching an inner layer of the hem channel during cinching. The bonds are thus located in a hem channel of a multi-film thermoplastic bag so as to reduce an amount of mechanical engagement between the films of the multi-film thermoplastic bag and another thermoplastic film such as a drawtape. In one or more implementations, a grab zone of the multi-film thermoplastic bag also includes bonds in the form of contact areas to provide tactile and visual cues of strength in the grab zone.

20 Claims, 27 Drawing Sheets

(56) References Cited

U.S. PATENT DOCUMENTS

| | | | | |
|---|---|---|---|---|
| 5,161,895 | A | 11/1992 | Myers | |
| 5,881,883 | A * | 3/1999 | Siegelman | B65D 81/03 206/720 |
| 7,712,962 | B1 * | 5/2010 | Reuhs | B65D 33/2508 383/105 |
| 9,050,783 | B2 * | 6/2015 | Borchardt | B31B 70/00 |
| 9,950,830 | B2 * | 4/2018 | de Lesseux | B65D 81/3897 |
| 10,889,431 | B2 * | 1/2021 | Cobler | B65D 33/28 |
| 2004/0097357 | A1 | 5/2004 | Pihl et al. | |
| 2010/0046861 | A1 | 2/2010 | Wilcoxen | |
| 2011/0044566 | A1 | 2/2011 | Fish et al. | |
| 2012/0057811 | A1 * | 3/2012 | Tucker | B65D 31/04 383/72 |
| 2012/0063704 | A1 | 3/2012 | Hoying et al. | |
| 2013/0188889 | A1 * | 7/2013 | Fraser | B65F 1/0006 383/37 |
| 2013/0188891 | A1 * | 7/2013 | Maxwell | B65F 1/002 383/114 |
| 2019/0315567 | A1 * | 10/2019 | Cobler | B32B 27/08 |

* cited by examiner

MULTI-FILM THERMOPLASTIC BAGS HAVING CONJOINED HEM CHANNELS AND METHODS OF MAKING THE SAME

CROSS-REFERENCE TO RELATED APPLICATIONS

This application claims priority to and the benefit of U.S. Provisional Patent Application No. 63/136,288, filed on Jan. 12, 2021, which is incorporated herein by reference in its entirety.

BACKGROUND

1. Technical Field

The present application relates generally to thermoplastic bags. More particularly, the present application relates to thermoplastic bags including multiple films.

2. Background and Relevant Art

Thermoplastic films are a common component in various commercial and consumer bags. For example, grocery bags, trash bags, sacks, and packaging materials are products that are commonly made from thermoplastic films. The cost to produce products including thermoplastic film is directly related to the cost of the thermoplastic film. Recently the cost of thermoplastic materials has risen. In response, some attempt to control manufacturing costs by decreasing the amount of thermoplastic material in a product. One way manufacturers reduce production costs is to utilize multiple thinner layers that combine to provide maintained, or even increased, strength compared to a single thicker layer.

While utilizing multiple thinner films can provide cost savings, the use of thinner gauge films can result in lower durability or other drawbacks. For example, multi-layer trash bags often experience friction and mechanical engagements in the hem channel when a drawtape is pulled through the channel, such as when the drawtape is being pulled to remove the trash bag from a receptacle. For instance, the drawtape in multi-layer trash bags often mechanically engages with the inner layer of the hem channel causing the inner layer of the hem channel to invert. In particular, the inner layer can invert independently from the outer layer and bunch at the drawtape notch in the hem channel. This inversion, in turn, makes it more difficult for the user to constrict the opening of the bag using the drawtape.

Along related lines, recent advancing in drawtape technology involves incrementally stretching the drawtape to provide the drawtape with increased strength or elastic-like characteristics. Such incremental stretching typically involves forming ribs in the drawtape. Such ribbed drawtapes further exacerbate the problem of the inner ply bunching or inverting during when the drawtape is drawn to cinch the opening of the bag.

Additionally, as a result of thinner bags, some conventional thermoplastic trash bags are prone to tearing, ruptures, and other issues at the top of the bag. For example, when grasping a conventional thermoplastic liner by a top portion, a grasping hand (e.g., fingers) can puncture or overly stretch (leading to subsequent failure of) the trash bag. For instance, after fingers stretch a thermoplastic bag during a grasping motion, these overly stretched areas are further compromised (e.g., in some cased to the point of failure) when pulling or lifting a thermoplastic bag and out of a trash receptacle. In turn, such compromising of the top of the bag can lead to trash spillage, require an adjusted/awkward carrying position or method, etc.

Finally, customers naturally sense from prior experience that thinner gauge materials are lower in quality and durability. For example, some cues to a customer of lower quality and durability of a film are how thick or thin the film feels and how thin or weak the film "looks." Customers tend to view thin looking or feeling films as having relatively low strength. This is particularly true when thin looking or feeling films are used in areas of customer products with which the customer comes in direct contact—such as the top edge of a trash bag.

BRIEF SUMMARY

One or more implementations of the present disclosure solve one or more problems in the art with multi-layer thermoplastic bags hem channels with conjoined or bonded layers. The bonds between the layers of the hem channels prevent the inner thermoplastic film layer from separating from the outer thermoplastic film layer when a drawtape in the hem channel is pulled to cinch the top of the multi-layer thermoplastic bag. As such, the bonded hem channels can prevent the inner thermoplastic film layer from inverting relative to the outer thermoplastic film layer and from bunching within the hem channel. Thus, the bonded hem channels can reduce drag and friction between the drawtape and the hem channel resulting in lower force needed to cinch the multi-layer thermoplastic bag. Additionally, the bonded layers of the hem channels can increase stiffness of the hem channel and provide a tactile feel that connotes strength to a user grasping the top of the multi-layer thermoplastic bag.

Optionally, in one or more implementations bonds also secure the layers of the thermoplastic bag together in grab zones (e.g., areas of the bag commonly grabbed when removing the bag from a receptacle and in particular the area just below hem seal) of the multi-layer thermoplastic bags. For example, bonds can comprise contact areas between adjacent films. The contact areas comprise areas in which at least first and second thermoplastic films of the multi-film thermoplastic structure are in intimate contact. The contact areas can help reinforce the top-of-bag due to increased stiffness provided by the contact areas, and thereby, help reduce tearing or other damage by stresses/strain from grasping fingers (e.g., during a grabbing motion to lift or carry) applied to the grab zone. Additionally, the increased stiffness can provide a tactile feel that connotes strength to a user grasping the grab zone. Thus, by positioning the contact areas in the grab zone, (a high-touch area) the contact areas provide tactile cues to the consumer about the strength and quality of the multi-film thermoplastic bag.

An implementation of a multi-film thermoplastic bag includes a first sidewall comprising a first thermoplastic film layer and a second thermoplastic film layer with a first hem channel along a top of the first sidewall. The first hem channel is formed from the first thermoplastic film layer and the second thermoplastic film layer and comprises one or more first bonds that securing together the first outer thermoplastic film layer and the second inner thermoplastic film layer in the first hem channel. The multi-film thermoplastic bag further includes a second sidewall comprising a third thermoplastic film layer and a fourth thermoplastic film layer with a second hem channel along a top of the second sidewall. The second hem channel is formed from the third thermoplastic film layer and the fourth thermoplastic film layer and comprises one or more second bonds securing together the third outer thermoplastic film layer and the fourth inner thermoplastic film layer in the second hem channel.

Additionally, an implementation of a multi-layer thermoplastic bag includes a first thermoplastic bag including first and second opposing sidewalls joined together along a first side edge and an opposite second side edge, an open first top edge, and a closed first bottom edge. The multi-layer thermoplastic bag also includes a second thermoplastic bag positioned within the first thermoplastic bag, where the second thermoplastic bag includes third and fourth opposing sidewalls joined together along a third side edge and an opposite fourth side edge, an open second top edge, and a closed second bottom edge. The multi-layer thermoplastic bag further includes a first hem channel along the open first top edge and a second hem channel along the open second top edge. The first hem channel is formed from the first and third sidewalls on a first side of the multi-layer thermoplastic bag and the second hem channel is formed from the second and fourth sidewalls on a second side of the multi-layer thermoplastic bag. The multi-layer thermoplastic bag also includes one or more bonds securing the first and second thermoplastic bags together in the first hem channel and the second hem channel.

In addition to the foregoing, a method for making a multi-film thermoplastic bag involves forming a film stack comprising a first thermoplastic film on top of a second thermoplastic film. The method also involves forming a plurality of bonds securing an area of the first thermoplastic film to the second thermoplastic film, the area of the first thermoplastic film being proximate a top edge of the first thermoplastic film. The method then involves folding the top edge of the first thermoplastic film and a top edge of the second thermoplastic film over the film stack to create a folded over portion. The method also involves creating a hem seal securing the folded over portion to the film stack thereby creating a hem channel from the folded over portion, the hem channel comprising the area of the first thermoplastic film secured to the second thermoplastic film by the plurality of bonds. The method additionally involves forming the film stack into a thermoplastic bag.

Additional features and advantages of will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above recited and other advantages and features of the present disclosure can be obtained, a more particular description of the present disclosure briefly described above will be rendered by reference to specific implementations thereof which are illustrated in the appended drawings. It should be noted that the figures are not drawn to scale, and that elements of similar structure or function are generally represented by like reference numerals for illustrative purposes throughout the figures. Understanding that these drawings depict only typical implementations of the present disclosure and are not therefore to be considered to be limiting of its scope, the present disclosure will be described and explained with additional specificity and detail through the use of the accompanying drawings in which.

DETAILED DESCRIPTION

Figure 1C:
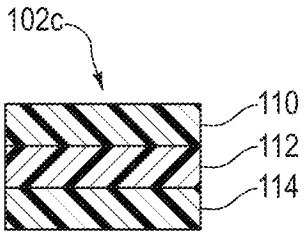
FIG. 1A-1C show partial side cross-sectional views of films having varying numbers of layers according to one or more implementations of the present disclosure.

One or more implementations of the present disclosure include apparatus and methods for creating multi-film thermoplastic bags with hem channels having bonded or conjoined layers. The bonds between the layers of the hem channels prevent the inner thermoplastic film layer of the hem channel from inverting relative to the outer thermoplastic film layer of the hem channel. Similarly, the bonds of the hem channels help prevent bunching of the film layers within the hem channel. Thus, the bonded hem channels can reduce drag and friction between the drawtape and the hem channel, which results in lower forces needed to cinch the multi-layer thermoplastic bag.

Additionally, two films bonded together have greater stiffness than two independent layers. Thus, the bonds securing the layers of the hem channels of a multi-film thermoplastic bag can increase the stiffness of the hem channels. The increased stiffness of the hem channels can provide a tactile feel that connotes strength to a user grasping the top of the multi-film thermoplastic bag.

In some implementations, when viewing a first thermoplastic film of a multi-film thermoplastic bag, the bonds in the hem channel between the first and second thermoplastic films differ in appearance (e.g., a different color) from areas of the first thermoplastic film of the hem channels not in intimate contact with the second thermoplastic film. The differing appearance of the bonds in the hem channels can provide a look that connotes increased strength to a user. The differing appearance of the bonds in the hem channels can be visible both from the outside of the bag (i.e., when viewing the outside of the outer layer of the bag) and from the inside of the bag (i.e., when viewing the inside of the inner layer of the bag). Thus, securing the layers of the hem channels together with visibly distinct bonds, the hem channels (a highly visible area) provide visual cues to the consumer about the strength and quality of the multi-film thermoplastic bag.

Moreover, bonds in the hem channel (and other areas of the multi-film thermoplastic bag) provide additional benefits. For example, tensile deformation (e.g., thinning and increased light transparency of films) is highly noticeable in plain filmed bags. In contrast, bonding between films, such as described herein causes thinning and light transparency to be less noticeable due to visual complexity associated with patterns of contact areas and other types of bonding, and to the patterns of contact areas being resistant to thinning. As such, the bonds in the multi-film thermoplastic bag described herein (e.g., in the hem channel and elsewhere) create an increased perception of strength and quality of the multi-film thermoplastic bag.

One or more implementations include a multi-film thermoplastic bag having sidewalls comprising a first thermoplastic film and an adjacent second thermoplastic film. The bonds comprise portions of the first thermoplastic film that are in intimate contact with portions of the second thermoplastic film and vice versa. In one or more implementations, the bonds are positioned in a hem channel of a multi-film thermoplastic bag in order to give the hem channel of the bag a stronger and/or more rigid feel—thus, giving a tactile cue that the thermoplastic bag is less likely to rip, tear, or puncture when handled in the hem channel. Additionally, the bonds in the hem channel of the multi-film thermoplastic bag reduce an amount of mechanical engagement between the inner surface of the hem channel and a drawtape positioned therein such that a reduced amount of force is required to pull the drawtape through the hem channel.

For example, in one or more implementations, the bonds in the hem channel reduce an area of a drawtape inserted in the hem channel that comes in contact with inner walls of the hem channel. This reduction in contact between the inner walls of the hem channel and the drawtape further reduces an amount of drag force exerted on the drawtape by the inner walls of the hem channel when the drawtape is pulled through the hem channel—as when a customer is pulling the drawtape of a multi-film thermoplastic bag in order to cinch the bag shut. This reduction in contact also prevents the drawtape from engaging with the inner walls of the hem channel thereby preventing the inner walls of the hem channel from inverting and potentially bunching up around the hem channel openings through which the drawtape is pulled.

In one or more implementations, a method of making a multi-film thermoplastic bag includes forming bonds in one or more areas of the multi-film thermoplastic bag prior to forming a hem channel and inserting a drawtape. For example, in order for the multi-film thermoplastic bag to have bonds in an area corresponding to the hem channel, the bonds can be added to the multi-film thermoplastic bag in an area adjacent to the top of the multi-film thermoplastic bag. The area including the bonds can be folded (e.g., at a top edge of the multi-film thermoplastic bag) to form hem channels, where the hem channels include the bonds. A drawtape can then be inserted into the hem channels.

In some implementations, folding over the top edges of the multi-film thermoplastic bag forms both a hem channel and a hem skirt extending from the hem channel down an inner surface of the multi-film thermoplastic bag. For example, depending on the length of the area where contact areas are added to the top portion of the multi-film thermoplastic bag, the bonds from the hem channel can extend into some or all of the hem skirt. Similarly, the bonds can extend from the hem channel down the outer surface of the multi-film thermoplastic bag.

In some implementations, the hem skirt may include an extended length to form an extended hem skirt. In particular, one or both of the layers of the hem skirt can extend down from the hem channel to cover at least a portion of the grab zone. An extended hem skirt with three or four layers can reinforce the grab zone by providing additional layers of thermoplastic material, and thereby, reduce puncturing, tearing, or other damage in the grab zone. Furthermore, the bonds can secure together layers of the sidewalls of the multi-film thermoplastic bag in the grab zone. The bonds can thus restrict relative movement between the layers in the grab zone, and thereby, provide a sensory signal of increased strength in the grab zone.

In one or more implementations, the bonds in the hem channels (or grab zone) between the films of a multi-film thermoplastic bag are arranged in a pattern. For example, the pattern can be continuous or discrete, and can include varying densities of pattern elements. Additionally, the multi-film thermoplastic bag may include the pattern of bonds over various percentages of the area of the multi-film thermoplastic bag (e.g., both within the hem channels and grab zones and outside). For example, in or more implementations, the bonds form a pattern that uniformly spans the hem channels and/or grab zone. In alternative implementations, the bonds form a pattern that creates a wavy or uneven pattern (i.e., a non-uniform pattern along the width of the grab zone). The wavy or uneven bottom edge of the pattern creates areas of lower linear force density across the width of the grab zone as compared to a uniform pattern of contact areas. This can provide lower stress on the material due to a wide distribution of forces from the local application of lift force at the top of the bag when removing the bag from a receptacle as described in greater detail below in relation to FIGS. 8A and 8B.

Bringing the first and second thermoplastic films into direct contact via one or more bonds can cause an appearance change to the areas or regions of first thermoplastic film—such as in the hem channel, the skirt, and other portions of a multi-film thermoplastic bag. In particular, in one or more implementations, when viewed from the first thermoplastic film side of the multi-film thermoplastic structure, the bonds comprise a different color than the portions of the first thermoplastic film not in intimate contact with the second thermoplastic film (e.g., separated by a gap or space).

Moreover, when films of a multi-film thermoplastic bag have different appearances, due to the inclusion of a pigment or other coloring agent, the contact areas cause the appearance of areas of visual contrast in adjacent films. For example, in a two-film thermoplastic bag where the first thermoplastic film is a light color and the second thermoplastic film is a dark color, intimate contact between the two films cause a wetting effect in an area of the first thermoplastic film. For instance, the intimate contact removes air from between portions of the two films such that the color of the second thermoplastic film shows through the first thermoplastic film. Thus, in this example the contact areas cause a dark area to appear in the lighter first thermoplastic film. Thus, the contact areas can create intimate contact between a portion of a first film and a portion of a second film causing the area of intimate contact to take on the visual characteristics of one of the films. Alternatively, the area of the intimate contact can take on a visual appearance that is a blending of the first and second films, or an appearance that is different from both the first and second films.

One will appreciate in light of the disclosure here that bonds in the hem channel (and optionally grab zone) between the films of a multi-film thermoplastic bag can be formed using various techniques. For example, the bonds can be formed using heat and pressure, ultrasonic welding, adhesive, cold deformation (SELFing, ring rolling, embossing), heat seals, the combination of pressure and tackifying agents embedded in the film, or the use of contact areas.

In particular, one or more implementations involve utilizing heat and pressure on the films of the multi-film thermoplastic bag to bring the films together and create the bonds. Furthermore, one or more implementations involve controlling the amount of heat and pressure to tailor the properties of the bonds. For example, in one or more implementations enough heat and pressure are applied so as to bring the films into intimate contact but not so much as to degrade the strength or otherwise weakening the films. For example, in one or more implementations a strength of the films in the bonds is not substantially weakened. More particularly, in one or more implementations a transverse-direction tensile strength of the films is not significantly lower than the areas of the films not including the bonds.

Additionally, one or more implementations involve controlling the amount of heat and pressure to tailor the properties of the films forming the bonds such that the films are in intimate contact but lightly bonded. For example, one or more implementations provide for forming bonds between adjacent films of a multi-film thermoplastic bag that are relatively light such that forces acting on the multi-film bag are first absorbed by breaking the bonds rather than, or prior to, tearing or otherwise causing the failure of any of the films of the multi-film bag when subjected to peel forces within a given range. Such implementations can provide an overall thinner film employing a reduced amount of raw material that nonetheless has maintained or increased strength parameters. Alternatively, such implementations can use a given amount of raw material and provide a film with increased strength parameters.

In particular, the bonds between adjacent layers of multi-film bags in accordance with one or more implementations can act to first absorb forces via breaking prior to allowing those same forces to cause failure of the individual films of the multi-film structure when subjected to peel forces. Such action can provide increased strength to the multi-film thermoplastic bag. In one or more implementations, the bonds include a bond strength that is less than a weakest tear resistance of each of the individual films so as to cause the bonds to fail prior to failure of the films when subjected to peel forces within a given range. Indeed, one or more implementations include bonds that release prior to any localized tearing of the films of the multi-film thermoplastic bag.

Thus, in one or more implementations, the bonds of a multi-film thermoplastic bag can fail before either of the individual layers undergoes molecular-level deformation. For example, an applied strain can pull the bonds apart prior to any molecular-level deformation (stretching, tearing, puncturing, etc.) of the individual film layers. In other words, the bonds can provide less resistive force to an applied strain than molecular-level deformation of individual films of the multi-film bag. Such a configuration of bonds can provide increased strength properties to the multi-film thermoplastic bag as compared to a monolayer film of equal thickness or a multi-film bag in which the plurality of layers are tightly bonded together (e.g., coextruded).

Moreover, as mentioned above, when positioned in a hem channel of a multi-film thermoplastic bag, the bonds make it easier for a customer to pull a drawtape through the hem channel. For example, as mentioned above, when flat and undeformed films are folded over to form a hem channel around a drawtape, it is possible for the drawtape to mechanically engage in a frictional manner with the film forming the inside of the hem channel. When the drawtape is pulled through the hem channel, this engagement can cause: 1) an increase in the amount of force required to pull the drawtape, and 2) an inversion of the inner film leading to bunching around a hem channel opening or aperture through which the drawtape is being pulled. In one or more implementations, bonds in the hem channel can both: reduce the amount of force needed to pull the drawtape (e.g., due to less contact between the drawtape and the inside of the hem channel), and secure the films of the hem channel together such that the inner film avoids inverting.

As used herein, the term "hem channel" refers to a portion of a thermoplastic bag that houses a drawtape. A hem channel extends side-to-side between, but does not include, opposing side seals (or tape seals). Additionally, in implementations including a hem seal, a hem channel extends from the top edge of a bag to, but does not include, the hem seal. As such, the sides seals, tape seals, and hem seals are separate and distinct from the inventive bonds described herein.

As used herein, the term "grab zone" refers to a portion of a thermoplastic bag that is subjected to an applied load (e.g., a lifting force to lift or carry the thermoplastic bag). In other works, a grab zone is an area of a bag commonly grabbed when removing the bag from a receptable. In particular, the grab zone includes a top portion of a thermoplastic bag (e.g., above and/or below a hem seal). For example, the grab zone extends from a first side edge to an opposing second side edge and from proximate (e.g., immediately adjacent to or within a threshold distance from) the top opening a first distance toward the bottom fold. As another example, the grab zone extends from a first side edge to an opposing second side edge and from the hem seal a second distance (equivalent or different from the first distance) toward the bottom fold. As a further example, the grab zone extends from a first side edge to an opposing second side edge and from the hem seal a third distance (equivalent or different from the first and second distances) to a hem skirt seal toward the bottom fold.

As used herein, the terms "lamination," "laminate," and "laminated film," refer to the process and resulting product made by bonding together two or more layers of film or other material. The term "bonding," when used in reference to bonding of multiple layers of a multi-film bag, may be used interchangeably with "lamination" of the layers. According to one or more implementations, adjacent films of a multi-film bag are laminated or bonded to one another.

The term laminate is also inclusive of coextruded multilayer films comprising one or more tie layers. As a verb, "laminate" means to affix or adhere (by means of, for example, adhesive bonding, pressure bonding, ultrasonic bonding, corona lamination, heat bonding, and the like) two or more separately made film articles to one another so as to form a multi-film bag. As a noun, "laminate" means a product produced by the affixing or adhering just described.

As used herein "bond" refers to a mechanism that secures, at least temporarily, two films together. For example, bonds can comprise heat seals, ultrasonic welds, adhesive bonds, pressure bonds (e.g., bonds formed by ring rolling, SELF'ing, or embossing), bonds formed due to tackifying agents in one or more of the films, contact areas, or combinations of the foregoing. Bonds in the form of contact areas are described in greater detail below in relation to FIGS. 3A-3F, and comprise bonds with a weaker bond strength so as to allow the bonds to fail prior to failure of the films bonded together by the contacts areas. This is in contrast to bonds, like heat seals, with a high bond strength that cause the films bonded together by the heat seals to fail prior to, or in conjunction with, failure of the heat seals.

In one or more implementations, the bonds between films of a multi-film bag may be continuous. As used herein, a "continuous" area of bonds refers to one or more bonds that are continuously positioned in an area, and arranged in the machine direction, in the transverse direction, or in an angled direction.

In one or more implementations, the bonds between films of a multi-film bag may be in a discrete or non-continuous pattern (i.e., discontinuous or partial discontinuous). As used herein, a "discrete pattern" of bonds refers to a non-repeating pattern of pattern elements in the machine direction, in the transverse direction, or in an angled direction.

In one or more implementations, the bonds between films of a multi-film bag may be in a partially discontinuous pattern. As used herein, a "partially discontinuous" pattern of bonds refers to pattern elements that are substantially continuous in the machine direction or in the transverse direction, but not continuous in the other of the machine direction or the transverse direction. Alternately, a partially discontinuous pattern of bonds refers to pattern elements that are substantially continuous in the width of the article but not continuous in the height of the article, or substantially continuous in the height of the article but not continuous in the width of the article. Alternatively, a partially discontinuous pattern of bonds refers to pattern elements that are substantially continuous for a width and height that is less than the width and height of the article. More particularly, a partially discontinuous pattern of bonds refers to repeating pattern elements broken up by repeating separated areas in either the machine direction, the transverse direction, or both. Both partially discontinuous and discontinuous patterns are types of non-continuous heated pressure bonding (i.e., bonding that is not complete and continuous between two surfaces).

One or more implementations involve bringing pigmented, lightly pigmented, and/or substantially un-pigmented thermoplastic films into intimate contact. As used herein, the term "substantially un-pigmented" refers to a thermoplastic ply or plies that are substantially free of a significant amount of pigment such that the ply is substantially transparent or translucent. For example, a "substantially un-pigmented" film can have a pigment concentration (i.e., percent of total composition of the film) that is between 0% by weight and 2% by weight. In some embodiments, a "substantially un-pigmented" film can have a pigment concentration between about 0% by weight and about 1% by weight. In further embodiments, a "substantially un-pigmented" film can have a pigment concentration between about 0% by weight and about 0.75% by weight. A substantially un-pigmented film can have a transparent or translucent appearance.

As used herein, the term "lightly pigmented" refers to a thermoplastic ply or plies that are pigmented such that, when placed into intimate contact with a pigmented film, an unexpected appearance is produced. For example, the unexpected appearance can be a "wetting" of a color of the pigmented film through the lightly pigmented film. Alternately, the unexpected appearance may be an effect that differs from an appearance (e.g., colors) of the individual films. If a film has too much pigment, when placed into intimate contact with another pigmented film, an unexpected appearance will not be produced. The amount of pigment in a lightly pigmented film that will produce the unexpected appearance can be dictated by the thickness of the film.

A pigmented film can comprise a lightly pigmented film or a film with a greater percentage of pigment than a lightly pigmented film. As mentioned above, in one or more embodiments, a first thermoplastic film is substantially un-pigmented or lightly pigmented and a second thermoplastic film is pigmented. Thus, in one or more embodiments, the second thermoplastic layer has a greater percentage of pigment than the first thermoplastic layer. Alternatively, the first and second thermoplastic layers have the same percentage of pigment, but the first thermoplastic layer comprises a lighter pigment than a pigment of the second thermoplastic layer.

As used herein, the term "pigment or pigments" are solids of an organic and inorganic nature which are defined as such when they are used within a system and incorporated into the thermoplastic film, absorbing part of the light and reflecting the complementary part thereof which forms the color of the thermoplastic ply. Representative, but not limiting, examples of suitable pigments include inorganic colored pigments such as such as iron oxide, in all their shades of yellow, brown, red and black; and in all their physical forms and particle-size categories, chromium oxide pigments, also co-precipitated with nickel and nickel titanates, blue and green pigments derived from copper phthalocyanine, also chlorinated and brominated in the various alpha, beta and epsilon crystalline forms, yellow pigments derived from lead sulphochromate, yellow pigments derived from lead bismuth vanadate, orange pigments derived from lead sulphochromate molybdate lead oxide, cadmium sulfide, cadmium selenide, lead chromate, zinc chromate, nickel titanate, and the like. For the purposes of the present invention, the term "organic pigment" comprises also black pigments resulting from organic combustion (so-called "carbon black"). Organic colored pigments include yellow pigments of an organic nature based on arylamides, orange pigments of an organic nature based on naphthol, orange pigments of an organic nature based on diketo-pyrrolo-pyrole, red pigments based on manganese salts of azo dyes, red pigments based on manganese salts of beta-oxynaphthoic acid, red organic quinacridone pigments, and red organic anthraquinone pigments. Organic colored pigments include azo and diazo pigments, phthalocyanines, quinacridone pigments, perylene pigments, isoindolinone, anthraquinones, thioindigo, solvent dyes and the like.

Pigments can be light reflecting (e.g., white pigments) or light absorbing (e.g., black pigments). Examples of pigments suitable for one or more implementations include titanium dioxide, Antimony Oxide, Zinc Oxide, White Lead, Lithopone, Clay, Magnesium Silicate, Barytes (BaSO4), and Calcium Carbonate (CaCO3).

As an initial matter, the thermoplastic material of the films of one or more implementations of the present disclosure may include thermoplastic polyolefins, including polyethylene and copolymers thereof and polypropylene and copolymers thereof. The olefin-based polymers may include ethylene or propylene based polymers such as polyethylene, polypropylene, and copolymers such as ethylene vinyl acetate (EVA), ethylene methyl acrylate (EMA) and ethylene acrylic acid (EAA), or blends of such polyolefins.

Other examples of polymers suitable for use as films in accordance with the present disclosure may include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), oriented poly(ethylene-terephthalate), poly (ethylene-butylacrylate), polyurethane, poly(ethylene-propylene-diene), ethylene-propylene rubber, nylon, etc.

Some of the examples and description herein below refer to films formed from linear low-density polyethylene. The term "linear low density polyethylene" (LLDPE) as used herein is defined to mean a copolymer of ethylene and a minor amount of an olefin containing 4 to 10 carbon atoms, having a density of from about 0.910 to about 0.930, and a melt index (MI) of from about 0.5 to about 10. For example, some examples herein use an octene comonomer, solution phase LLDPE (MI=1.1; ρ=0.920). Additionally, other examples use a gas phase LLDPE, which is a hexene gas phase LLDPE formulated with slip/AB (MI=1.0; ρ=0.920). Still further examples use a gas phase LLDPE, which is a hexene gas phase LLDPE formulated with slip/AB (MI=1.0; ρ=0.926). One will appreciate that the present disclosure is not limited to LLDPE, and can include "high density polyethylene" (HDPE), "low density polyethylene" (LDPE), and "very low density polyethylene" (VLDPE). Indeed, films made from any of the previously mentioned thermoplastic materials or combinations thereof can be suitable for use with the present disclosure.

Some implementations of the present disclosure may include any flexible or pliable thermoplastic material that may be formed or drawn into a web or film. Furthermore, the thermoplastic materials may include a single layer or multiple layers. The thermoplastic material may be opaque, transparent, translucent, or tinted. Furthermore, the thermoplastic material may be gas permeable or impermeable.

As used herein, the term "flexible" refers to materials that are capable of being flexed or bent, especially repeatedly, such that they are pliant and yieldable in response to externally applied forces. Accordingly, "flexible" is substantially opposite in meaning to the terms inflexible, rigid, or unyielding. Materials and bags that are flexible, therefore, may be altered in shape and structure to accommodate external forces and to conform to the shape of objects brought into contact with them without losing their integrity. In accordance with further prior art materials, web materials are provided which exhibit an "elastic-like" behavior in the direction of applied strain without the use of added traditional elastic materials. As used herein, the term "elastic-like" describes the behavior of web materials which when subjected to an applied strain, the web materials extend in the direction of applied strain, and when the applied strain is released the web materials return, to a degree, to their pre-strained condition.

As used herein, the term "substantially," in reference to a given parameter, property, or condition, means to a degree that one of ordinary skill in the art would understand that the given parameter, property, or condition is met within a degree of variance, such as within acceptable manufacturing tolerances. By way of example, depending on the particular parameter, property, or condition that is substantially met, the parameter, property, or condition may be at least 70.0% met, at least 80.0%, at least 90% met, at least 95.0% met, at least 99.0% met, or even at least 99.9% met.

Additional additives that may be included in one or more implementations include slip agents, anti-block agents, voiding agents, or tackifiers. Additionally, one or more implementations of the present disclosure include films that are devoid of voiding agents. Some examples of inorganic voiding agents, which may further provide odor control, include the following but are not limited to: calcium carbonate, magnesium carbonate, barium carbonate, calcium sulfate, magnesium sulfate, barium sulfate, calcium oxide, magnesium oxide, titanium oxide, zinc oxide, aluminum hydroxide, magnesium hydroxide, talc, clay, silica, alumina, mica, glass powder, starch, charcoal, zeolites, any combination thereof, etc. Organic voiding agents, polymers that are immiscible in the major polymer matrix, can also be used. For instance, polystyrene can be used as a voiding agent in polyethylene and polypropylene films.

One of ordinary skill in the art will appreciate in view of the present disclosure that manufacturers may form the films or webs to be used with the present disclosure using a wide variety of techniques. For example, a manufacturer can form precursor mix of the thermoplastic material and one or more additives. The manufacturer can then form the film(s) from the precursor mix using conventional flat or cast extrusion or co-extrusion to produce monolayer, bilayer, or multilayer films. Alternatively, a manufacturer can form the films using suitable processes, such as, a blown film process to produce monolayer, bilayer, or multilayer films. If desired for a given end use, the manufacturer can orient the films by trapped bubble, tenterframe, or other suitable process. Additionally, the manufacturer can optionally anneal the films thereafter.

An optional part of the film-making process is a procedure known as "orientation." The orientation of a polymer is a reference to its molecular organization, i.e., the orientation of molecules relative to each other. Similarly, the process of orientation is the process by which directionality (orientation) is imposed upon the polymeric arrangements in the film. The process of orientation is employed to impart desirable properties to films, including making cast films tougher (higher tensile properties). Depending on whether the film is made by casting as a flat film or by blowing as a tubular film, the orientation process can require different procedures. This is related to the different physical characteristics possessed by films made by conventional film-making processes (e.g., casting and blowing). Generally, blown films tend to have greater stiffness and toughness. By contrast, cast films usually have the advantages of greater film clarity and uniformity of thickness and flatness, generally permitting use of a wider range of polymers and producing a higher quality film.

When a film has been stretched in a single direction (mono-axial orientation), the resulting film can exhibit strength and stiffness along the direction of stretch, but can be weak in the other direction, i.e., across the stretch, often splitting when flexed or pulled. To overcome this limitation, two-way or biaxial orientation can be employed to more evenly distribute the strength qualities of the film in two directions. Most biaxial orientation processes use apparatus that stretches the film sequentially, first in one direction and then in the other.

In one or more implementations, the films of the present disclosure are blown film, or cast film. Both a blown film and a cast film can be formed by extrusion. The extruder used can be a conventional one using a die, which will provide the desired gauge. Some useful extruders are described in U.S. Pat. Nos. 4,814,135; 4,857,600; 5,076,988; 5,153,382; each of which are incorporated herein by reference in their entirety. Examples of various extruders, which can be used in producing the films to be used with the present disclosure, can be a single screw type modified with a blown film die, an air ring, and continuous take off equipment.

In one or more implementations, a manufacturer can use multiple extruders to supply different melt streams, which a feed block can order into different channels of a multi-channel die. The multiple extruders can allow a manufacturer to form a film with layers having different compositions. Such multi-film bags may later be provided with a complex stretch pattern to provide the benefits of the present disclosure.

In a blown film process, the die can be an upright cylinder with a circular opening. Rollers can pull molten thermoplastic material upward away from the die. An air-ring can cool the film as the film travels upwards. An air outlet can force compressed air into the center of the extruded circular profile, creating a bubble. The air can expand the extruded circular cross section by a multiple of the die diameter. This ratio is called the "blow-up ratio." When using a blown film process, the manufacturer can collapse the film to double the plies of the film. Alternatively, the manufacturer can cut and fold the film, or cut and leave the film unfolded.

In any event, in one or more implementations, the extrusion process can orient the polymer chains of the blown film. The "orientation" of a polymer is a reference to its molecular organization, i.e., the orientation of molecules or polymer chains relative to each other. In particular, the extrusion process can cause the polymer chains of the blown film to be predominantly oriented in the machine direction. The orientation of the polymer chains can result in an increased strength in the direction of the orientation. As used herein predominately oriented in a particular direction means that the polymer chains are more oriented in the particular direction than another direction. One will appreciate, however, that a film that is predominately oriented in a particular direction can still include polymer chains oriented in directions other than the particular direction. Thus, in one or more implementations the initial or starting films (films before being stretched or bonded or laminated in accordance with the principles described herein) can comprise a blown film that is predominately oriented in the machine direction.

The process of blowing up the tubular stock or bubble can further orient the polymer chains of the blown film. In particular, the blow-up process can cause the polymer chains of the blown film to be bi-axially oriented. Despite being bi-axially oriented, in one or more implementations the polymer chains of the blown film are predominantly oriented in the machine direction (i.e., oriented more in the machine direction than the transverse direction).

The films of one or more implementations of the present disclosure can have a starting gauge between about 0.1 mils to about 20 mils, suitably from about 0.2 mils to about 4 mils, suitably in the range of about 0.3 mils to about 2 mils, suitably from about 0.6 mils to about 1.25 mils, suitably from about 0.9 mils to about 1.1 mils, suitably from about 0.3 mils to about 0.7 mils, and suitably from about 0.4 mils and about 0.6 mils. Additionally, the starting gauge of films of one or more implementations of the present disclosure may not be uniform. Thus, the starting gauge of films of one or more implementations of the present disclosure may vary along the length and/or width of the film.

As described above, a multi-film thermoplastic bag includes a plurality of thermoplastic films. Each individual film may itself include a single layer or multiple layers. In other words, the individual films of the multi-film bag may each themselves comprise a plurality of layers. Such layers may be significantly more tightly bonded together than the bonding (if any). Both tight and relatively weak bonding can be accomplished by joining layers by mechanical pressure, joining layers with heat, joining with heat and pressure, joining layers with adhesives, spread coating, extrusion coating, ultrasonic bonding, static bonding, cohesive bonding and combinations thereof. Adjacent sub-layers of an individual film may be coextruded. Co-extrusion results in tight bonding so that the bond strength is greater than the tear resistance of the resulting laminate (i.e., rather than allowing adjacent layers to be peeled apart through breakage of the lamination bonds, the film will tear).

Figure 1B:
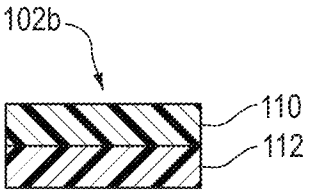
Figure 1A:
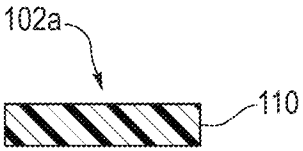

A thermoplastic film can may include a one, two, three, or more layers of thermoplastic material. FIGS. 1A-1C are partial cross-sectional views of films that can be included in a multi-film thermoplastic bag of one or more implementations. In some implementations, the film may include a single layer film 102*a*, as shown in FIG. 1A, comprising a single first layer 110. In other embodiments, the film can comprise a two-layer film 102*b* as shown in FIG. 1B, including the first layer 110 and a second layer 112. The first and second layers 110, 112 can be coextruded. In such implementations, the first and second layers 110, 112 may optionally include different grades of thermoplastic material and/or include different additives, including polymer additives and/or pigments. In yet other implementations, a film be a tri-layer film 102*c*, as shown in FIG. 1C, including the first layer 110, the second layer 112, and the third layer 114. In yet other implementations, a film may include more than three layers. The tri-layer film 102*c* can include an A:B:C configuration in which all three layers vary in one or more of gauge, composition, color, transparency, or other properties. Alternatively, the tri-layer film 102*c* can comprise an A:A:B structure or A:B:A structure in which two layers have the same composition, color, transparency, or other properties. In an A:A:B structure or A:B:A structure the A layers can comprise the same gauge or differing gauge. For example, in an A:A:B structure or A:B:A structure the film layers can comprise layer ratios of 20:20:60, 40:40:20, 15:70:15, 33:34:33, 20:60:20, 40:20:40, or other ratios.

In one example, the film 102*a* can comprise a 0.5 mil, 0.920 density LLDPE, colored film containing 4.8% pigment that appears a first color. In an alternative embodiment, the film 102*a* can comprise a 0.5 mil, 0.920 density LLDPE, un-pigmented film that appears clear or substantially clear. In still further embodiments, the film 102*a* can comprise a 0.5 mil, 0.920 density LLDPE, pigmented film that appears a second color.

In at least one implementation, such as shown in FIG. 1C, a multilayered film 102*c* can include co-extruded layers. For example, the film 102*c* can include a three-layer B:A:B structure, where the ratio of layers can be 20:60:20. The exterior B layers (i.e., the first layer 110, and the third layer 114) can comprise a mixture of hexene LLDPE of density 0.918, and metallocene LLDPE of density 0.920. The interior A core layer (i.e., the second layer 112) can comprise a mixture of hexene LLDPE of density 0.918, butene LLDPE of density 0.918, reclaimed resin from trash bags. Additionally, the A core layer (i.e., the second layer 112) can include a pigment. For example, the A core layer can include a colorant in an amount between about 0.1 percent and about 6%.

In another example, the film 102*c* is a coextruded three-layer B:A:B structure where the ratio of layers is 15:70:15. The B:A:B structure can also optionally have a ratio of B:A that is greater than 20:60 or less than 15:70. In one or more implementations, the LLDPE can comprise greater than 50% of the overall thermoplastic material in the film 102*c*.

In another example, the film 102*c* is a coextruded three-layer C:A:B structure where the ratio of layers is 20:60:20. The C layer (i.e., the third layer 114) can comprise a LLDPE material with a first colorant (e.g., black). The B layer (i.e., the second layer 112) can also comprise a LLDPE material with a second colorant (e.g., white). The LLDPE material can have a MI of 1.0 and density of 0.920 g/cm3. The A core layer (i.e., the first layer 110) can comprise similar materials to any of the core layer describe above. The A core layer can comprise a black colorant, a white colorant, or can be clear.

In still further embodiments, a film can comprise any number of co-extruded layers. More particularly in one or more embodiments, a film can comprise any number of co-extruded layers so long as the A and B layers do not alternate such that the A layers are on one side and the B layers are on the other side. In still further embodiments, a film can comprise one or more co-extruded layers between the A and B layers. For example, the film can comprise clear or transparent layers between the A and B layer(s). In still further embodiments, a film can comprise intermittent layers of different colors in addition to the A and B layer(s).

Figure 2A:
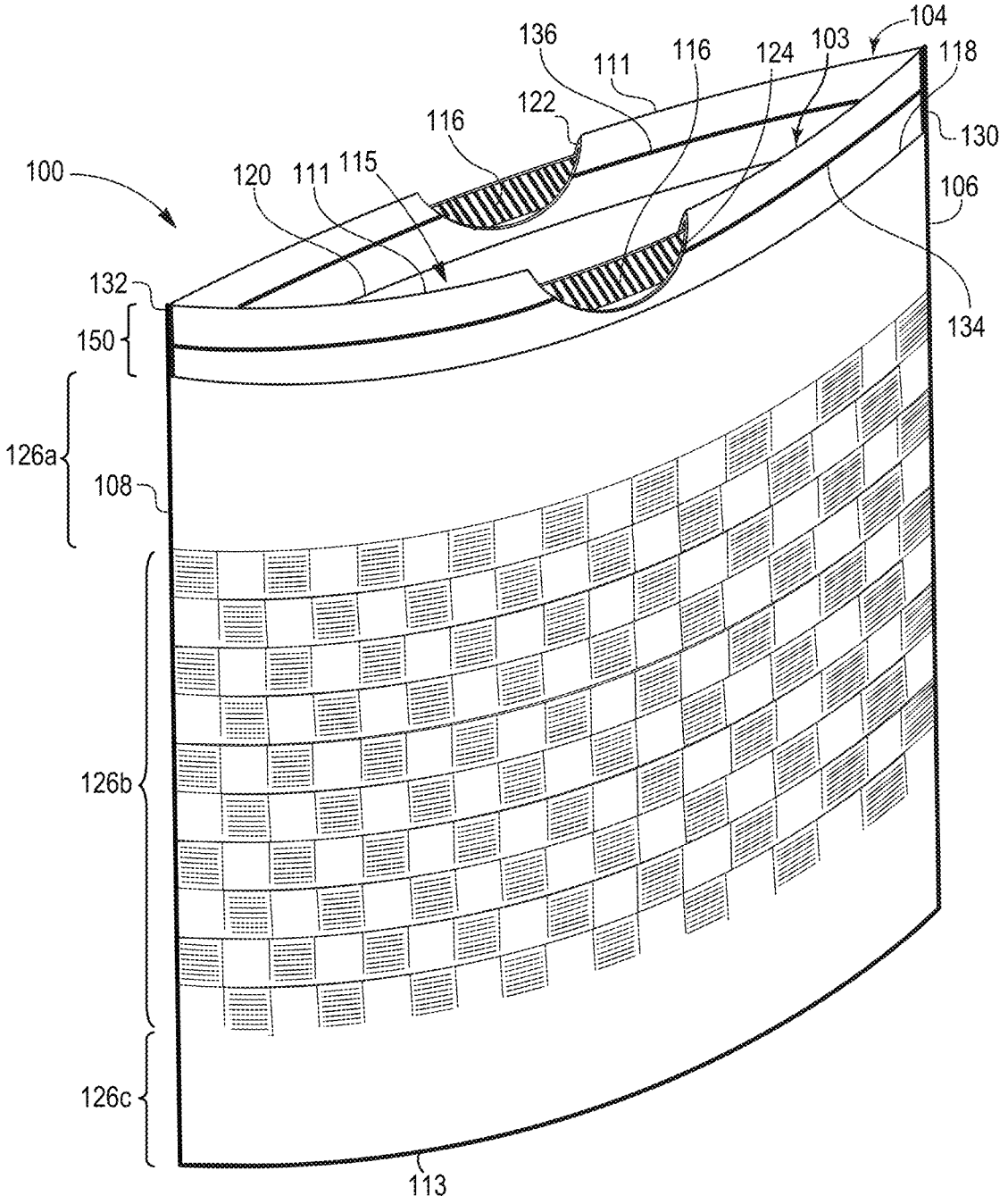
FIG. 2A shows a shows a perspective view of a multi-film thermoplastic bag with a conjoined hem channel according to one or more implementations of the present disclosure.

FIG. 2A is a perspective view of a multi-film thermoplastic bag 100 having a conjoined hem channel according to an implementation of the present disclosure. The multi-film thermoplastic bag 100 includes a first sidewall 103 and a second sidewall 104. Each of the first and second sidewalls 103, 104 includes a first side edge 106, a second opposite side edge 108, a bottom edge 113 extending between the first and second side edges 106, 108. Each of the first and second sidewalls 103, 104 also includes a top edge 111 extending between the first and second side edges 106, 108 opposite the bottom edge 113. In some implementations, the first sidewall 103 and the second sidewall 104 are joined together along the first side edges 106, the second opposite side edges 108, and the bottom edges 113. The first and second sidewalls 103, 104 may be joined along the first and second side edges 106, 108 and bottom edges 113 by any suitable process such as, for example, a heated pressure seal. In alternative implementations, the first and second sidewalls 103, 104 may not be joined along the side edges. Rather, the first and second sidewalls 103, 104 may be a single uniform piece. In other words, the first and second sidewalls 103, 104 may form a sleeve or a balloon structure.

In some implementations, the bottom edge 113 or one or more of the side edges 106, 108 can comprise a fold. In other words, the first and second sidewalls 103, 104 may comprise a single unitary piece of material. The top edges 111 of the first and second sidewalls 103, 104 may define an opening 115 to an interior of the multi-film thermoplastic bag 100. In other words, the opening 115 may be oriented opposite the bottom edge 113 of the multi-film thermoplastic bag 100. Furthermore, when placed in a trash receptacle (e.g., trash can), the top edges 111 of the first and second sidewalls 103, 104 may be folded over the rim of the receptacle.

In some implementations, the multi-film thermoplastic bag 100 may optionally include a closure mechanism located adjacent to the top edges 111 for sealing the top of the multi-film thermoplastic bag 100 to form an at least substantially fully-enclosed container or vessel. As shown in FIG. 2A, in some implementations, the closure mechanism comprises a drawtape 116. As shown the drawtape 116 can optionally be ribbed. The ribs of the drawtape 116 can provide the drawtape 116 with an elastic characteristic. For example, the drawtape can comprise such as that disclosed in U.S. Pat. No. 9,604,760, the entire contents of which are hereby incorporated by reference.

The multi-film thermoplastic bag 100 also includes a first hem seal 118, and a second hem seal 120. In particular, the first top edge 111 of the first sidewall 103 may be folded over into the interior volume and may be attached or secured to an interior surface of the first sidewall 103 by first hem seal 118. Similarly, the second top edge 111 of the second sidewall 104 is folded over into the interior volume and may be attached to an interior surface of the second sidewall 104 by a second hem seal 120. The drawtape 116 extends through a hem channel 150 created by the first and second hem seals 118, 120 along the first and second top edges 111. The hem channel 150 is the channel between the top edges 111 and the hem seals 118, 120 and extends between a first tape seal 130 and a second tape seal 132. The tape seals 130, 132 secure the ends of the draw tape 116 to the sides 106, 108 of the multi-film thermoplastic bag 100.

The first hem channel 150 of the first side wall 103 includes a first aperture 124 (e.g., notch) extending through the hem channel 150 and exposing a portion of the drawtape 116. Similarly, the second hem channel 150 of the second side wall 104 includes a second aperture 122 extending through the hem channel 150 and exposing another portion of the drawtape 116. During use, pulling the drawtape 116 through the first and second apertures 122, 124 will cause the top edges 111 to constrict. As a result, pulling the drawtape 116 through the first and second apertures 122, 124 will cause the opening 115 of the multi-film thermoplastic bag 100 to at least partially close or reduce in size. The drawtape closure mechanism may be used with any of the implementations of a multi-film thermoplastic bag described herein.

Each of the sidewalls 103, 104 of the multi-film thermoplastic bag 100 comprise a multi-film thermoplastic structure. Thus, each sidewall 103, 104 includes at least an inner layer and an outer layer. Indeed, the thermoplastic bag 100 has a bag-in-bag structure. In other words, the thermoplastic bag 100 includes a first bag and a second bag positioned therein. More particularly, the thermoplastic bag comprises first and second opposing sidewalls joined together along a first side edge, an opposite second side edge, and a closed first bottom edge. The second thermoplastic bag is positioned within the first thermoplastic bag. The second thermoplastic bag comprises third and fourth opposing sidewalls joined together along a third side edge, an opposite fourth side edge, and a closed second bottom edge.

In one or more implementations, the first thermoplastic bag (e.g., the outer layer) is pigmented with a first color, and the second thermoplastic bag is pigmented with a second color (e.g., the inner layer is pigmented with the second color). As described above, the differing colors of the layers can allow for the creation of bonds 134, 136 when the inner bag and the outer bag are placed into intimate contact.

More particularly, the bonds 134, 136 can comprise areas in which the first thermoplastic film is in direct, or intimate, contact with the second thermoplastic film. As such, the bonds 134, 136 can create regions that are visually distinct from the areas in which the films of the multi-film thermoplastic bag 100 are not in intimate contact (at least when viewing the outer surface of the multi-film thermoplastic bag 100). In other words, because the first thermoplastic film is directly abutted against the second thermoplastic film, the bonds 134, 136 can have the color or appearance of the second thermoplastic film or another color or appearance that differs from the separated portions of the first thermoplastic film.

For example, in one or more implementations, the second thermoplastic film can comprise a pigmented film and have a black appearance while the first thermoplastic film is substantially un-pigmented or lightly pigmented and have a clear, transparent, or cloudy appearance. When combined to form a multi-film thermoplastic bag 100 in accordance the principles described herein, the first thermoplastic film as part of the multi-film thermoplastic bag 100 can have a color or appearance that differs from the color of the first thermoplastic film. For example, the first thermoplastic film can have a metallic, silvery metallic or light grey color rather than a black appearance or color as would be expected (i.e., due to viewing the second thermoplastic film through a clear or transparent film). The regions or areas of the two films in intimate contact with each other create bonds 134, 136 that have a color or appearance that differs from the color or appearance of the first thermoplastic film. For example, the bonds 134, 136 can have the color or appearance of the second thermoplastic film (e.g., black).

In one or more alternative implementations, the first thermoplastic film comprises a light colorant while the second thermoplastic film comprises a dark colorant. As used herein, a light colorant is a color with a brightness closer to the brightness of white than the brightness of black. As used herein, a dark colorant is a color with a brightness closer to the brightness of black than the brightness of white. In one or more embodiments, the first thermoplastic film has a concentration of light colorant between about 1% by mass and about 15% by mass. More particularly, in one or more embodiments, the first thermoplastic film has a concentration of light colorant between about 2% by mass and about 12% by mass. In still further embodiments, the first thermoplastic film 204 has a concentration of light colorant between about 5% by mass and about 10% by mass.

Still further, the second thermoplastic film has a concentration of dark colorant between about 1% by mass and about 15% by mass. More particularly, in one or more embodiments, the second thermoplastic film has a concentration of dark colorant between about 2% by mass and about 12% by mass. In still further embodiments, the second thermoplastic film has a concentration of dark colorant between about 5% by mass and about 10% by mass.

The white colored first thermoplastic film, when part of the multi-film thermoplastic bag 100 can have a gray appearance. The foregoing described color change may give the appearance of a third color without requiring the actual colorant mixture of the third color to be within the multi-film thermoplastic bag 100. In other words, the bag can be devoid of a gray pigment. For example, it may allow a film having a viewable black layer and a viewable white layer to have (i.e., mimic) a gray appearance (often a consumer preferred color). Furthermore, the foregoing described color change may allow the film to mimic a gray appearance without significantly increasing and/or reducing a transparency (i.e., light transmittance) of the film. In other words, the foregoing described color change may allow the multi-film thermoplastic bag 100 to mimic a gray appearance without detrimentally affecting an appearance of quality of the film.

Thus, the bonds 134, 136 have a color or appearance that differs from the color or appearance of the first thermoplastic film. For example, the bonds 134, 136 can have the color or appearance of the second thermoplastic film (e.g., black) or another color. One will appreciate in light of the disclosure herein that black and white are used as exemplary colors for ease in explanation. In alternative embodiments, the films can comprise other color combinations such as white and blue, yellow and blue, red and blue, etc.

Irrespective of the specific colors of the first and second thermoplastic films, the bonds 134, 136 can have a substantial change in appearance compared to the separated areas when viewed from the first thermoplastic film side of the multi-film thermoplastic bag 100. In some embodiments, for example, when using the LAB color space, a represents a measurement of green and magenta values, b represents a measurement of blue and yellow values, and L represents a measurement of lightness (i.e., white and back values). In some embodiments, the change in appearance of the bonds 134, 136 comprises a color change in which the L value decreases by at least five points. In some embodiments, the change in appearance of the bonds 134, 136 comprises a color change in which the L value decreases between five and forty points, between five and thirty points, or between five and twenty points.

For example, the change in appearance of the bonds 134, 136 may include a perceivable change of color from gray to black. In additional embodiments, the change in appearance of the bonds 134, 136 may include a perceivable change of color from a first relatively lighter color to a second darker color. For example, the change in appearance may include perceivable change of color from a first light gray to a second dark gray. In other implementations, the change in appearance may include perceivable change of color from a first lighter version of any color to a second darker version of the same color.

As another example, it may allow a film having a viewable blue layer (with a back yellow layer) to have (i.e., mimic) a green appearance. Furthermore, the foregoing described color change may allow the film to mimic a green appearance without significantly increasing and/or reducing a transparency (i.e., light transmittance) of the film. In other words, the foregoing described color change may allow the film to mimic a green appearance without detrimentally affecting an appearance of quality of the film. As a result of the foregoing, the multi-film thermoplastic bag of the present disclosure may provide a multi-layer film having a particular appearance (e.g., a green appearance) while reducing costs. One will appreciate that other color combination in addition to white/black producing grey and yellow/blue producing green are possible and the foregoing are provided by way of example and not limitation.

Due to the multiple films construction of the sidewalls 103, 104, the folded portions of the sidewalls 103, 104 that form the hem channels 150 include multiple layers. To help ensure that the drawtape 116, when being cinched, does not bunch at the notches 122, 124 by pulling the inner layer away from the outer layer of the hem channel 150, the hem channels 150 each include one or more bonds 134, 136 that secure the layers of the hem channels 150 together. Additionally, the bonds 134, 136 can also prevent the drawtape 116, when being cinched, from inverting the inner layer away from the outer layer of the hem channel 150. Thus, the bonds 134, 136 securing the layers of the hem channels 150 can reduce the force required to pull the drawstring 116 through hem channel and the notches 122, 124 to cinch the top of the multi-film thermoplastic bag 100. As such, the bonds 134, 136, can help create a tactile perception of an easy cinchable bag.

Figure 2B:
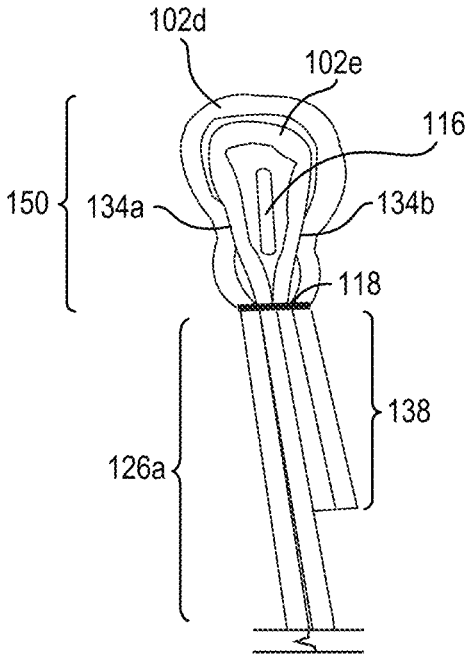
FIG. 2B shows a partial cross-sectional view of a hem channel of the multi-film thermoplastic bag with the conjoined hem channel of FIG. 2A.

As shown by FIG. 2B, a cross-sectional view of the hem channel 150 of the first sidewall 103. In particular, the multi-film thermoplastic bag 100 includes an outer first thermoplastic bag and an inner second thermoplastic bag positioned within the first thermoplastic bag. The top edges of the first thermoplastic bag and the second thermoplastic bag are folded over the drawtape 116 to form a hem channel 150. The drawtape 116 is movable in the hem channel 150 so as to cinch the multi-film thermoplastic bag 100 closed when pulled through the first and second apertures 122, 124 (e.g., shown in FIG. 2A above).

In one or more implementations each hem channel 150 can comprise two bonds 134*a*, 134*b*—one on each side of the hem channel 150. Each bond 134*a*, 134*b* can secure the outer film layer 102*d* to the inner film layer 102*e* of the hem channel 150. The bonds 134*a*, 134*b* can be positioned between the hem seal 118 and the top of the hem channel 150.

While FIG. 2B shows a bond 134*a*, 134*b* on each side of the hem channel 150, the present invention is not so limited. In alternative implementations, the hem channel 150 includes bond(s) only on one side of the hem channel 150. Additionally, as described in greater detail below, in one or more implementations the hem skirt 138 and/or the grab zone 126*a* can include bonds securing the outer film layer 102*d* to the inner film layer 102*e*.

As mentioned above, the one or more bonds 134*a*, 134*b* in the hem channel 150 reduce an amount of surface area of the inner surface of the hem channel 150 that comes in contact with the drawtape 116, thereby reducing an amount of mechanical engagement between the inner surface of the hem channel 150 and the drawtape 116. For example, the bonds 134*a*, 134*b* bring areas of the outer film layer 102*d* to the inner film layer 102*e* into intimate contact. As the entire hem channel is not bonded, the combination of the bonds 134*a*, 134*b* and the non-bonded areas can create an uneven surface along the inner film layer 102*e*. Due to the uneven surface created by the bonds 134*a*, 134*b*, the surface areas of the inner surface of the hem channel 150 that interacts with the drawtape 116 is reduced, which then reduces the amount of force required to pull the drawtape 116 through the hem channel 150. Therefore, a customer pulling the drawtape 116 in order to cinch the multi-film thermoplastic bag 100 closed would experience less drag on the drawtape 116. Moreover, the reduction in mechanical engagement between the inner surface of the hem channel 150 and the drawtape 116 further reduces a previous tendency of the inner surface of the hem channel 150 to invert and bunch around the hem channel apertures when the drawtape is pulled through the hem channel 150.

As further shown in FIG. 2B, folding over the top edges of the first and second bags (i.e., the outer film layer 102*d* to the inner film layer 102*e*) creates a hem skirt 138 extending from the hem seals 118 down an inner surface of the multi-film thermoplastic bag 100. The hem skirt 138 can have a length of in a first range of about 0.1 inch (0.254 cm) to about 10 inches (25.4 cm), a second range of about 0.5 inches (1.27 cm) to about 8 inches (20.3 cm), a third range of about 1 inches (2.54 cm) to about 6 inches (15.2 cm), a fourth range of about 3 inches (7.6 cm) to about 6 inches (15.2 cm). In one or more implementations, the hem skirt 138 has a length of 0.5 inches (1.27 cm). In another implementation, the hem skirt 138 has a length of 4 inches (10.2 cm). In one implementation, the hem skirt 138 has a length of 5 inches (12.7 cm). In another implementation, the hem skirt 138 has a length that is shorter or longer than the examples listed above.

The grab zone or first region 126*a* may have a length (distance the grab zone extends from the hem channel toward the bottom of the bag) of about 1 inch (2.54 cm) to about 10 inches (25.4 cm), a second range of about 3 inches (7.6 cm) to about 8 inches (20.3 cm), a third range of about 4 inches (10.2 cm) to about 6 inches (15.2 cm), a fourth range of about 3 inches (7.6 cm) to about 6 inches (15.2 cm). In one implementation, the grab zone has a length of 5 inches (12.7 cm). In a further implementation, the grab zone has a length of 4 inches (10.2 cm). In another implementation, the grab zone has a length that is shorter or longer than the examples listed above.

Furthermore, the hem skirt 138 can have a length that is co-extensive or the same length as the grab zone 126*a*. Alternatively, the hem skirt 138 has a length less than a length of the grab zone 126*a*. For example, FIG. 2B illustrates that the hem skirt 138 has a length approximately 66% of the length of the grab zone 126*a*. In alternative implementations, the hem skirt 138 has a length approximately 10%, 20%, 25%, 33%, 50%, 75%, 80% or 90% of the length of the grab zone 126*a*. In another implementation, the hem skirt 138 has a length that is relatively shorter or longer than the examples listed above compared to the grab zone 126*a*. For example, in one or more implementations, the hem skirt 138 is longer than the grab zone 126*a*.

Returning to FIG. 2A, the bonds 134, 136 can provide a tactilely measurable increase in the stiffness of the hem channel 150. In particular, by bonding the layers of the hem channel 150 together, the hem channel can have increased stiffness, which a user can feel when grasping the top of the multi-film thermoplastic bag 100. Furthermore, the bonds 134, 136 can provide the increased stiffness without weaking the films (e.g., the TD tensile strength is not significantly lower than hem channels without bonds 134, 136).

Additionally, as mentioned the inner film of the sidewalls 103, 104 can comprise a dark color and the outer film of the sidewalls 103, 104 can comprise a lighter color or be transparent or translucent. As such, when the inner film and outer films of the sidewalls are brought into intimate contact by the bonds 134, 136, the bonds 134, 136 can take on the color of the inner film. As such, the bonds 134, 136 can have a different color or appearance than the rest of the hem channel 150 in which the inner film and the outer film are not in intimate contact. Thus, in one or more implementations, the bonds in the hem channel impart a decorative feature or aesthetic to the multi-film thermoplastic bag 100. For example, the bonds of the hem channel 150 can comprise stripes, circles, stars, triangles, dots, dashes, words, or other shapes and patterns. Furthermore, the bonds of the hem channel 150, in one or more implementations, can match or correspond to patterns in other areas of the multi-film thermoplastic bag 100.

As shown in FIG. 2A, in one or more implementations, the bonds 134, 136 of the hem channels 150 are continuous (i.e., extend from one side of the hem channel 150 to an opposing side of the hem channel 150). In alternative implementations as shown and described below, the bonds of the hem channel 150 can be discontinuous. For example, the bonds can comprise repeating patterns (e.g., a grid pattern, repeating diamond pattern). Still further, the hem channels 150 of the multi-film thermoplastic bag 100 of FIG. 2A each include a single bond 134, 136. In alternative implementations, the hem channels 150 can comprise two, three, or multiple bonds securing the films of the hem channel 150 together.

The bonds 134, 136 can comprise heat seals. When heat seals, the bonds 134, 136 can comprise a bond strength that resists delamination. In particular, in one or more implementations, the bonds 134, 136 have a bond strength that ensures that the inner film layer of the hem channel 150 does not separate from the outer film layer when the drawtape 116 is pulled through the hem channel 150. In alternative implementations, the bonds 134, 136 can comprise ultrasonic welds. In other alternative implementations, the bonds 134, 136 can comprise bonds formed by pressure and/or heat, ring rolling, SELFing, or comprise contact areas as described in greater detail below. In one or more implementations, the bonds have a bond strength that allows the bonds to separate without damaging the bonded film layers (e.g., a peelable lamination) as described in greater detail below in relation to the implementations in which the bonds comprise contact areas.

In still further implementations, the bonds 134, 136 comprise adhesive bonds. For example, adhesive between the inner film layer and the outer film layer of the hem channel can provide inter-ply adhesion to create the bonds 134, 136. Furthermore, in one or more implementations, the adhesive is introduced during extrusion as a component of the skin layers of one or more of the inner film layer or the outer film layer. Alternatively, the adhesive is printed or coated onto one or more of the inner film layer or the outer film layer during extrusion. Still further, in one or more implementations, the adhesive is applied to one or more of the inner film layer or the outer film layer during the bag conversion process.

As shown in FIG. 2A, the multi-film thermoplastic bag 100 includes a first region or grab zone 126*a*, a second region 126*b*, and a third region 126*c*. In one or more implementations the grab zone 126*a* extends from the top of the multi-film thermoplastic bag 100 to the second region 126, and thus, includes the hem channel 150. In alternative implementations, the grab zone extends from the first hem seal 118 toward the bottom edge 113 of the multi-film thermoplastic bag 100 a first distance.

The third or bottom region 126*c* of the multi-film thermoplastic bag 100 is a flat portion of the multi-film thermoplastic bag 100. In one or more implementations, the second region 126*b* includes SELF'ed or ring rolled patterns. For example, as shown in FIG. 2A, the second region 126*b* includes a checkerboard pattern of SELF'ed squares as described in International Patent Application No. PCT/US2018/058998 filed on May 16, 2019 and entitled "THERMOPLASTIC FILMS AND BAGS WITH COMPLEX STRETCH PATTERNS AND METHODS OF MAKING THE SAME," hereby incorporated by reference in its entirety.

As shown by FIG. 2A, the checkboard pattern of deformations can comprise a repeating pattern of raised rib-like elements. In particular, the checkboard pattern of deformations can include a first plurality of rib-like elements arranged pattern. Portions of the raised rib-like elements of the outer layer can be in direct contact and have the appearance of the inner of the bag 100. The portions of deformations (e.g., raised rib-like element of a SELFing pattern or alternating thicker ribs and thinner stretched webs of a ring rolling pattern) stretch the film incrementally to create areas of varying gauge or thickness.

The thermoplastic bag 100, as shown, includes side heat seals along the side edges 106, 108. As shown, the side heat seals can comprise areas in which all four or more layers of the thermoplastic bag are in intimate contact. As such, the side heat seal (and any other heat seals such as a hem seal) can have the same appearance as the bonds.

Figure 2C:
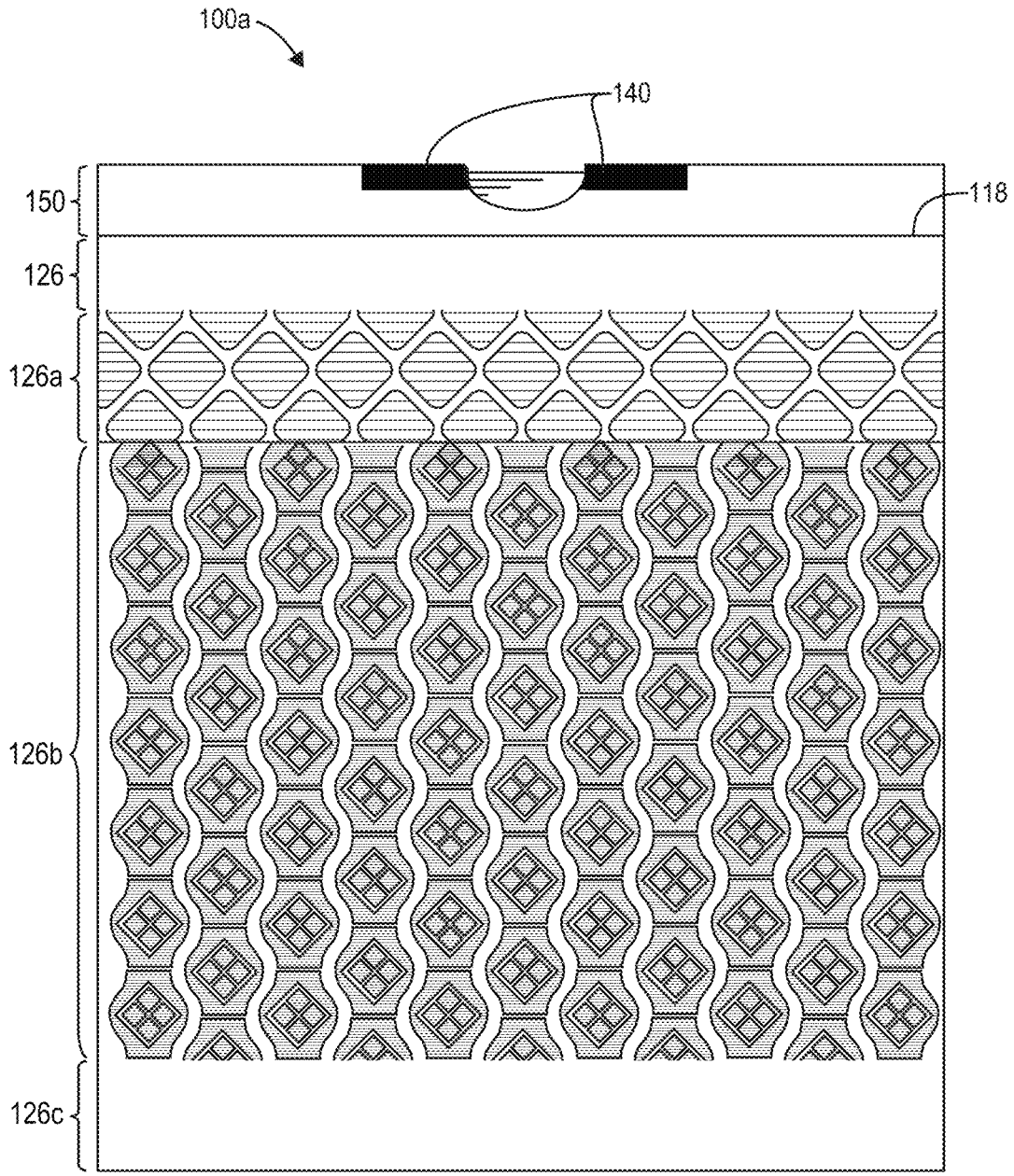
FIGS. 2C-2G show various multi-film thermoplastic bags with conjoined hem channels according to one or more implementations of the present disclosure.

The bonds securing the layers of the hem channel together can have various configurations, patterns, numbers, sizes, etc. For example, FIG. 2C illustrates another example of a multi-film thermoplastic bag 100*a* having a conjoined hem channel 150. The multi-film thermoplastic bag 100*a* can have the same constructure and features as the multi-film thermoplastic bag 100 described above, albeit with the differences pointed out below. In particular, rather than the bonds being continuous, the bonds can be discontinuous. In particular, the bonds 140 of the multi-film thermoplastic bag 100*a* are discontinuous in that they do not extend the entire length of the hem channel 150. In particular, the bonds 140 extend from the drawtape notch toward the tape or side seals a distance that is less than the length of the hem channel 150. In one or more implementations, the length that the bonds 140 extend from the drawtape notch toward the side seal is in a range of a half inch (1.27 cm) to 10 inches (25.4 cm), a second range of about 3 inches (7.6 cm) to about 8 inches (20.3 cm), a third range of about 4 inches (10.2 cm) to about 6 inches (15.2 cm), a fourth range of about 1 inch (2.54 cm) to 3 inches (7.6 cm). In one implementation, the bonds 140 have a length of one inch (2.54 cm) or two inches (5.08 cm).

Additionally, the bonds 140 can span or extend across the top edge of the multi-film thermoplastic bag 100*a*. As such, the same bond 140 can secure the inner and outer layers of both sides of the hem channel 150 together rather than each side of the hem channel 150 having a separate bond as described above in relation to FIG. 2B. In any event, the position adjacent to the drawtape notches can help ensure that the hem channel 150 does not bunch or gather at the notches as the drawtape 116 is cinched.

FIG. 2C also illustrates that the grab zone can comprise an upper grab zone 126 that is un-patterned or deformed and a lower grab zone 126*a* that includes a pattern of raised rib-like elements in a diamond pattern that form a strainable network. In particular, the diamond pattern of raised rib-like elements can be formed by SELFing rollers and provide the grab zone with an elastic like characteristic. FIG. 2C also illustrates that the second area 126*b* includes raised rib-like elements in a strainable network or alternating thicker ribs and thinner stretched webs. As shown, the pattern of deformations in the second area 126*b* is distinct from the pattern deformations in the lower grab zone 126*a*. As shown, the second area 126*b* includes a pattern of elements that includes diamonds and wavy lines. For example, the pattern of elements in the second area 126*b* can be a SELF'ing. In particular, the pattern or raised rib-like elements in the second area 126*b* includes a SELFing pattern of bulbous areas with nested diamonds. Wavy land areas separate the SELFing patterns. In some implementations, the wavy land areas may be bonds between the layers of the sidewalls as well. More particularly, the second region 126*b* includes a pattern as described in International Patent Application No. PCT/US2018/058998 filed on May 16, 2019 and entitled "THERMOPLASTIC FILMS AND BAGS WITH COMPLEX STRETCH PATTERNS AND METHODS OF MAKING THE SAME," hereby incorporated by reference in its entirety.

Figure 2D:
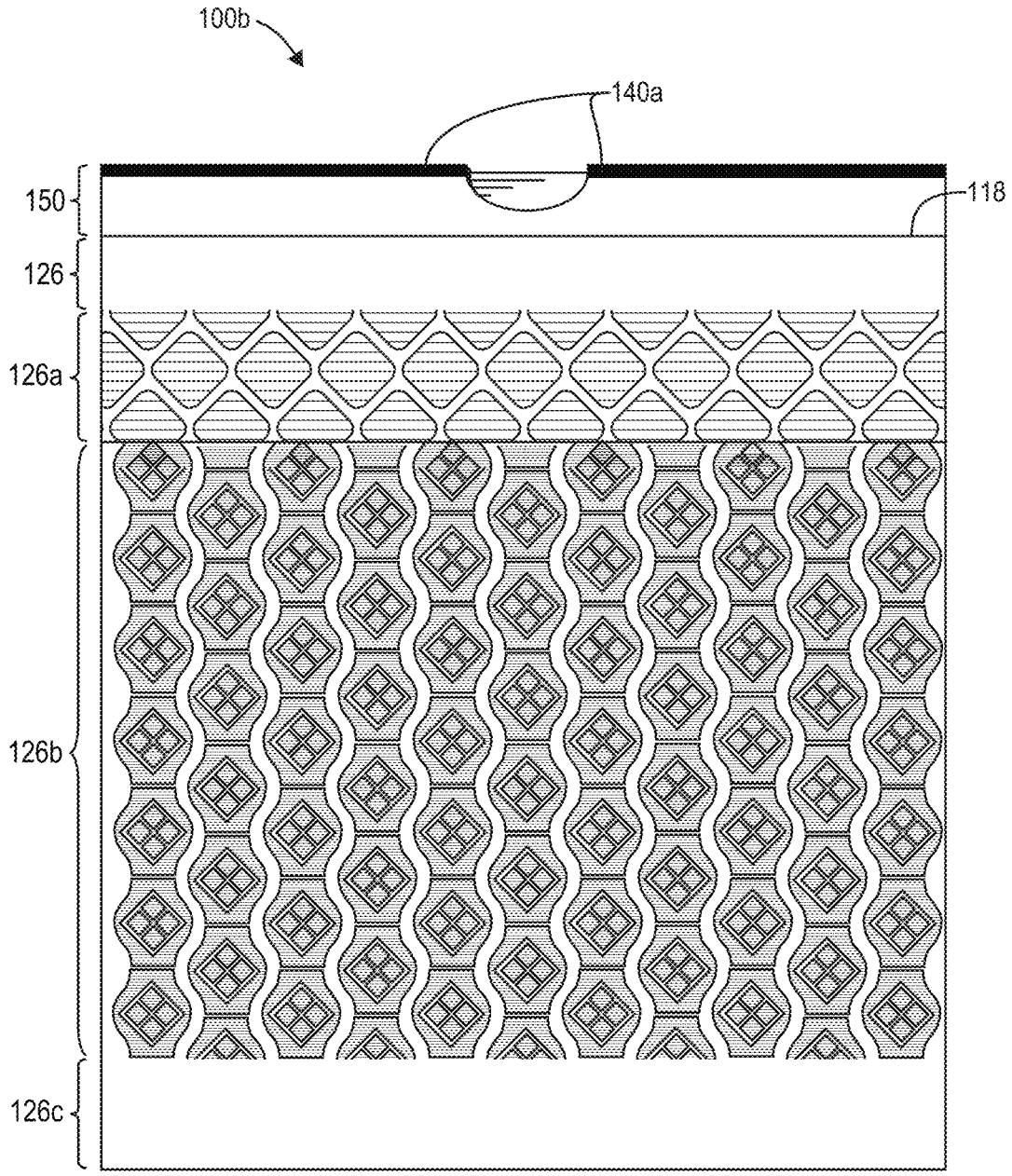

In another implementation, as shown in FIG. 2D, the multi-film thermoplastic bag 100*b* has a hem channel 150 that includes bonds 140*a* extending along a top-edge of one or both sidewalls of the multi-film thermoplastic bag 100*b*. As shown, the placement of the bonds 140 along the top-edge of one or both sidewalls of the multi-film thermoplastic bag 100*b* helps reduce mechanical engagement between the drawtape and the top of the inner surface of the hem channel 150 when the drawtape is pulled up vertically—such as when a user is pulling a trash bag up and out of a receptacle by the drawtape. In particular, as shown in FIG. 2D, the bonds 140*a* can extend the entire length from the drawtape notch to the sides seals.

Figure 2E:
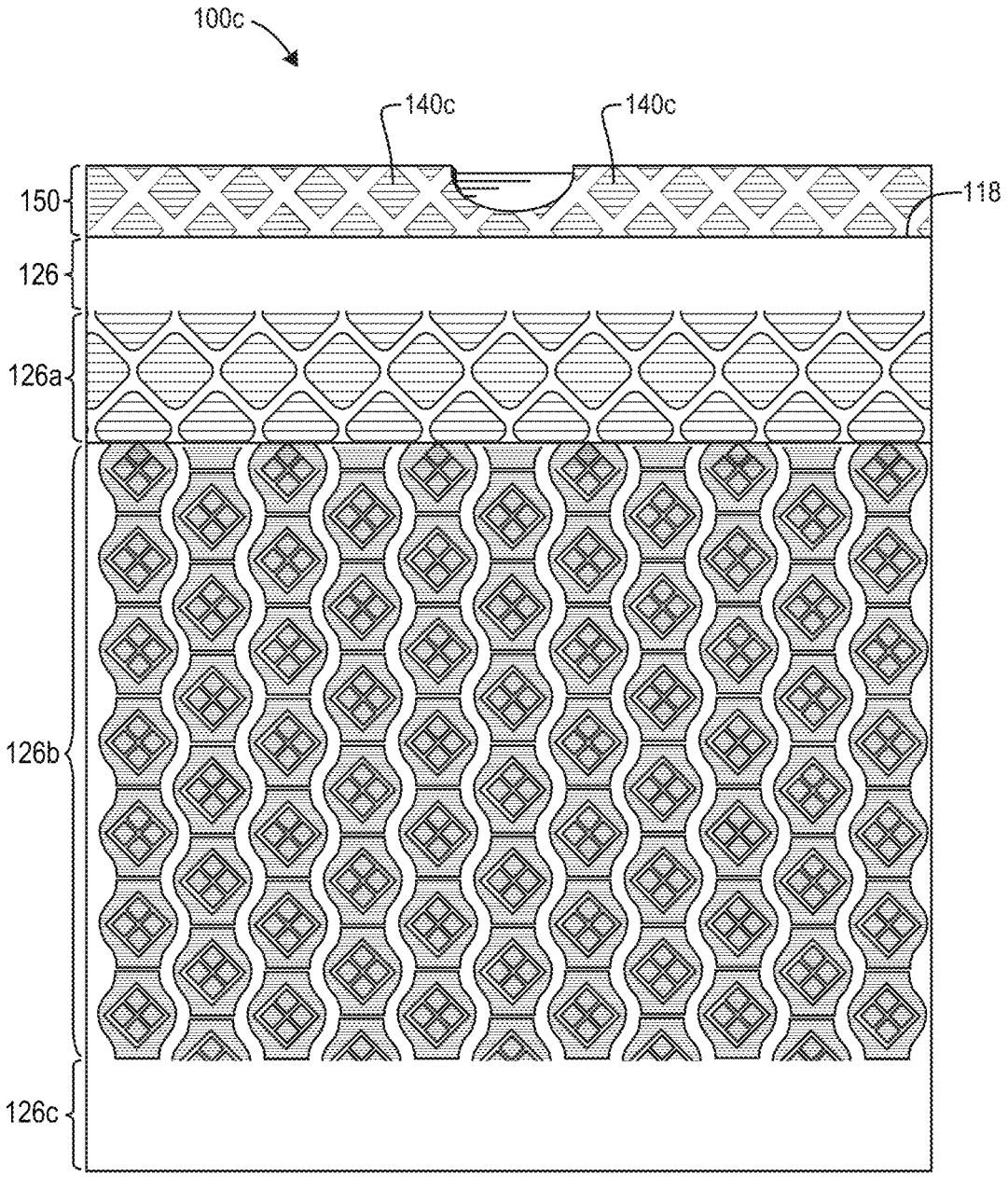

While the bonds 134, 136, 140, 140*a* comprise heat seals, ultrasonic bonds, or adhesive bonds, the present invention is not so limited. For example, FIG. 2E illustrates a multi-film thermoplastic bag 100*c* with conjoined hem seals 150 with bonds 140*c* formed by SELF'ing. In particular, the hem channel 150 can include a pattern of deformations including at least one of raised rib-like elements in a strainable network or alternating thicker ribs and thinner stretched webs. For example, as shown in FIG. 2E, the pattern includes 1) deformable areas that provide visible expansion upon stress (e.g., the diamonds and lines), and 2) land areas (e.g., flat and undeformed film) that resist deformation by including a length dimension oriented in the direction of applied stress (e.g., the TD direction such as when the multi-film thermoplastic bag 100 is pulled up vertically by the drawtape). In at least one implementation, when the hem channel 150 includes the pattern of bonds 140*c* in the hem channel 150 which exhibit advantageous low force extensional properties such that the films in the hem channel 150 deform under stress rather than separating or tearing.

In contrast to heat seals, ultrasonic bonds, or adhesive bonds, the SELF'ing bonds 140*c* securing the inner and outer film layers of the hem channel 150 can comprise bonds with a bond strength that is configured to fail before the tearing or failing of the inner or outer film layers for the hem channel 150. In particular, the SELF'ing bonds 140*c* can act to first absorb forces via breaking prior to allowing those same forces to cause failure of the individual films of the hem channel 150. Such action can provide increased strength to the hem channel 150. In one or more implementations, the SELF'ing bonds 140*c* include a bond strength that is less than a weakest tear resistance of each of the individual films of the hem channel 150 so as to cause the bonds to fail prior to failure of the films when subjected to forces within a given range. Indeed, one or more implementations include bonds that release prior to any localized tearing of the films of the hem channel 150.

Thus, in one or more implementations, the SELF'ing bonds 140*c* can fail before either of the individual layers undergoes molecular-level deformation. For example, an applied strain can pull the SELF'ing bonds 140*c* apart prior to any molecular-level deformation (stretching, tearing, puncturing, etc.) of the individual film layers. In other words, the SELF'ing bonds 140*c* can provide less resistive force to an applied strain than molecular-level deformation of individual films of the hem channel 150. Such a configuration of the SELF'ing bonds 140*c* can provide increased strength properties to the hem channel 150 as compared to a monolayer film of equal thickness or a hem channel in which the plurality of layers are tightly bonded together (e.g., heat sealed).

FIG. 2E further illustrates a plurality of bonds 140*c* comprise a repeating pattern that spans across the entire hem channel 150. Furthermore, the plurality of bonds 140*c* are separated by unbonded regions that together form a strainable network that provides an elastic characteristic to the hem channel 150.

Figure 2F:
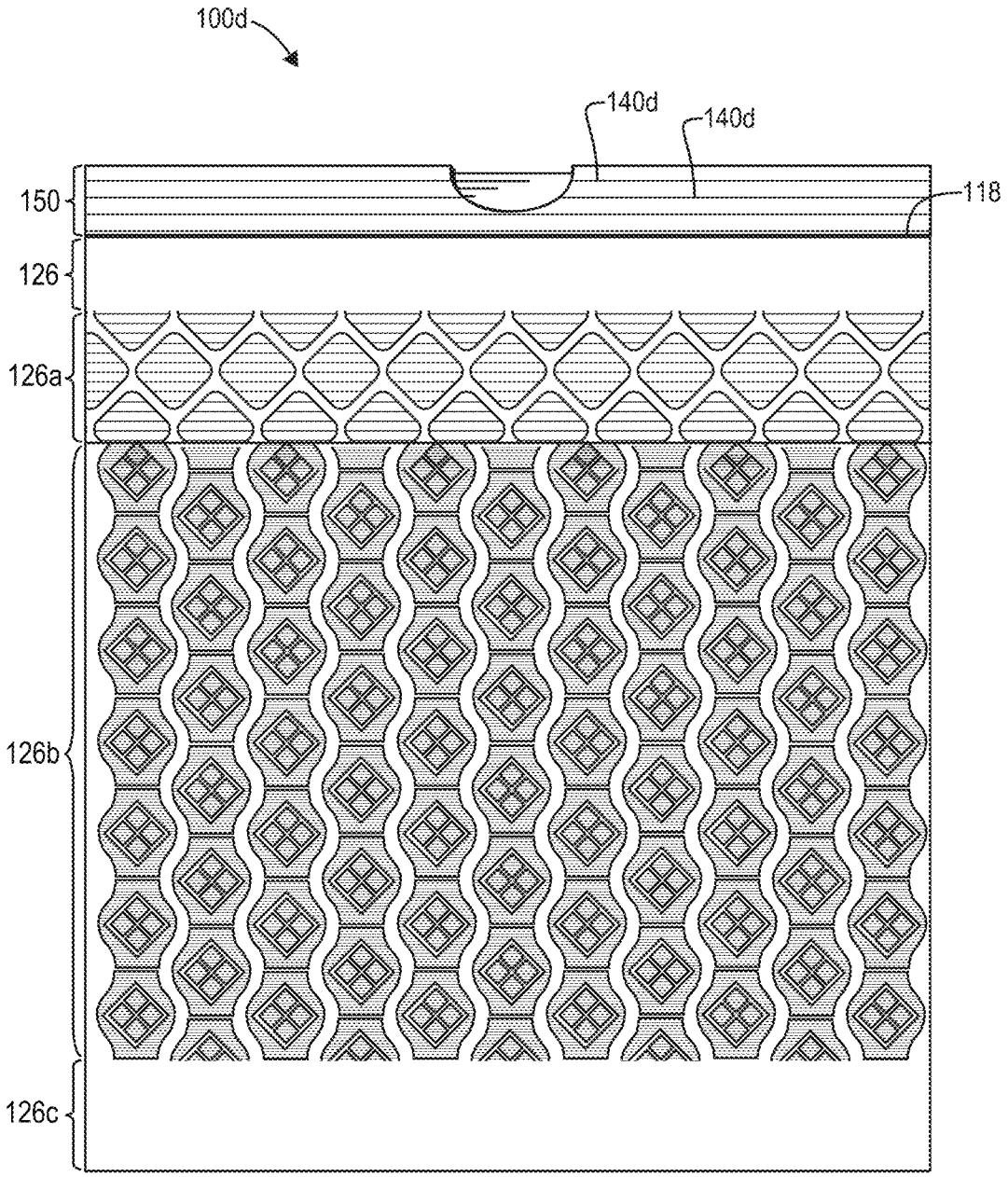

In addition to SELF'ing bonds, one or more implementations include hem channels 150 conjoined by ring rolling bonds. For example, FIG. 2F illustrates a multi-film thermoplastic bag 100*d* with conjoined hem seals 150 with bonds 140*d* formed by transverse direction (TD) ring rolling. As shown, the TD ring rolling bonds 140*d* can extend across the entire width of the hem channel 150 and bond the film layers of the hem channel 150 together to provide an easy cinch drawtape bag.

Figure 2G:
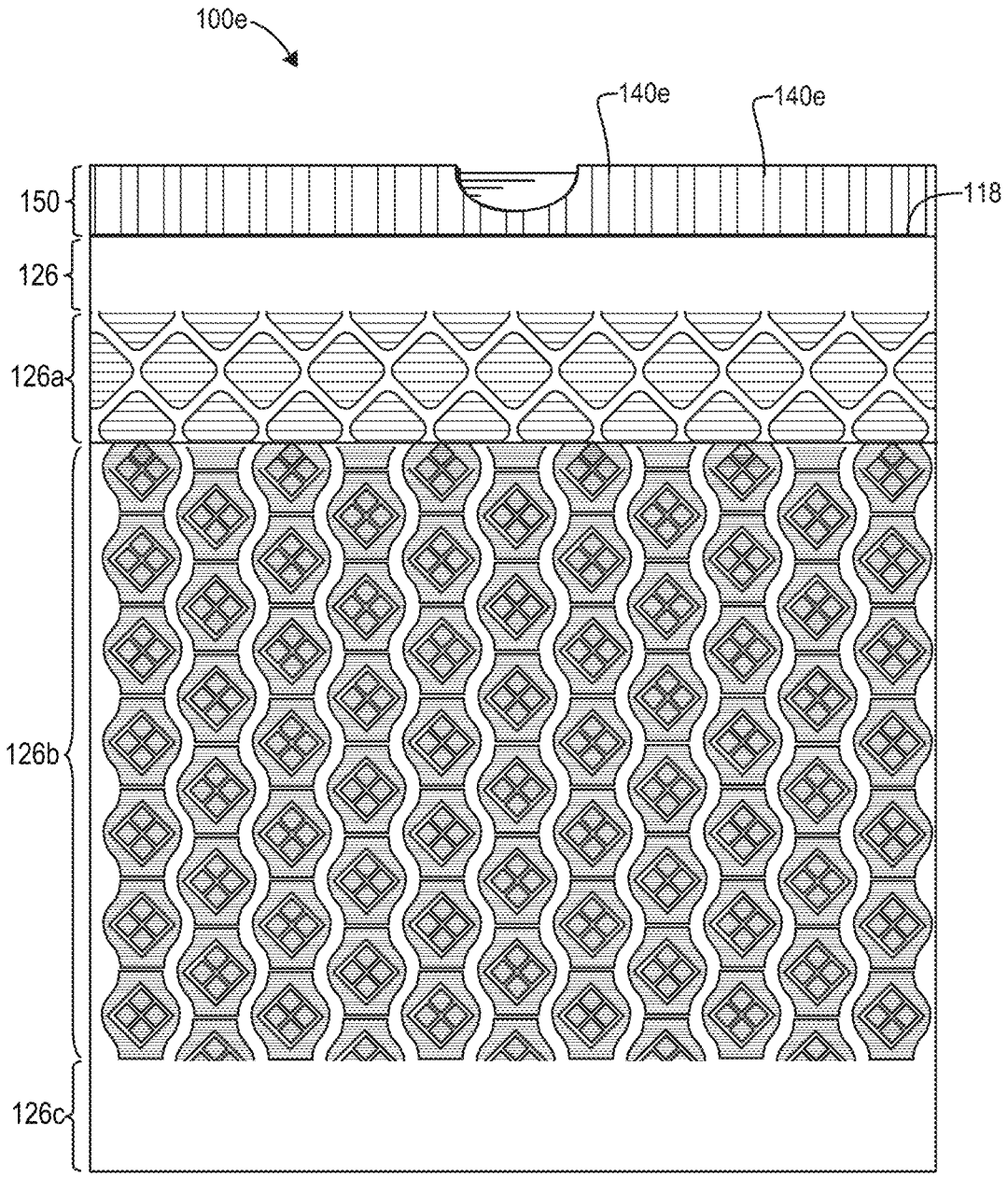

Along related lines, FIG. 2G illustrates a multi-film thermoplastic bag 100*e* with conjoined hem seals 150 with bonds 140*e* formed by machine direction (MD) ring rolling. As shown, the MD ring rolling bonds 140*e* can extend across the entire height of the hem channel 150 and bond the film layers of the hem channel 150 together to provide an easy cinch drawtape bag.

In addition to the foregoing, in one or more implementations the bonds of a conjoined hem channel comprise contact areas such as those described in International Patent Application No. PCT/US2020/024143 filed on Mar. 23, 2020 and entitled "MULTI-FILM THERMOPLASTIC STRUCTURES AND BAGS HAVING VISUALLY-DISTINCT CONTACT AREAS AND METHODS OF MAKING THE SAME," hereby incorporated by reference in its entirety. In particular and as described below, bonds in the form of contact areas are formed by a combination of heat and pressure and have a relatively weak bond strength such that the contact area will delaminate or fail prior to the failure of the film layers bonded together by the contact area. Additionally, as described below contact areas are visually-distinct due and flat and undeformed.

Figure 3A:
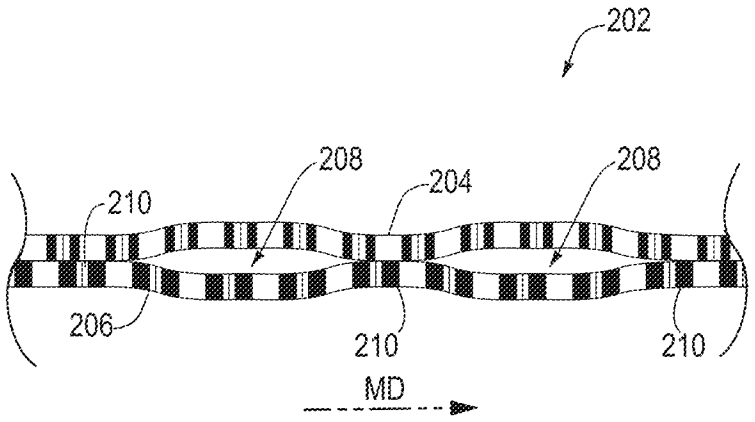
FIG. 3A shows a partial side cross-sectional view of a multi-film thermoplastic bag having bonds in the form of contact areas between first and second thermoplastic film according to one or more implementations of the present disclosure.

In particular, FIG. 3A illustrates one example of a portion of a sidewall of a multi-film thermoplastic bag 202 (i.e., a portion of hem channel) including bonds in the form of contact areas 210 between a first thermoplastic film 204 and a second thermoplastic film 206. Each of the thermoplastic films 204, 206 can comprise any of the thermoplastic films 102*a*-102*c* described above or a film with more than three layers. FIG. 3A illustrates that the first thermoplastic film 204 of the multi-film thermoplastic bag 202 is secured to the second thermoplastic film 206 via bonds in the form of contact areas 210. In particular, the multi-film thermoplastic bag 202 can include contact areas 210 and separated regions 208. The contact areas 210 remove the air and/or space between the thermoplastic films 204, 206.

FIG. 3A further illustrates that the contact areas 210 secure the thermoplastic films 204, 206 of the multi-film thermoplastic bag 202 such that the thickness of the thermoplastic films 204, 206 is substantially unchanged at each of the contact areas 210. In other words, each of the first and second thermoplastic films 204, 206 can have a substantially uniform gauge (e.g., are substantially flat). In other words, the gauge of the first and second thermoplastic films 204, 206 in the separated regions 208 is substantially the same as the gauge of the first and second thermoplastic films 204, 206 in the contact areas 210. This is in contrast to ring rolled, SELF'ed, conventional embossing, or other processes that can bond film layers together, while also deforming portions of the films. As mentioned above, the heat, pressure, and depth of engagement during creation of the contact areas can control to what extent, if any, the thermoplastic films are deformed when forming the contact areas 210. In one or more implementations, the process of forming the contact areas 210 does not deform, or does not substantially deform, the thermoplastic films such that they are flat, or appear flat, despite the presence of contact areas 210. In alternative implementations, the portions of the first and second thermoplastic films comprising the contact areas 210 create an increase or decrease in the gauge or loft of the multi-film thermoplastic bag 202.

In one or more implementations, the creation of the contact areas 210 does not weaken the first and second thermoplastic films 204, 206. For example, in one or more implementations the portions of the first and second thermoplastic films 204, 206 comprising the contact areas 210 is not significantly lower than the portions of the first and second thermoplastic films 204, 206 in the separated areas 208. In particular, in one or more implementations film in the contact areas 210 have transverse direction tensile strength that is the same as the film in the separated areas 208.

Moreover, the creation of the contact areas 210 can create other tactile features in the multi-film thermoplastic bag 202. For example, regions of the multi-film thermoplastic structure 202 including the contact areas 210 can have an increased rigidity over other regions of the multi-film thermoplastic bag 202 without contact areas. In some implementations, the contact areas 210 may increase the rigidity of the multi-film thermoplastic bag 202 by a factor of one. In other implementations, the contact areas 210 may increase the rigidity of the multi-film thermoplastic bag 202 by as much as a factor of three. Alternatively, the contact areas 210 may not increase the rigidity of the multi-film thermoplastic bag 202 at all.

Figure 3B:
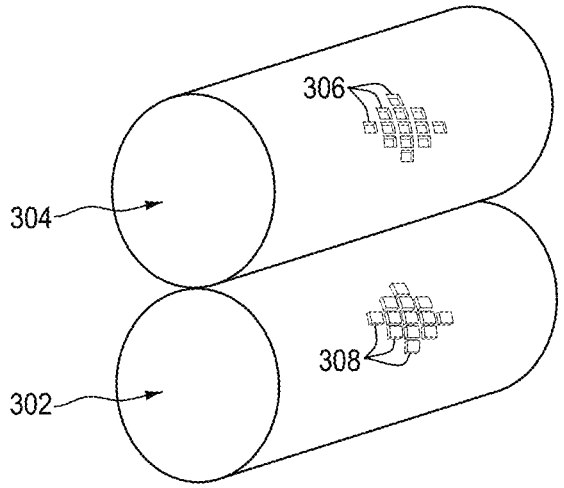
FIGS. 3B-3D show views of a set of contact rollers for forming contact areas according to one or more implementations of the present disclosure.

FIGS. 3B-3E illustrate various implementations of contact rollers for forming contact areas. For example, as shown in FIG. 3B, the contact rollers include a punch roll 302 and a cooperating die roll 304. Each of the punch roll 302 and the die roll 304 may be cylindrical and may have longitudinal axes that are parallel to each other. The punch roll 302 and the die roll 304 may define a passage or tooling nip therebetween through which film materials may pass through to form the contact areas. As shown in FIG. 3B, the punch roll 302 is provided with punch regions 308 and the die roll 304 is provided with corresponding die regions 306 for cooperating with, or receiving, the punch regions 308.

Figure 3C:
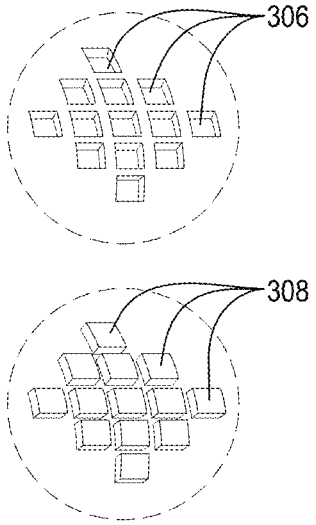

As illustrated in the enlargement shown in FIG. 3C, the punch regions 308 may each have a plurality of punch elements for cooperating with corresponding die elements in the die regions 306. The cooperating engagement of the punch elements with the die elements, with one or more thermoplastic films therebetween, forms contact areas by pressing thermoplastic films together.

Figure 3D:
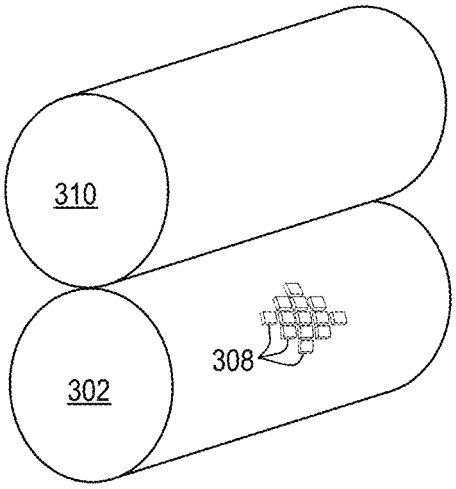
Figure 3E:
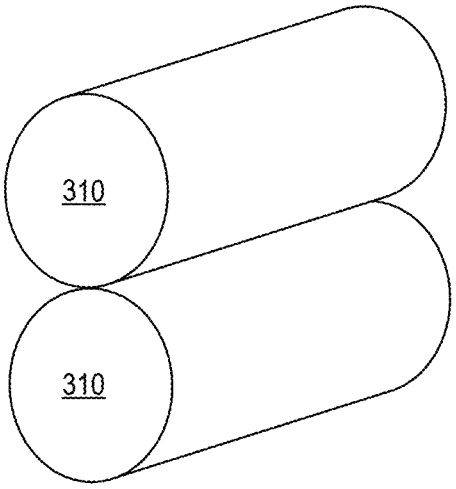
FIG. 3E shows a perspective view of another set of contact rollers for forming contact areas according to one or more implementations of the present disclosure.

FIG. 3D illustrates an alternative set of contact rolls comprise a punch roll 302 and a press roll 310. The press roll 310 may comprise a conformable surface for conforming to the punch elements, or other surface configuration of the punch roll 302. In still further embodiments, the press roll can comprise a rubber roll. FIG. 3E illustrates yet another implementation of contact rolls comprising two flat rolls.

In any event, one of the rolls may be formed from a relatively hard material (e.g., steel, ebonite or other suitable hard material), and the other may be formed from a softer material (e.g., rubber or other suitable softer material). For example, the punch roll 302 and the cooperating die roll 304 may include a steel-to-rubber interface. In alternative embodiments, both the punch roll 302 and the die roll 304 may be formed from the relatively hard material (e.g., steel). Put another way, the punch roll 302 and the die roll 304 may include a steel-to-steel interface. Regardless of whether the punch roll 302 and the die roll 304 include a steel-to-rubber interface or a steel-to-steel interface, in one or more implementations, one or more of the contract rollers may include an electrically heated roll (e.g., means of heating). In alternative embodiments, the neither of the contact rolls are heated.

The plurality of punch elements may have height of between about 10.0 mils and about 40.0 mils, and the receiving the die elements may have depth of between about 10.0 mils and about 40.0 mils. In at least one implementation, as shown in FIG. 3C, the punch elements and the correlating die elements can include a plurality of evenly spaced squares forming a repeat unit. In alternative implementations, the punch elements and the correlating die elements can include a plurality of evenly spaced chevron patterns. Alternatively, the punch elements and the correlating die elements can include a plurality of random polygon shaped protrusions and a plurality of matching random polygon shaped recesses to form a mosaic of random polygon shaped recesses.

Figure 3F:
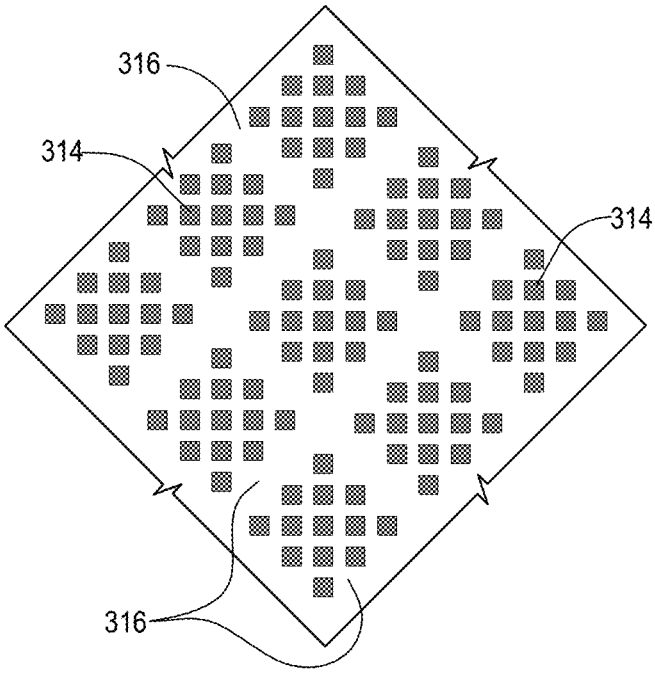
FIG. 3F shows a view of a portion of a multi-film thermoplastic bag having contact areas created by the contact rollers of FIG. 3A or 3C according to one or more implementations of the present disclosure.

Referring to FIG. 3F, a pattern formed by the contact rolls 302, 304 is illustrated in which each of the contact areas 314 in a flat portion of a portion of a multi-film thermoplastic bag is formed by a cooperating set of punch and die elements, and the remaining unformed areas define the separated areas 316 of the multi-film thermoplastic bag. As mentioned above, and as discussed further below, the contact areas 314 provide a visual impression with significant contrast to the multi-film thermoplastic bag. Additionally, as mentioned above, the contact areas 314 can increase a rigidity of the multi-film thermoplastic bag—thereby creating a sturdier and stronger feel in the areas of the multi-film thermoplastic bag including the contact areas 314.

In at least one embodiment, one or both of the contact rolls 302, 304 and/or the press roll 310 (as shown in FIGS. 3B-3E above) are heated to a temperature between 125 degrees and 324 degrees (Fahrenheit) in order to create the contact areas 314. Additionally, in at least one embodiment, the contact rolls 302, 304 and/or the press roll 310 may create the contact areas 314 by being positioned so as to create a tooling nip (e.g., a passage) where a multi-film thermoplastic structure passing therein experiences pressure within a range of 100-1800 pounds per square inch. Furthermore, the contact rolls 302, 304 and/or the press roll 310 may create the contact areas 314 by spinning at speeds of 500-1200 feet per minute. In one or more embodiments, the contact rolls 302, 304 and/or the press roll 310 may operate within these ranges of heat, pressure, and speed while processing a two-layer thermoplastic film, a four-layer thermoplastic film, or a multi-film thermoplastic structure with even more layers.

In at least one embodiment, one or both of the contact rolls 302, 304 and/or the press roll 310 are pre-heated along the outer perimeter of the contact rolls 302, 304 and/or the press roll 310 to a temperature within the range described above. Additionally, or alternatively, the multi-film thermoplastic structure may be pre-heated prior to passing through the contact rolls 302, 304 and/or the press roll 310.

Figure 4A:
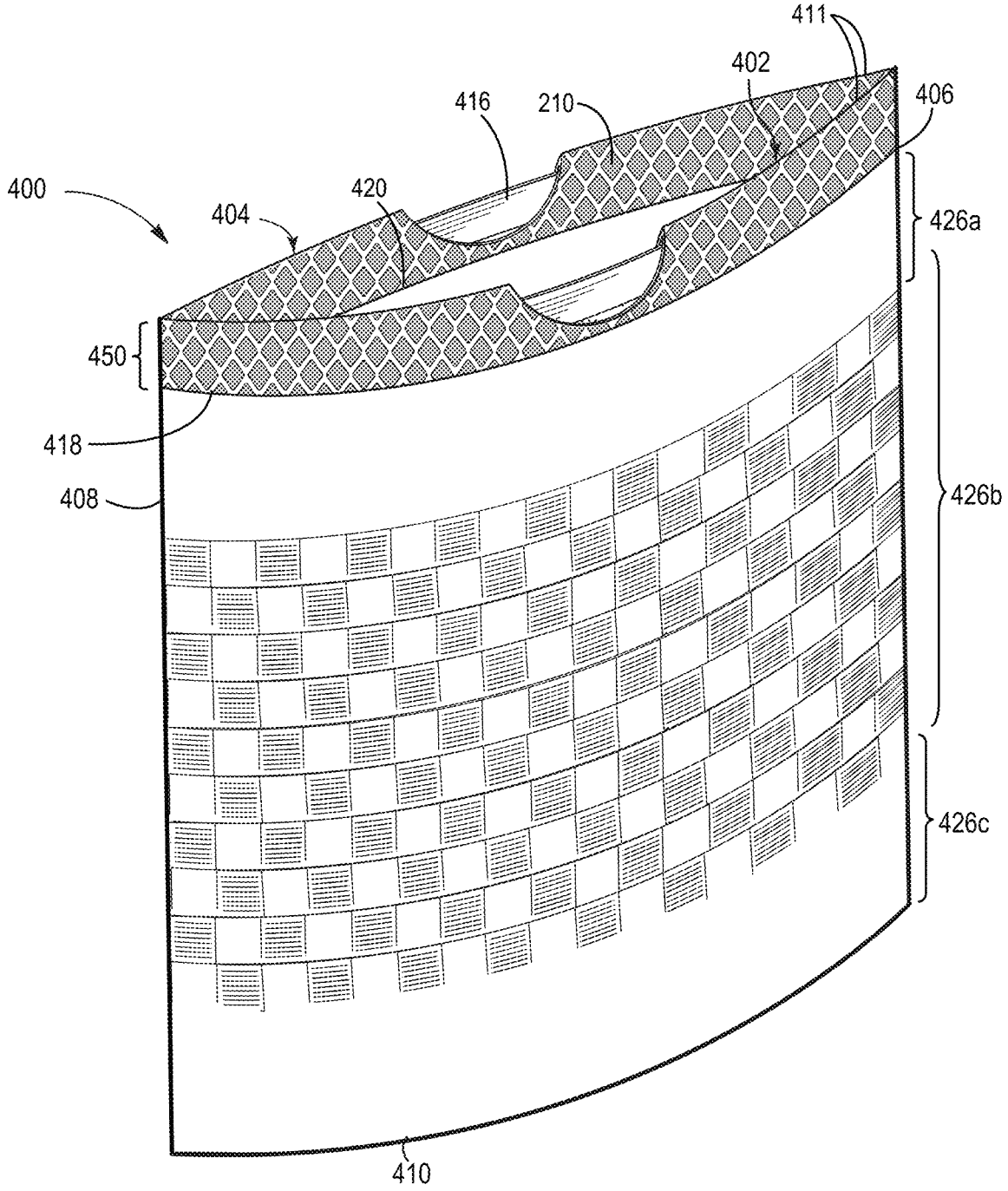
FIG. 4A shows a perspective view of a multi-film thermoplastic bag having a hem channel with layers conjoined by contact areas according to one or more implementations of the present disclosure.

FIG. 4A is a perspective view of a multi-film thermoplastic bag 400 including a conjoined hem channel in which the bonds of the hem channel comprise contact areas (e.g., light bonding such as "smash" bonds or "peelable" bonds) according to an implementation of the present disclosure. The multi-film thermoplastic bag 400 includes a first sidewall 402 and a second sidewall 404. Each of the first and second sidewalls 402, 404 includes a first side edge 406, a second opposite side edge 408, a bottom edge 410 extending between the first and second side edges 406, 408. Each of the first and second sidewalls 402, 404 also includes a top edge 411 extending between the first and second side edges 406, 408 opposite the bottom edge 410. In some implementations, the first sidewall 402 and the second sidewall 404 are joined together along the first side edges 406, the second opposite side edges 408, and the bottom edges 410 as described above in relation to the multi-film thermoplastic bag 100.

As shown, the multi-film thermoplastic bag 400 includes a closure mechanism located adjacent to the top edges 411 for closing the top of the multi-film thermoplastic bag 400 to form an at least substantially fully-enclosed container or vessel. As shown in FIG. 4A, the closure mechanism comprises a drawtape 416 within a hem channel 450. The drawtape 416 extends through the hem channel 450 created by the first and second hem seals 418, 420 along the first and second top edges 411.

Each of the sidewalls 402, 404 of the multi-film thermoplastic bag 400 comprise a multi-film thermoplastic structure. Thus, each sidewall 402, 404 includes at least an inner layer and an outer layer. Indeed, the thermoplastic bag 400 has a bag-in-bag structure. In other words, the thermoplastic bag 400 includes a first bag and a second bag positioned therein. More particularly, the first thermoplastic bag comprises first and second opposing sidewalls joined together along a first side edge, an opposite second side edge, and a closed first bottom edge. The second thermoplastic bag is positioned within the first thermoplastic bag. The second thermoplastic bag comprises third and fourth opposing sidewalls joined together along a third side edge, an opposite fourth side edge, and a closed second bottom edge. In one or more implementations, the first thermoplastic bag (e.g., the outer layer) is pigmented with a first color, and the second thermoplastic bag is pigmented with a second color (e.g., the inner layer is pigmented with the second color). As described above, the differing colors of the layers can allow for the creation of contact areas when the inner bag and the outer bag are placed into intimate contact. As shown in FIG. 4A, the multi-film thermoplastic bag 400 includes a first region or grab zone 426*a*, a second region 426*b*, and a third region 426*c* such as those described above in relation to FIG. 2A.

As shown by FIG. 4A, the hem channel 150 comprises bonds in the form of contact areas 210 that secure the inner and outer thermoplastic film layers together. More particularly, the contact areas 210 are arranged in a repeating diamond pattern that extend across the hem channel 450. As discussed above, the contact areas 210 include light bonding between the inner and outer thermoplastic film layers that are formed by relatively low levels of heat and pressure. The pattern of contact areas 210 in hem channel 450 provide the hem channel 450 with pleasing aesthetics and visual cues of strength and durability without substantially changing the gauge of the films in the hem channel 450. Additionally, the contact areas 210 conjoining the hem channels 450 can provide increased stiffness and other tactile cues that connote strength. As such, the contact areas can provide the grab zone with both a look and feel of increased strength.

While FIG. 4A illustrates contact areas 210 conjoining the hem channels 450 comprising repeating diamond-shaped elements, other implementations can comprise differently shaped contact areas. For example, the contact areas can comprise squares, circles, ovals, stars, hexagons, or other shapes. As such, the use of diamond-shaped contact areas is for illustrative purpose and does not limit the implementations of the present invention.

Figure 4B:
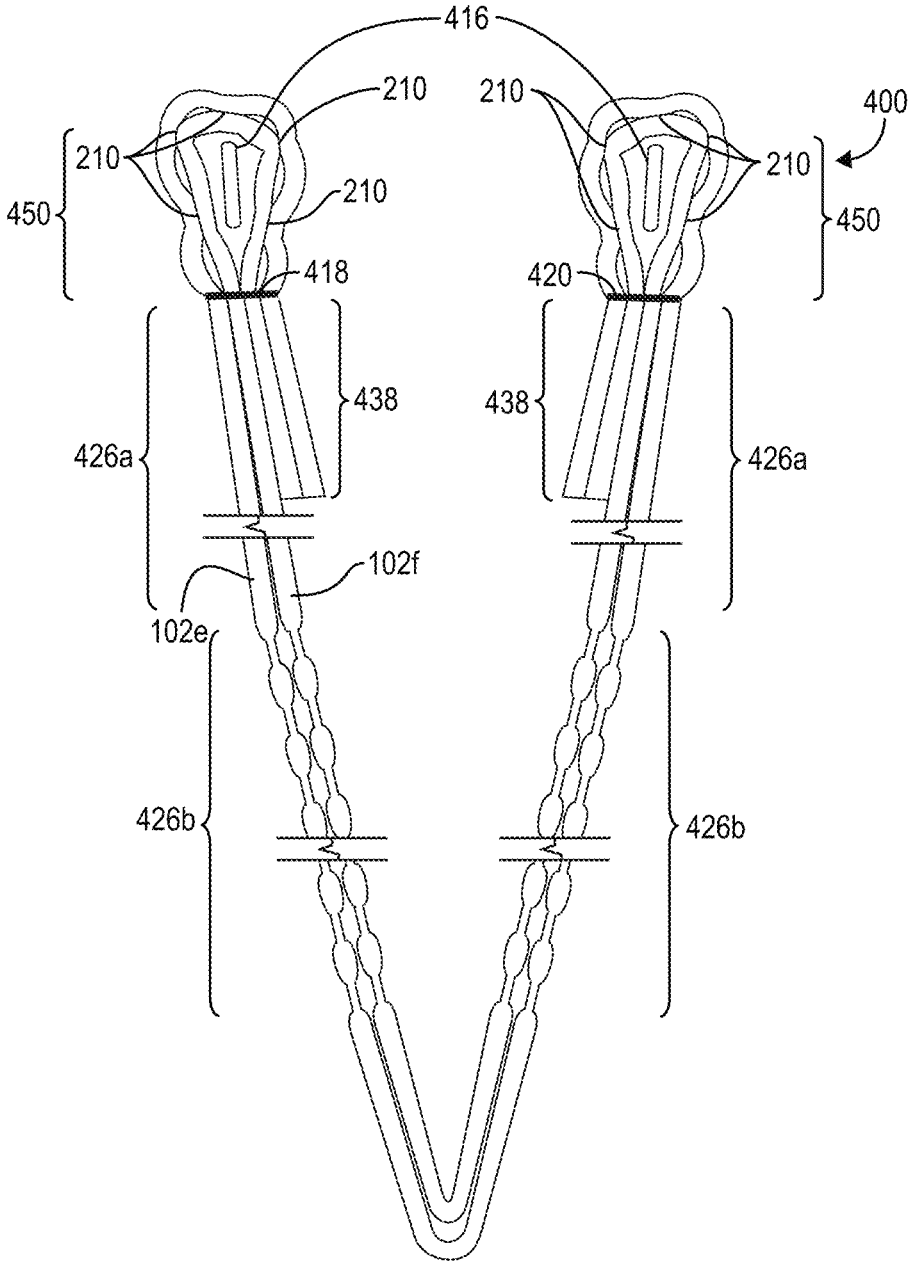
FIG. 4B illustrates a cross-sectional view of the multi-film thermoplastic bag of FIG. 4A according to one or more implementations of the present disclosure.

FIG. 4B illustrates a cross-sectional view of the multi-film thermoplastic bag 400 shown in FIG. 4A. For example, as shown in FIG. 4B, the multi-film thermoplastic bag 400 includes an outer thermoplastic film layer 102*e* and an inner second thermoplastic bag 102*f*. The top edges of the outer thermoplastic film layer 102*e* and the inner second thermoplastic bag 102*f* are folded over the drawtape 416 to form a hem channel 450. The drawtape is movable in the hem channel 450 so as to cinch the multi-film thermoplastic bag 400 closed when pulled through the first and second drawtape notches.

As mentioned above, the one or more contact areas 210 in the hem channel 450 reduce an amount of surface area of the inner surface of the hem channel 450 that comes in contact with the drawtape 416, thereby reducing an amount of mechanical engagement between the inner surface of the hem channel 450 and the drawtape 416. For example, as discussed above with reference to FIG. 2A, the contact areas 210 bring areas of the first thermoplastic film layer 102*e* and the second thermoplastic film layer 102*f* into intimate contact. The resulting separated regions between the inner and outer film layers create a non-even surface on both the outer and inner surface of the multi-film thermoplastic bag 400. For instance, in the hem channel 450, the outer and inner surface of the multi-film thermoplastic bag 400 may be puckered, dimpled, bumpy, or wavy to the touch. Because the area of contact between the inner surface of the hem channel 450 and the drawtape 416 is reduced, the amount of force required to pull the drawtape 416 through the hem channel 450 is also reduced. Therefore, a customer pulling the drawtape 416 in order to cinch the multi-film thermoplastic bag 400 closed would experience less drag on the drawtape 416. Moreover, the reduction in mechanical engagement between the inner surface of the hem channel 450 and the drawtape 416 further reduces a previous tendency of the inner surface of the hem channel 450 to invert and bunch around the hem channel apertures when the drawtape is pulled through the hem channel 450.

As further shown in FIG. 4B, the sidewalls of the multi-film thermoplastic bag 400 can include the grab zone 426*a* and the second region 426*b*, where each region includes different or no bonding between the first thermoplastic film layer 102*e* and the second thermoplastic film layer 102*f*. As further shown in FIG. 4B, folding over the top edges of the first and second thermoplastic film layers 102*e*, 102*f* creates a hem skirt 438 extending from the hem seals 418, 420 down an inner surface of the thermoplastic bag 400.

In addition to having contact areas that conjoin the layers of hem channels, one or more implementations further include grab zones having contact areas. In particular, one or more implementations include a multi-film thermoplastic bag including regions of contact areas, where the contact areas create visual and tactile cues of strength and quality in areas of the multi-film thermoplastic bags that are highly visible and often touched by the customer (e.g., the hem channel and the grab zone). More particularly, the contact areas in the grab zone can conjoin the outer and inner film layers of the sidewalls of a multi-film thermoplastic bag together in the grab zone.

Figure 5A:
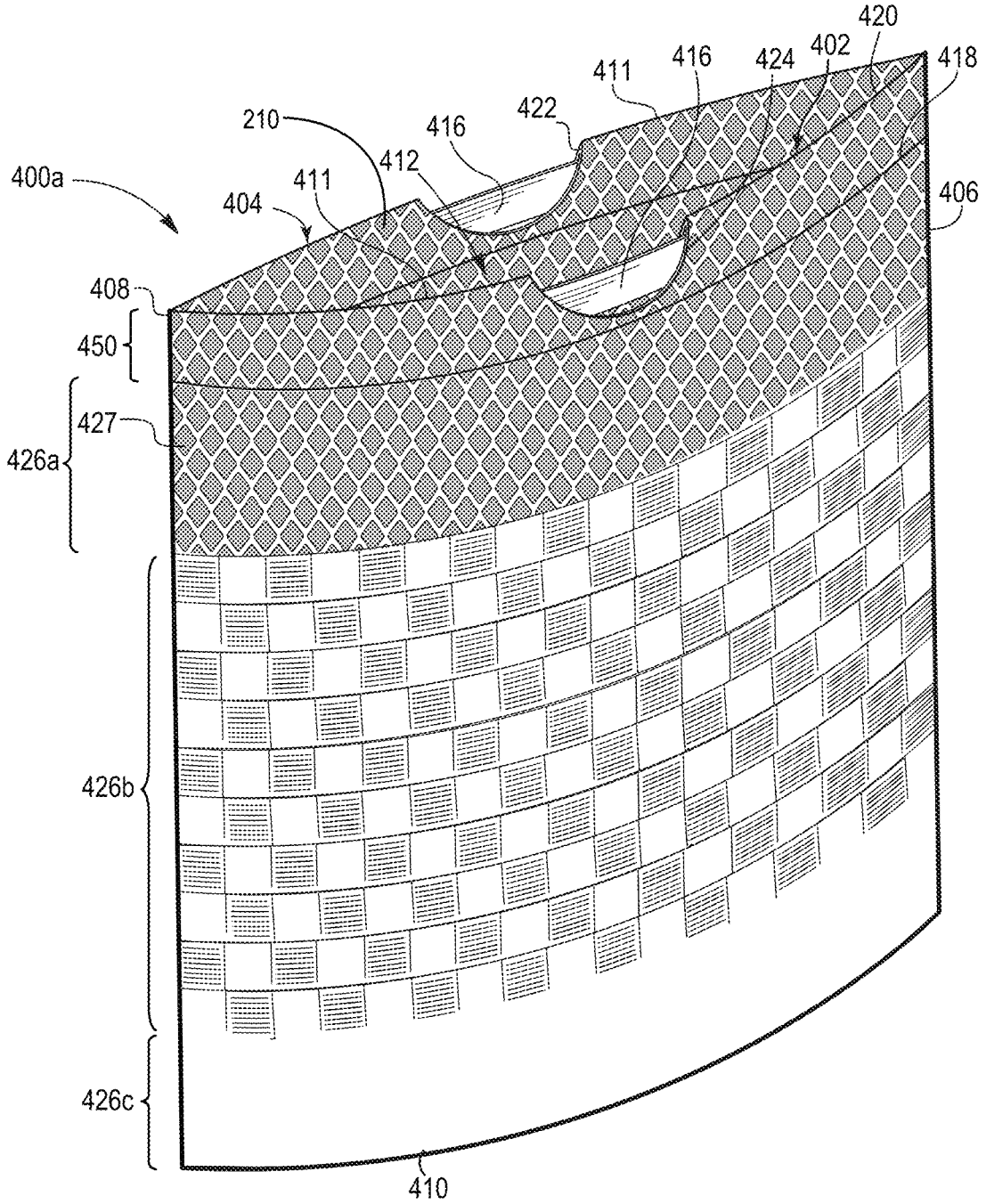
FIG. 5A shows a perspective view of a multi-film thermoplastic bag including a hem channel with layers conjoined by contact areas and grab zone with contact areas according to one or more implementations of the present disclosure.

For example, FIG. 5A illustrates a perspective view of a multi-film thermoplastic bag 400*a* similar to the multi-film thermoplastic bag 400 of FIG. 4A albeit that the diamond-shaped contact areas 210 conjoin the inner and outer film layers in the grab zone 426*a* in addition to the hem channel 450. As discussed above, the contact areas 210 include "peelable" bonds between the films of the multi-film thermoplastic bag 400*a*. When forces are applied to the multi-film thermoplastic bag 400*a*, the contact areas 210 are configured to fail (e.g., allow the films of the multi-film thermoplastic bag 400*a* to separate) prior to any failure of the films (e.g., ripping, tearing, puncturing). Moreover, when positioned in the grab zone 426*a*, the contact area 210 give an added perception of strength and quality to the multi-film thermoplastic bag 400*a* as the light bonding in the contact areas 210 causes the films of the multi-film thermoplastic bag 400*a* to feel thicker and more rigid.

As shown in FIG. 5A, the multi-film thermoplastic bag 400*a* includes a grab zone or first region 426*a*, a second region 426*b*, and a third region 426*c*. The grab zone 426*a* further includes a pattern 427 of contact areas 210. The pattern 427 of contact areas shown in FIG. 5A includes a medium pattern density and exists on the outer and inner surfaces of the first and second sidewalls 402, 404 including the hem channel 450. Additionally, the grab zone 426*a* covers a portion of the multi-film thermoplastic bag 400*a* extending from the first hem seal 418 toward the bottom edge 410 of the multi-film thermoplastic bag 400*a*. Additionally, the pattern 427 of contact areas is registered to the same location on the second sidewall 404 of the multi-film thermoplastic bag 400*a*—namely, the pattern 427 of contact areas exists in the hem seal and through a grab zone of the second sidewall 404 of the multi-film thermoplastic bag 400*a*.

The third region 426*c* of the multi-film thermoplastic bag 400*a* is a flat portion of the multi-film thermoplastic bag 400*a*. In one or more implementations, the second region 426*b* includes SELF'ed or ring rolled patterns as described above. As shown by FIG. 5A, the checkboard pattern of deformations can comprise a repeating pattern of raised rib-like elements. In particular, the checkboard pattern of deformations can include a first plurality of rib-like elements arranged pattern. Portions of the raised rib-like elements of the outer layer can be in direct contact and have the appearance of the inner of the bag 400*a*. In contrast to the pattern 427 contact areas, however, the portions of deformations (e.g., raised rib-like element of a SELFing pattern or alternating thicker ribs and thinner stretched webs of a ring rolling pattern) stretch the film incrementally to create areas of varying gauge or thickness.

In one or more implementations, it is desirable to have more thermoplastic material in areas of the bag 400*a* (e.g., in the grab zones) that are often susceptible to tears, rips, or other failures. For example, the grab zone 426*a* lacks significant deformations and is otherwise less stretched relative to the second region 426*b*. The pattern 427 of contact areas in the grab zone 426*a* provide the region with pleasing aesthetics and visual cues of strength and durability without substantially changing the gauge of the films in the grab zone 426*a*.

The thermoplastic bag 400*a*, as shown, includes side heat seals along the side edges 406, 408. As shown, the side heat seals can comprise areas in which all four or more layers of the thermoplastic bag are in intimate contact. As such, the side heat seal (and any other heat seals such as a hem seal) can have the same appearance as the contact areas. Heat seals differ from the contact areas in that the heat seals will not separate prior to failure of the thermoplastic films bonded by the heat seals.

As shown by FIG. 5A, the contact areas in the grab zone 426*a* form a diamond pattern 427 that provides the grab zone 426*a* with a unique visual appearance that connotes strength. Additionally, as mentioned above, the contact areas in the grab zone 426*a* can provide increased stiffness and other tactile cues that connote strength. As such, the contact areas can provide the grab zone with both a look and feel of increased strength.

Figure 5B:
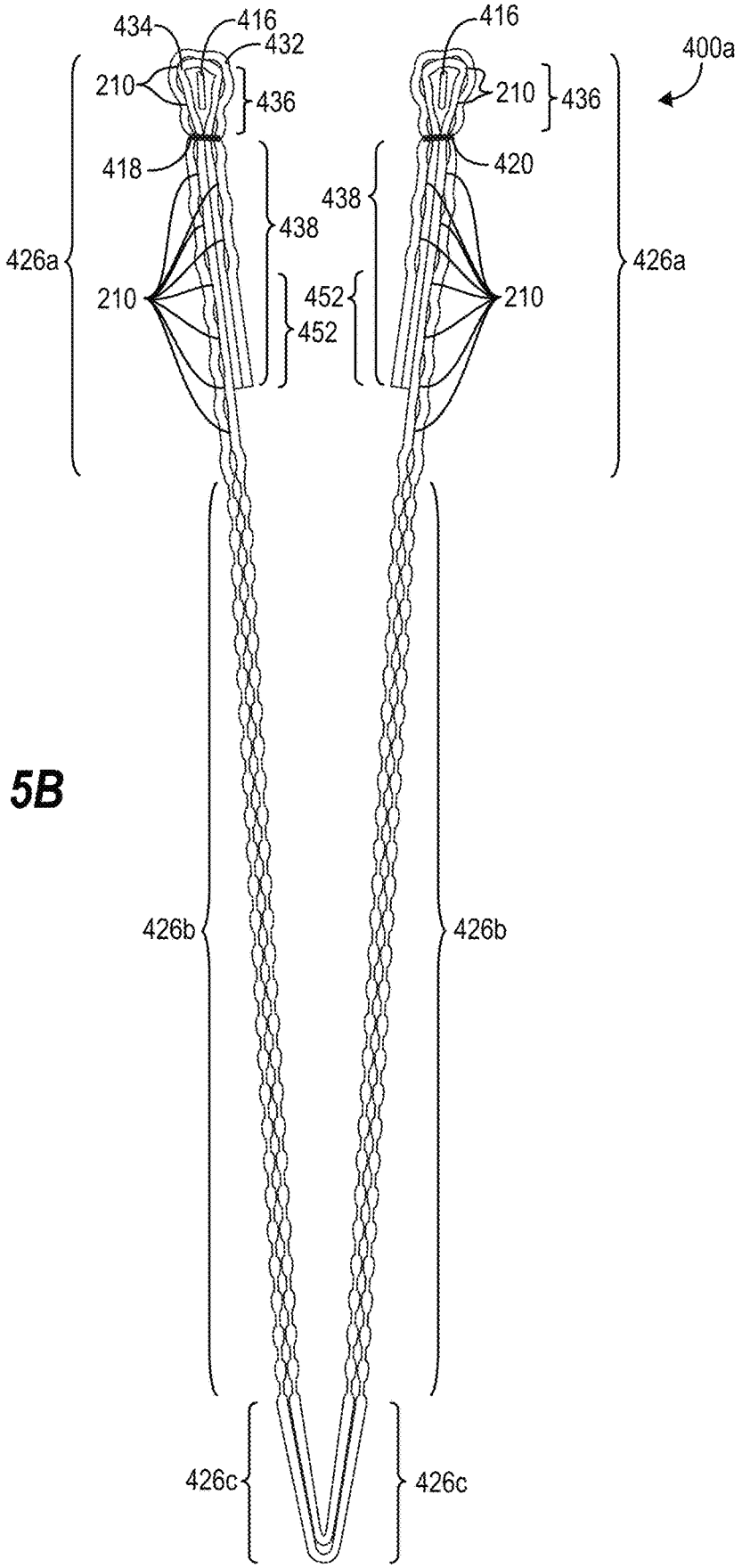
FIGS. 5B-5E illustrate cross-sectional views of the multi-film thermoplastic bag of FIG. 5A according to one or more implementations of the present disclosure.

FIGS. 5B-5E illustrate cross-sectional views of one or more implementations of the multi-film thermoplastic bag 400*a* shown in FIG. 5A. For example, as shown in FIG. 5B, the multi-film thermoplastic bag 400*a* includes an outer first thermoplastic bag 432 and an inner second thermoplastic bag 434 positioned within the first thermoplastic bag 432. The top edges of the first thermoplastic bag 432 and the second thermoplastic bag 434 are folded over the draw tape 416 to form a hem channel 436. The draw tape is movable in the hem channel 436 so as to cinch the multi-film thermoplastic bag 400*a* closed when pulled through the first and second apertures 422, 424 (e.g., shown in FIG. 5A above).

As mentioned above, the one or more contact areas 210 in the hem channel 436 reduce an amount of surface area of the inner surface of the hem channel 436 that comes in contact with the draw tape 416, thereby reducing an amount of mechanical engagement between the inner surface of the hem channel 436 and the draw tape 416. For example, as discussed above with reference to FIG. 3A, the contact areas 210 bring areas of the first thermoplastic bag 432 and the second thermoplastic bag 434 into intimate contact. The resulting separated regions (e.g., the separated region 208 as shown in FIG. 3A) between the first thermoplastic bag 432 and the second thermoplastic bag 434 create a non-even surface on both the outer and inner surface of the multi-film thermoplastic bag 400*a*. For instance, in the grab zone 426*a*, the outer and inner surface of the multi-film thermoplastic bag 400*a* may be puckered, dimpled, bumpy, or wavy to the touch. Because the area of contact between the inner surface of the hem channel 436 and the draw tape 416 is reduced, the amount of force required to pull the draw tape 416 through the hem channel 436 is also reduced. Therefore, a customer pulling the draw tape 416 in order to cinch the multi-film thermoplastic bag 400*a* closed would experience less drag on the draw tape 416. Moreover, the reduction in mechanical engagement between the inner surface of the hem channel 436 and the draw tape 416 further reduces a previous tendency of the inner surface of the hem channel 436 to invert and bunch around the hem channel apertures when the draw tape is pulled through the hem channel 436.

As further shown in FIG. 5B, the sidewalls of the multi-film thermoplastic bag 400*a* can include the grab zone 426*a*, the second region 426*b*, and the third region 426*c*, where each region includes different or no bonding between the first thermoplastic bag 432 and the second thermoplastic bag 434. For example, as shown in FIG. 5B, the grab zone 426*a* includes contact areas 210 between the first thermoplastic bag 432 and the second thermoplastic bag 434 where the first thermoplastic bag 432 and the second thermoplastic bag 434 have been brought into intimate contact via any of the processes described above, while leaving the thickness of the bags 432, 434 substantially unchanged in the grab zone 426*a*. The second region 426*b* includes areas of a plurality of deformations, where the plurality of deformations includes alternating thicker ribs and thinner stretched webs between the first and second bags 432, 434. The third region 426*c* includes an area that is flat and undeformed between the first and second bags 432, 434.

As further shown in FIG. 5B, folding over the top edges of the first and second bags 432, 434 creates a hem skirt 438 extending from the hem seals 418, 420 down an inner surface of the second thermoplastic bag 434. As shown, the length of the hem skirt 438 includes portions of the first and second bags 432, 434, where the length (distance from the hem channel toward the bottom of the bag) of the hem skirt 438 includes equal portions of the first and second bags 432, 434. Furthermore, the hem skirt 438 can have a length that is co-extensive or the same length as the grab zone 426*a*. Alternatively, the hem skirt 438 has a length less than a length of the grab zone 426*a*. For example, FIG. 5B illustrates that the hem skirt 438 has a length approximately 66% of the length of the grab zone 426*a*. In alternative implementations, the hem skirt 438 has a length approximately 10%, 20% 25% 33%, 50%, 75%, 80% or 90% of the length of the grab zone 426*a*. In another implementation, the hem skirt 438 has a length that is relatively shorter or longer than the examples listed above compared to the grab zone 426*a*. For example, in one or more implementations, the hem skirt 438 is longer than the grab zone 426*a*.

As further shown in FIG. 5B, the contact areas in the grab zone 426*a* extend through at least a portion of the hem skirt 438. For example, in at least one implementation, the contact areas in the grab zone 426*a* are formed before the top edges of the first and second bags 432, 434 are folded over in the region and secured via the hem seals 418, 420. Thus, when the top edges of the first and second bags 432, 434 are folded over, the contact areas 210 may extend into at least a portion of the hem skirt 438. Nonetheless because the contact areas 210 are formed prior to forming the hem channel 450, the hem skirt 438 is not secured to the sidewall 402 by the contact areas 210. The contact areas 210 in the hem skirt 438 in combination with the contact areas 210 in the outer portion of the multi-film thermoplastic bag 400*a* can create rigidity in the multi-film thermoplastic bag 400*a* in the grab zone that is 0-3 times greater than the rigidity of the multi-film thermoplastic bag 400*a* in the other regions.

As shown in FIG. 5B, the skirt 438 further includes a region 452 where the first and second bags 432, 434 are flat and undeformed. For example, the process that forms the contact areas 210 in the top portions of the first and second bags 432, 434 may not extend all the way to the top edges of the first and second bags 432, 434. Thus, when the top edges of the first and second bags 432, 434 are folded over to form the hem channel 436 and the hem skirt 438, the end region 452 of the hem skirt 438 remains flat and undeformed.

In another implementation, the top edge of the inner second thermoplastic bag 434 may extend beyond the top edge of the outer first thermoplastic bag 432 in the hem skirt 438. For example, the top edge of the inner second thermoplastic bag 434 may extend any distance beyond the top edge of the outer first thermoplastic bag 432 in the hem skirt 438, or vice versa. In another implementation, the hem skirt 438 may only include either the top edge of the outer first thermoplastic bag 432 or the top edge of the inner second thermoplastic bag 434. In that implementation the hem skirt 438 may not include contact areas.

Figure 5C:
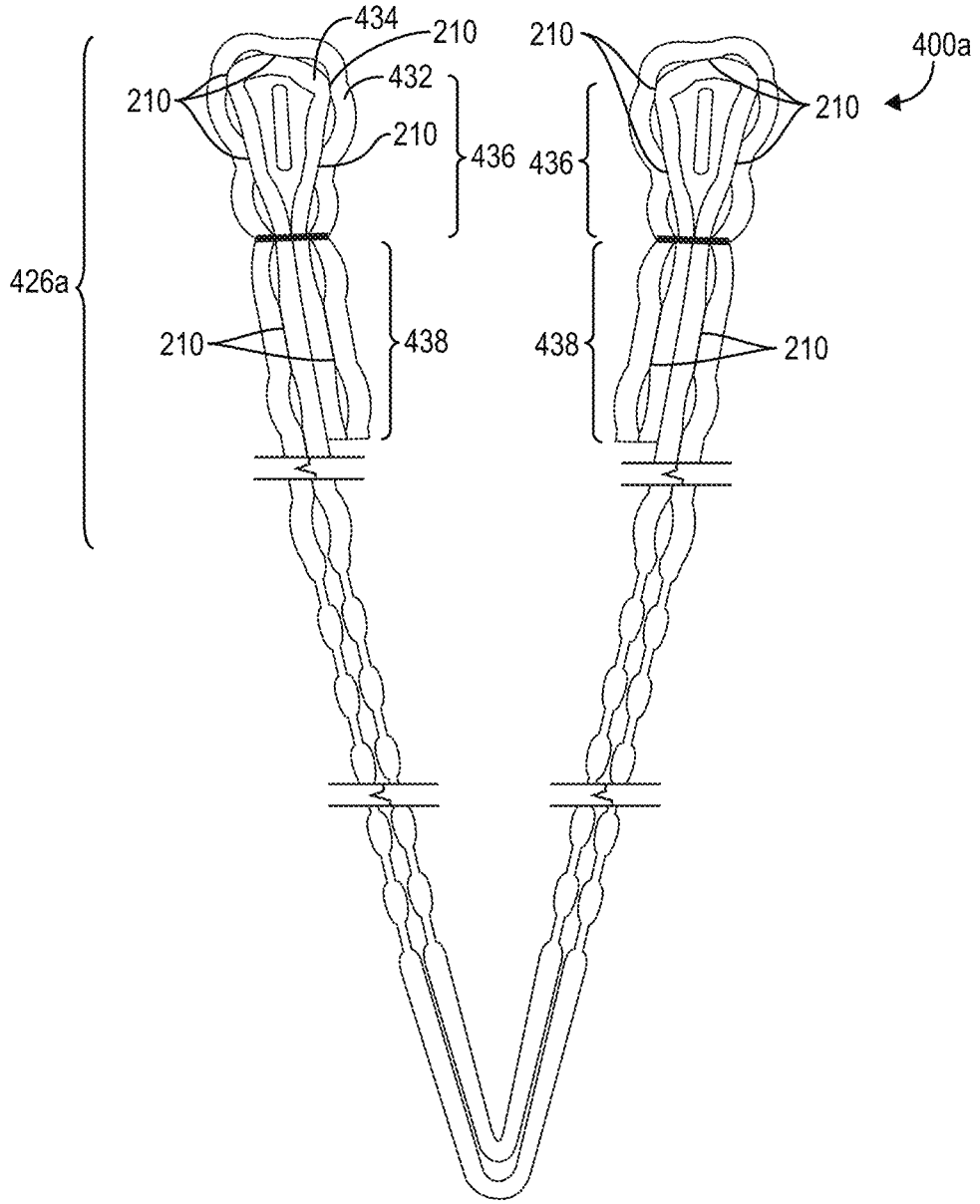

Alternatively, as shown in FIG. 5C, the contact areas 210 extend to the end of the hem skirt 438. For example, the process that forms the contact areas 210 in the grab zone 426*a* can form the contact areas 210 from the top edges of the first and second bags 432, 434. Thus, when the top edges of the first and second bags 432, 434 are folded over to form the hem channel 436 and the hem skirt 438, the contact areas 210 extend to the edge of the hem skirt 438.

Figure 5D:
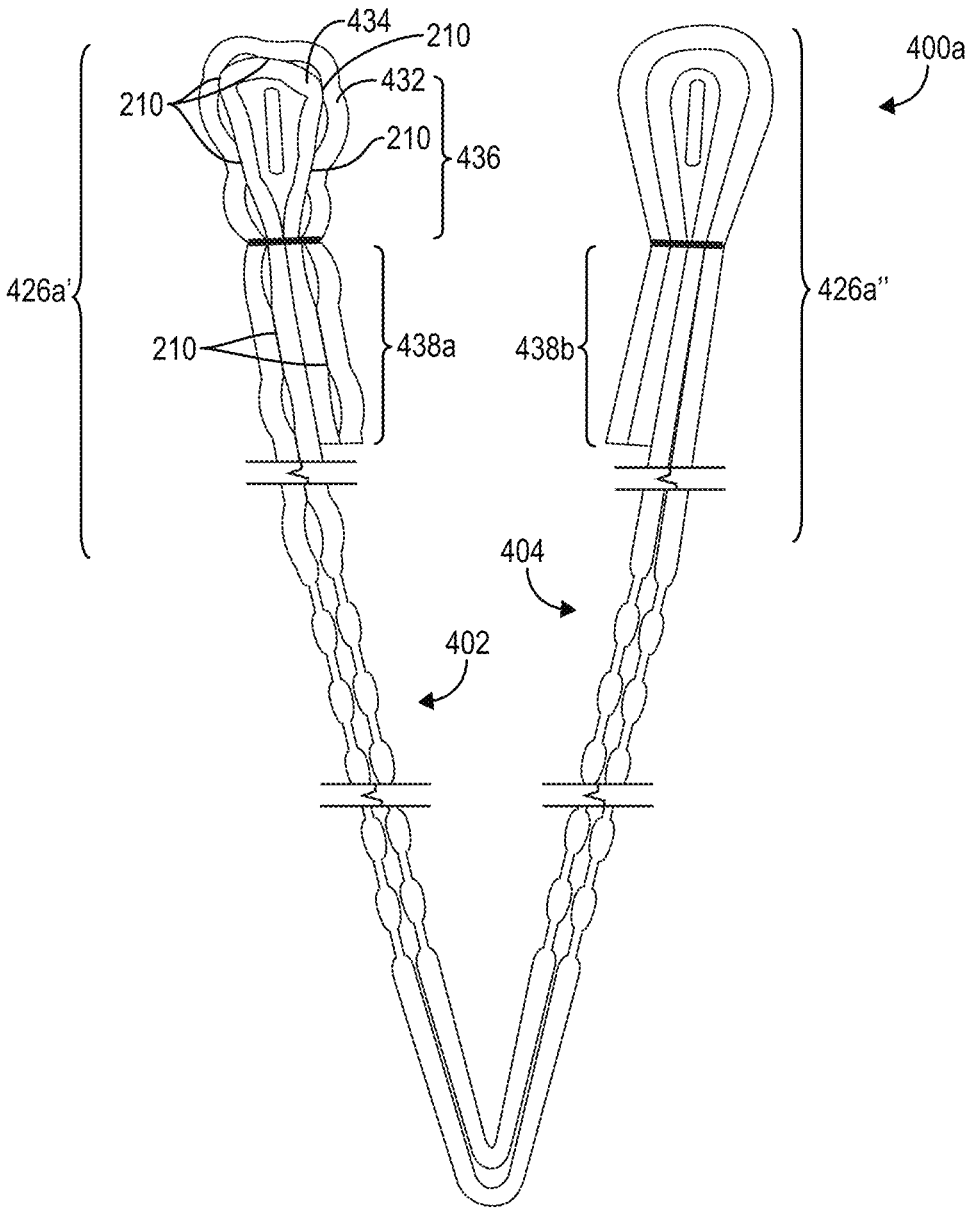

In the implementation shown in FIG. 5D, the process that forms the contact areas 210 in the region 426*a*' does not form contact areas 210 in a mirroring region 426*a*" of the multi-film thermoplastic bag 400*a*. For example, while the region 426*a*' includes contact areas 210 extending through the first sidewall 402 into the hem channel 436 and the hem skirt 438*a*, the mirroring region 426*a*" is devoid of contact areas 210.

Figure 5E:
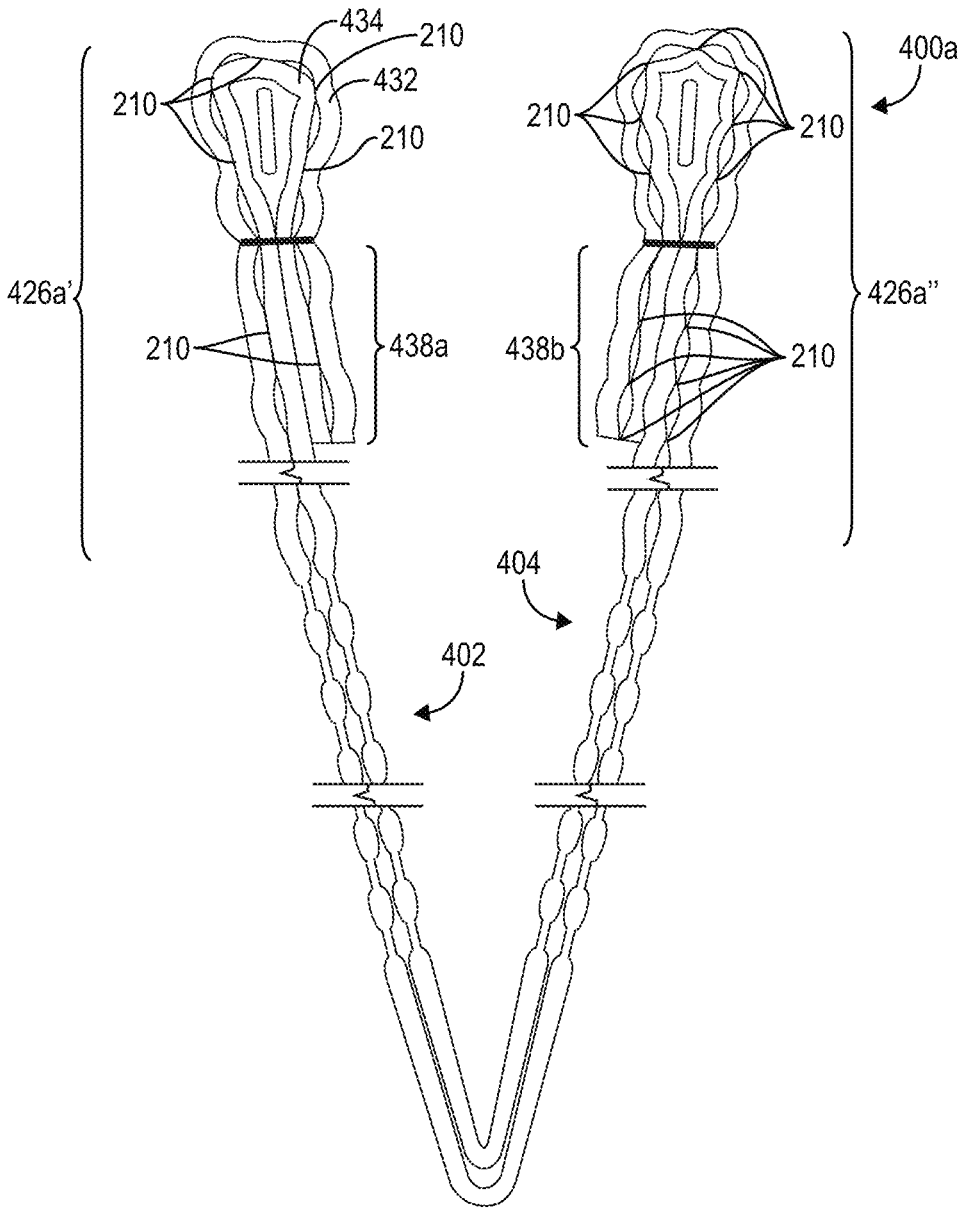

Additionally, or alternatively, as shown in FIG. 5E, the process that forms a first pattern of contact areas 210 in the region 426*a*' can form a second pattern of contact areas 210 in the region 426*a*". For example, the first sidewall 402 includes the first pattern (e.g., a medium density pattern) of contact areas 210 from a top edge of the first and second bags 432, 434 such that the first pattern of contact areas 210 extend to the end of the hem skirt 438*a*. The second sidewall 404 includes the second pattern (e.g., a high density pattern) of contact areas 210 from a top edge of the first and second bags 432, 434 such that the second pattern of contact areas 210 extend to the end of the hem skirt 438*b*.

Figure 6A:
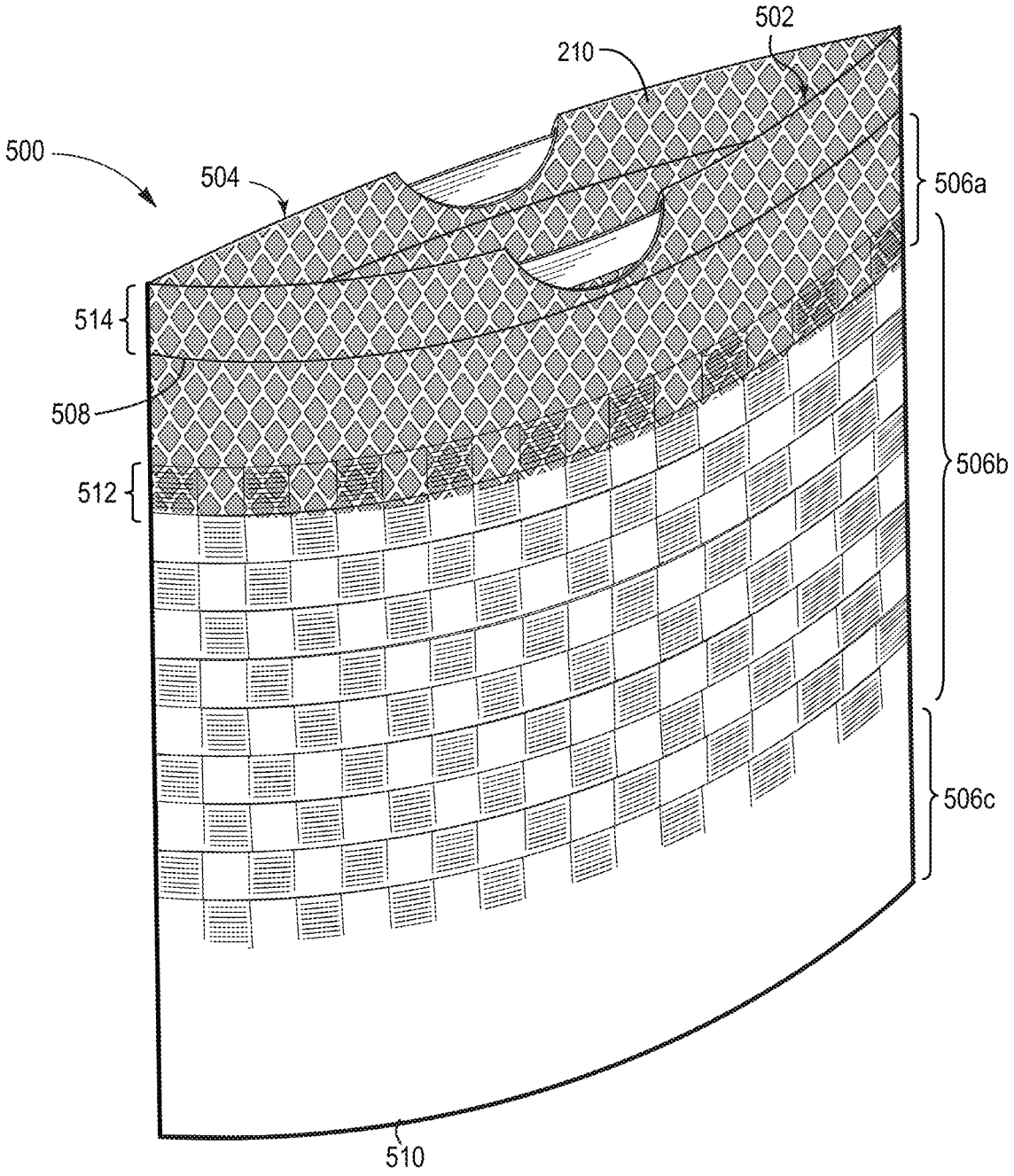
FIG. 6A shows a perspective view of a multi-film thermoplastic bag including a hem channel with layers conjoined by contact areas and grab zone with contact areas that overlap a region of deformations according to one or more implementations of the present disclosure.
Figure 6B:
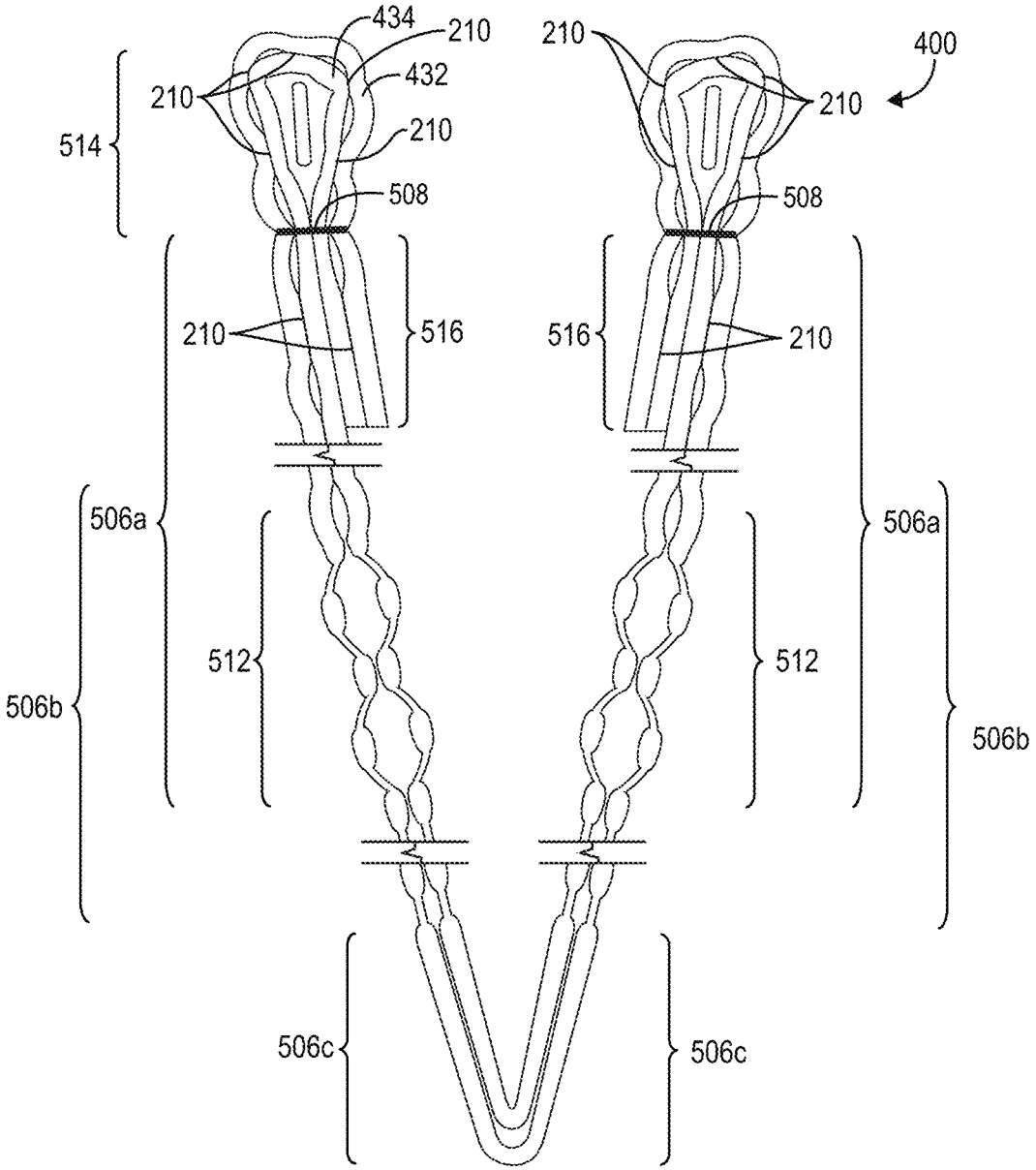
FIG. 6B illustrates a cross-sectional view of the multi-film thermoplastic bag of FIG. 6A according to one or more implementations of the present disclosure.

FIGS. 6A and 6B illustrate a perspective view and a cross-sectional view, respectively, of an implementation of a multi-film thermoplastic bag 500 (e.g., similar to the multi-film thermoplastic bag 400 illustrated in FIGS. 5A-5E). As shown in FIG. 6A, the multi-film thermoplastic bag 500 includes a first sidewall 502 and a second sidewall 504, where each of the sidewalls 502, 504 include a grab zone 506*a*, a second region 506*b*, and a third region 506*c*. The grab zone 506*a* includes contact areas 210 between the layers of the multi-film thermoplastic bag 500, while the second region 506*b* includes deformations such as raised rib-like elements in a strainable network or alternating thicker ribs and thinner stretched webs, and the third region 506*c* includes a flat and undeformed area. The hem channel 514 further includes contact areas 210 between the folded over layers of the multi-film thermoplastic bag 500.

As further shown in FIG. 6A, the grab zone 506*a* extends a first distance from a hem seal 508 toward the bottom edge 510 of the multi-film thermoplastic bag 500. The first distance of the grab zone 506*a* ends after the second region 506*b* of deformations begins, creating an overlap 512 between the contact areas 210 in the grab zone 506*a* and the deformations in the second region 506*b*. The overlap 512 can include a length that is any percentage of the length of the grab zone 506*a* of contact areas 210. Thus, in some implementations, the length of the overlap 512 may be very small (e.g., 1-3 centimeters), while in other implementations, the length of the overlap 512 may be the same as the length of the grab zone 506*a* of contact areas 210 (i.e., the entire length of the grab zone 506*a* is overlapped by some or all of the second region 506*b* of deformations). For example, the overlap 510 can be a length within a first range of about 0.1 inch (0.254 cm) to about 10 inches (25.4 cm), within a second range of about 0.5 inches (1.27 cm) to about 8 inches (20.3 cm), within a third range of about 1 inches (2.54 cm) to about 6 inches (15.2 cm), or within a fourth range of about 3 inches (7.6 cm) to about 6 inches (15.2 cm). In one or more implementations, the overlap 512 adds to the tactile and visual cues of strength and durability in the "grab zone" of the multi-film thermoplastic bag 500. In one or more implementations, the overlap 510 including both contact areas from the grab zone 506*a* and deformations in the second region 506*b* can connote additional strength due to increased stiffness and other tactile cues.

FIG. 6B illustrates a cross-sectional view of the multi-film thermoplastic bag 500. For example, as shown, the grab zone 506*a* extends a first length from the hem seal 508. The first length of the grab zone 506*a* ends after the second region 506*b* begins, creating the overlap 512 of the contact areas 210 in the grab zone 506*a* and the deformations in the second region 506*b*. For example, the overlap 512 shows the deformed films (e.g., via a SELFing process) that are pushed together at the contact areas 210. The hem skirt 516 includes the contact areas 210 of the grab zone 506*a*, and is unaffected by the overlap 512. In additional implementations, the overlap 512 may include any length of the hem skirt 516 such that at least a portion of the hem skirt 516 includes both the contact areas 210 of the grab zone 506*a* and the deformations of the second region 506*b*.

Figure 7A:
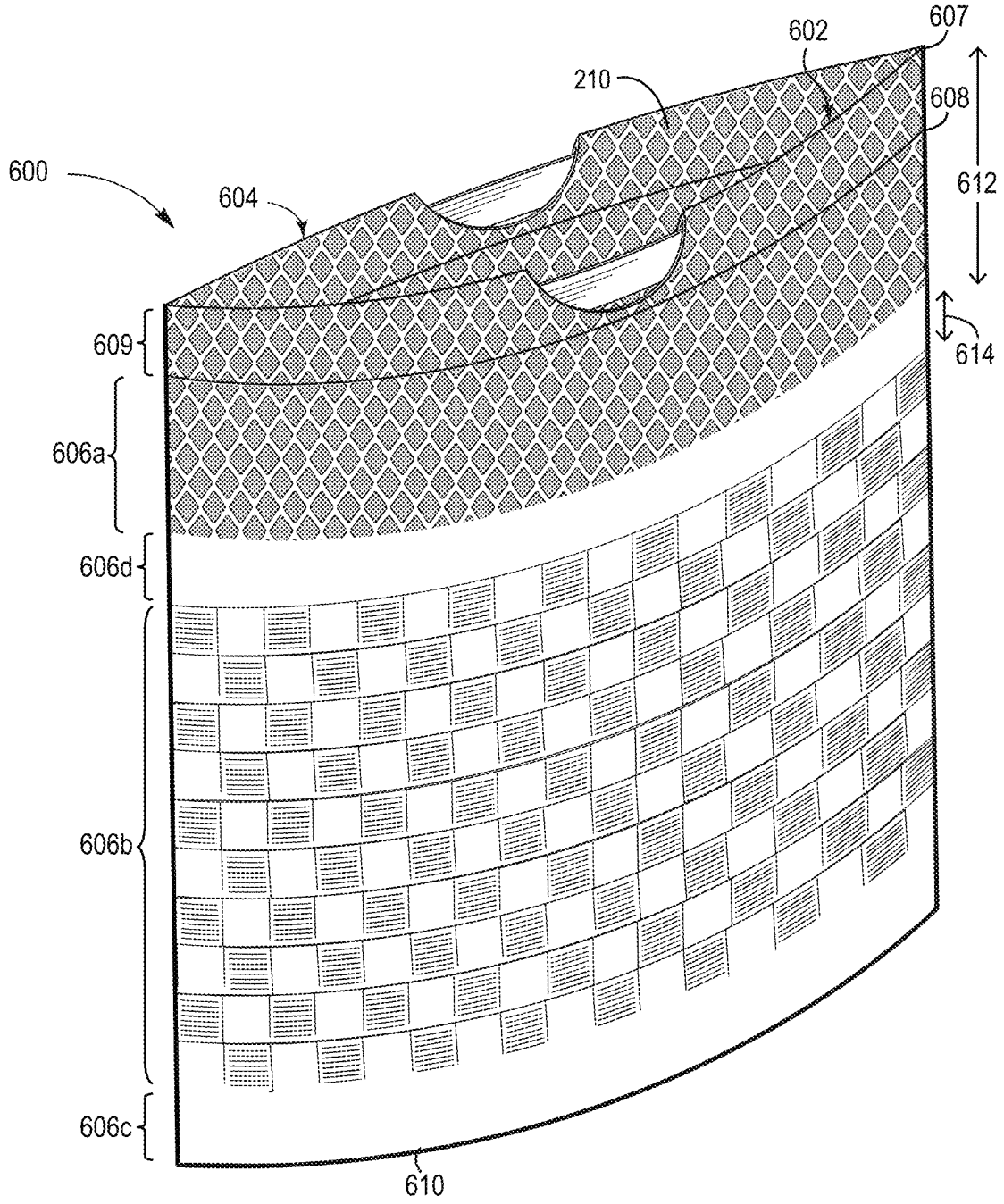
FIG. 7A shows a perspective view of a multi-film thermoplastic bag including a hem channel with layers conjoined by contact areas a region of contact areas and a grab zone with contact areas separated from a region of deformations by a flat and undeformed region according to one or more implementations of the present disclosure.
Figure 7B:
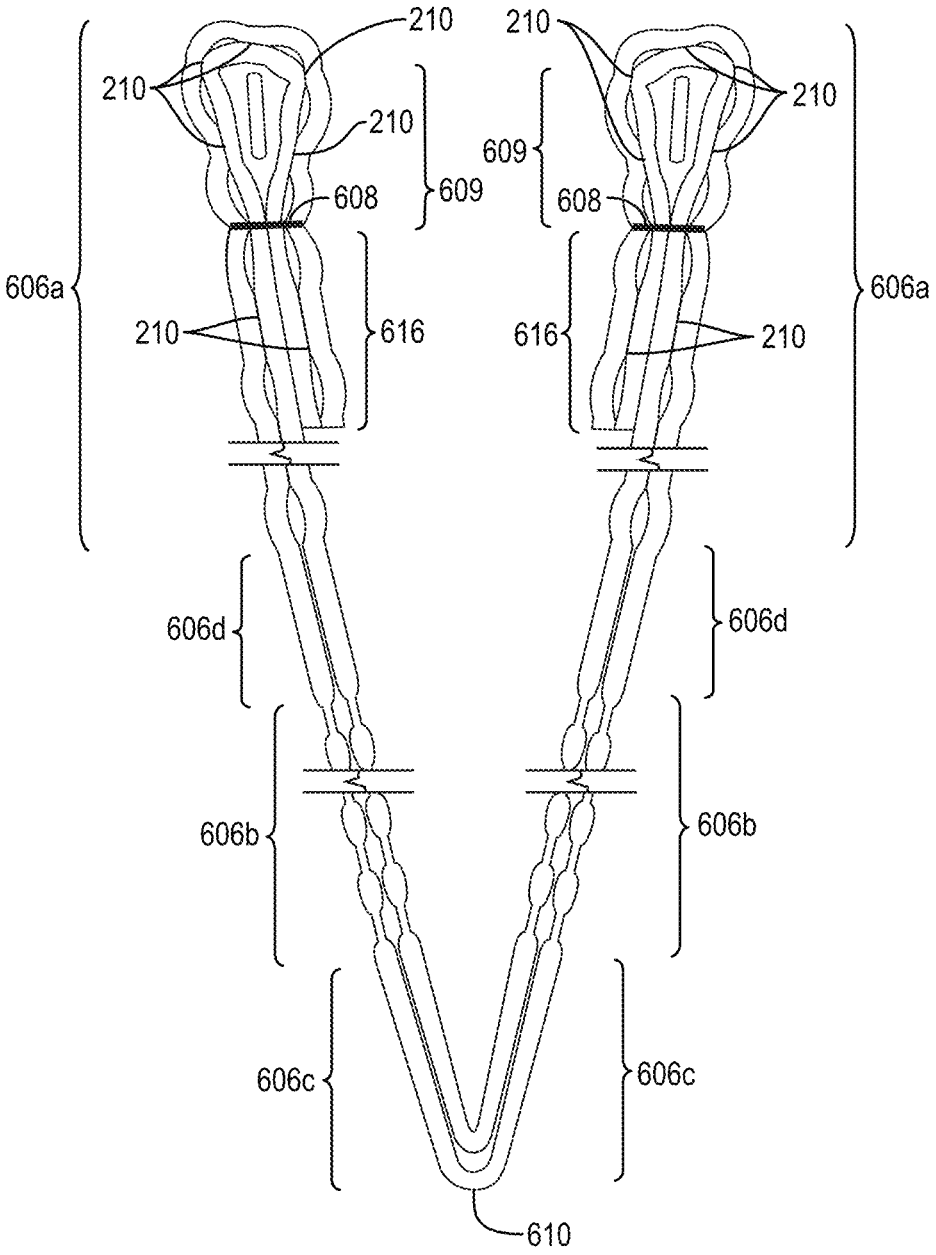
FIG. 7B illustrates a cross-sectional view of the multi-film thermoplastic bag of FIG. 7A according to one or more implementations of the present disclosure.

FIGS. 7A and 7B illustrate a perspective view and a cross-sectional view, respectively, of an implementation of the multi-film thermoplastic bag 600 (e.g., similar to the multi-film thermoplastic bags 400 and 500 described above). As shown in FIG. 7A, the multi-film thermoplastic bag 600 includes a first sidewall 602 and a second sidewall 604. Each of the sidewalls 602, 604 include a grab zone 606*a*, a second region 606*b*, a third region 606*c*, and a fourth region 606*d*. The grab zone 606*a* includes contact areas 210 between the layers of the multi-film thermoplastic bag 600, while the second region 606*b* includes deformations such as raised rib-like elements in a strainable network or alternating thicker ribs and thinner stretched webs, and the third and fourth regions 606*c*, 606*d* include flat and undeformed areas.

As further shown in FIG. 7A, the grab zone 606*a* extends a first distance 612 from a top edge 607 toward a bottom edge 610 of the multi-film thermoplastic bag 600, over the hem channel 609 and through the hem seal 608. The first distance 612 of the grab zone 606*a* ends before the fourth region 606*d* of flat and undeformed film begins. The fourth region 606*d* then extends a second distance 614 from the grab zone 606*a* that ends before the second region 606*b* of deformations. In some implementations, the length of the fourth region 606*d* may be very small (e.g., 1-3 centimeters), while in other implementations, the length of the fourth region 606*d* may be the same as the length of the grab zone 606*a*. In other implementations, the grab zone 606*a*, the second region 606*b*, the third region 606*c*, and the fourth region 606*d* may have equal lengths (e.g., approximately 25% of the length of the multi-film thermoplastic bag 600). In one or more implementations, the fourth region 606*d* adds to the tactile and visual cues delineating a "grab zone" near the top of the multi-film thermoplastic bag 600.

FIG. 7B illustrates a cross-sectional view of the multi-film thermoplastic bag 600. For example, as shown, the contact areas 210 extend through the hem channel 609, and from the hem seal 608 into the grab zone 606*a* toward the bottom edge 610 of the multi-film thermoplastic bag 600. The first length of the grab zone 606*a* ends before the fourth region 606*d* begins, creating an area of flat and undeformed film before the second region 606*b* the deformations. In additional implementations, the hem skirt 616 may extend further from the hem seal 608 on the inner surface of the multi-film thermoplastic bag 600, such that one portion of the hem skirt 616 includes contact areas 210, and another portion of the hem skirt 616 includes flat and undeformed films. The fourth region 606*d* of flat and undeformed areas further highlights the tactile cues connoting strength included in the grab zone 606*a* (e.g., the grab zone) by physically and visually separating the grab zone 606*a* from the second region 606*b*.

Figure 8A:
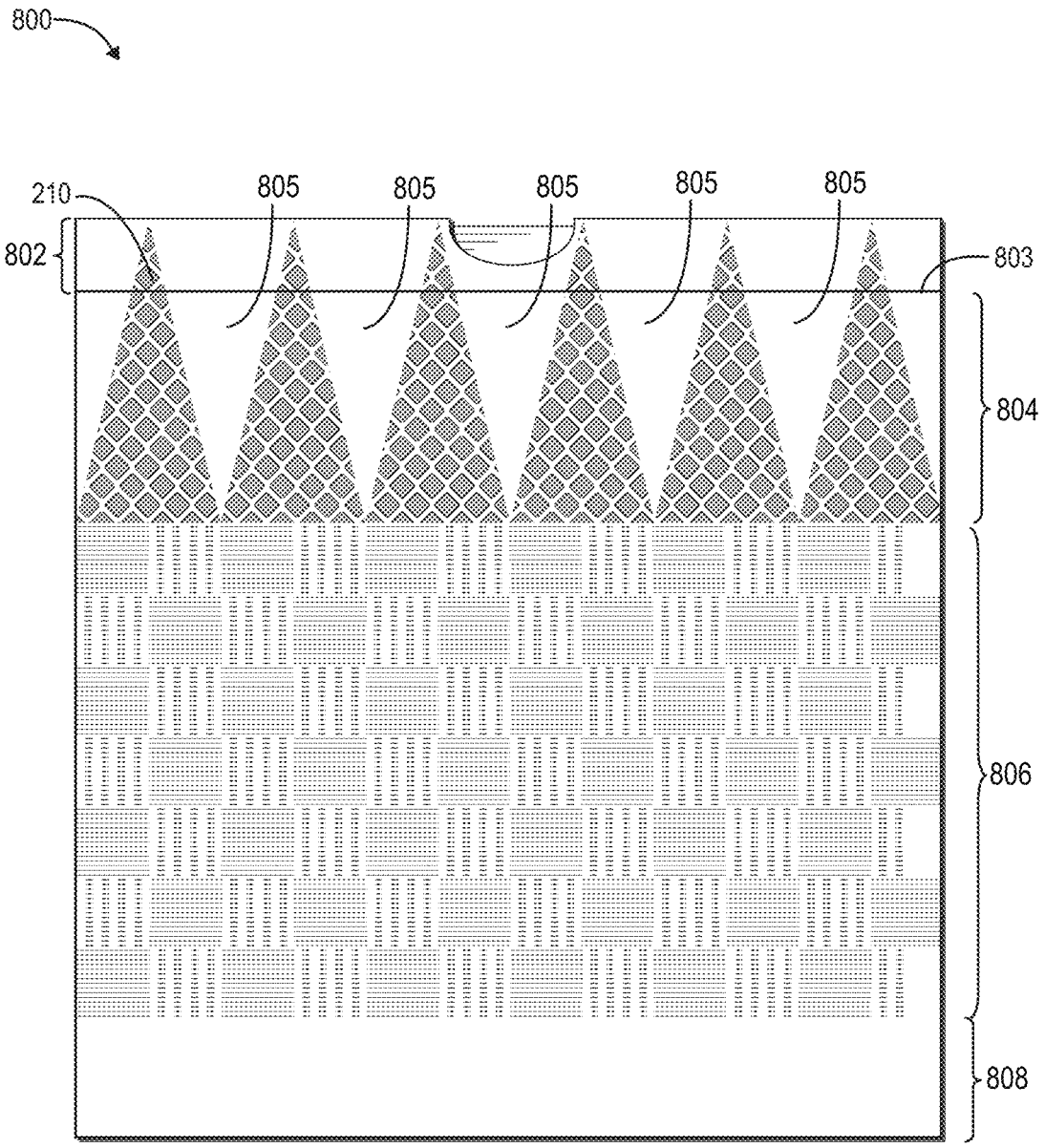
FIGS. 8A-8B show front views of multi-film thermoplastic bags including conjoined hem channels and regions of contact areas according to one or more implementations of the present disclosure.
Figure 8B:
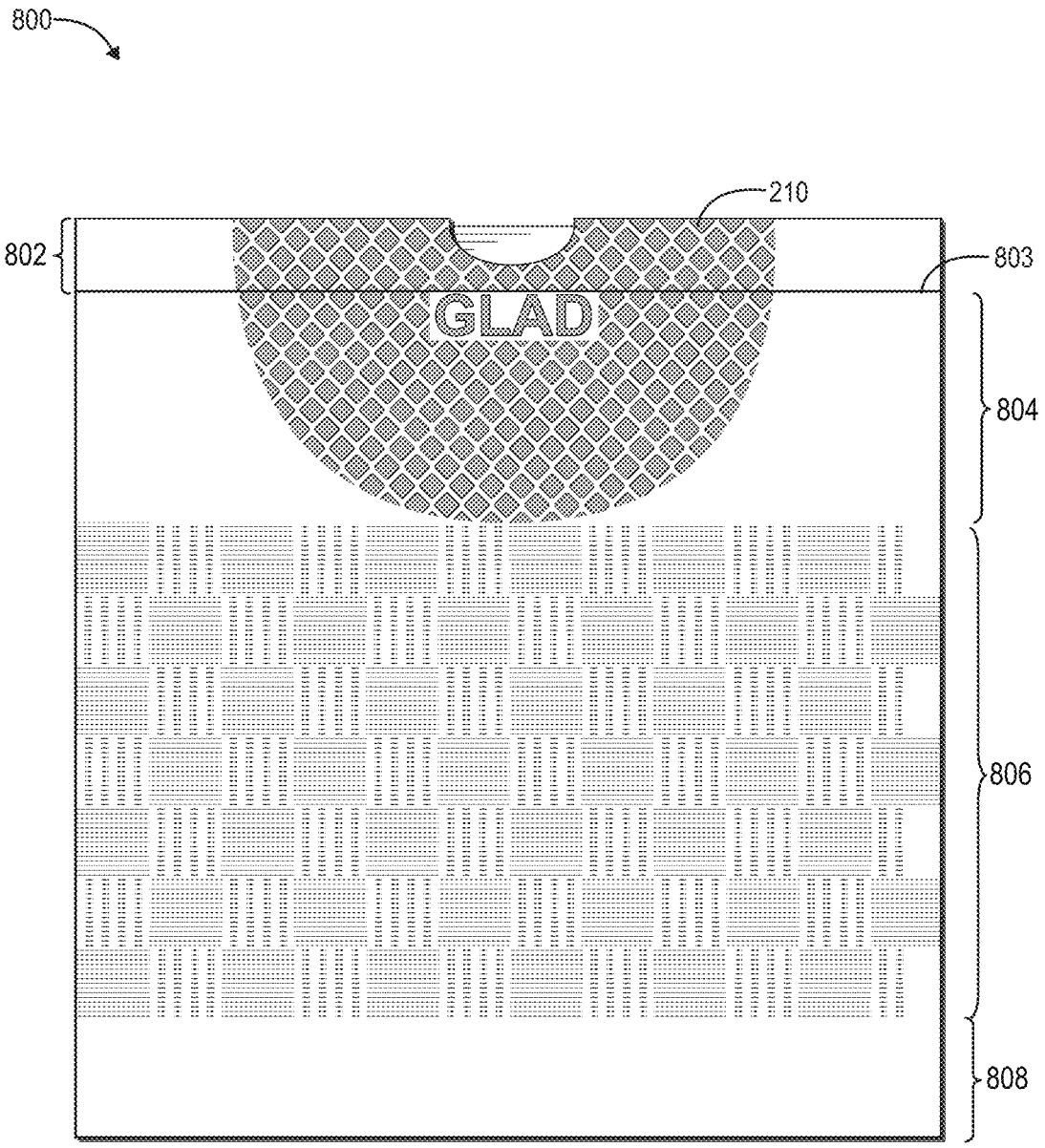

In one or more implementations, one or more contact areas can be positioned in additional areas of a thermoplastic bag beyond the hem channel. FIGS. 8A, 8B, and 8C illustrate implementations of a multi-film thermoplastic bag with various configurations of contact areas. The regions of contact areas (e.g., in various grab zone configurations) illustrated in the implementations of the multi-film thermoplastic bag shown in FIGS. 8A-8C provide multiple advantages. For example, the regions of contact areas server to evenly distribute pull and lift forces across the top the multi-film thermoplastic bag. Thus, the regions of contact areas reduce puncturing and tearing in association with a grab zone of the multi-film thermoplastic bag. Moreover, the regions of contact areas provide increased stiffness as well as other tactile cues connoting strength. As such, the grab zones of contact areas illustrated in provide both the look and feel of increased strength in areas of the multi-film thermoplastic bag most likely to be handled by a user.

For example, FIG. 8A illustrates a multi-film thermoplastic bag 800 with contact areas 210 in both the hem channel 802 (e.g., delineated by a hem seal 803) and a first area 804. As discussed above, the process that forms the contact areas 210 in the sidewalls of the multi-film thermoplastic bag 800 occurs prior to the top edges of the bag 800 being folded over and secured with the hem seal 803 to form the hem channel 802.

In some implementations, the contact areas 210 may not extend through an entirety of the hem channel 802. For example, as shown in FIG. 8A, the contact areas are formed into shapes that extend through portions of the hem channel 802 and portions of the grab zone 804. For instance, each group of contact areas 210 is shaped as a triangle that extends through a bottom portion of the grab zone 804 up into the hem channel 802. The triangle-shaped patterns of contact area form mirrored areas 805 of flat and undeformed films in the hem channel 802 and first area 804 of the multi-film thermoplastic bag 800. In other implementations, the contact areas 210 can be formed into any shape that extends through any area of the multi-film thermoplastic bag 800.

As shown in FIG. 8A, the multi-film thermoplastic bag 800 also includes the second area 806 featuring deformations including at least one of raised rib-like elements in a strainable network or alternating thicker ribs and thinner stretched webs. Additionally, the multi-film thermoplastic bag 800 includes the third area 808 of flat and undeformed film near the bottom of the bag 800.

In at least one implementation, the pattern of contact areas in the multi-film thermoplastic bag 800 may be shaped in various configurations. For example, as shown in FIG. 8B, the contact areas 210 can form a yoke extending from the hem channel 802 into the first area 804. In this configuration, the contact areas 210 can still provide a reduction in drag force required to pull the drawtape through the hem channel 802. Additionally, the placement of contact areas further reduce the likelihood of the inner surface of the hem channel 802 inverting and bunching around the hem channel apertures through which the drawtape is pulled. In some implementations, the multiple areas of contact areas 210 can be formed into patterns including alpha-numeric characters. For example, as further shown in FIG. 8B, the multiple areas of contact areas can be formed into words (e.g., "GLAD"). In other implementations, the multiple areas of contact areas can be formed into words including brand names, claims, and instructions.

Figure 9:
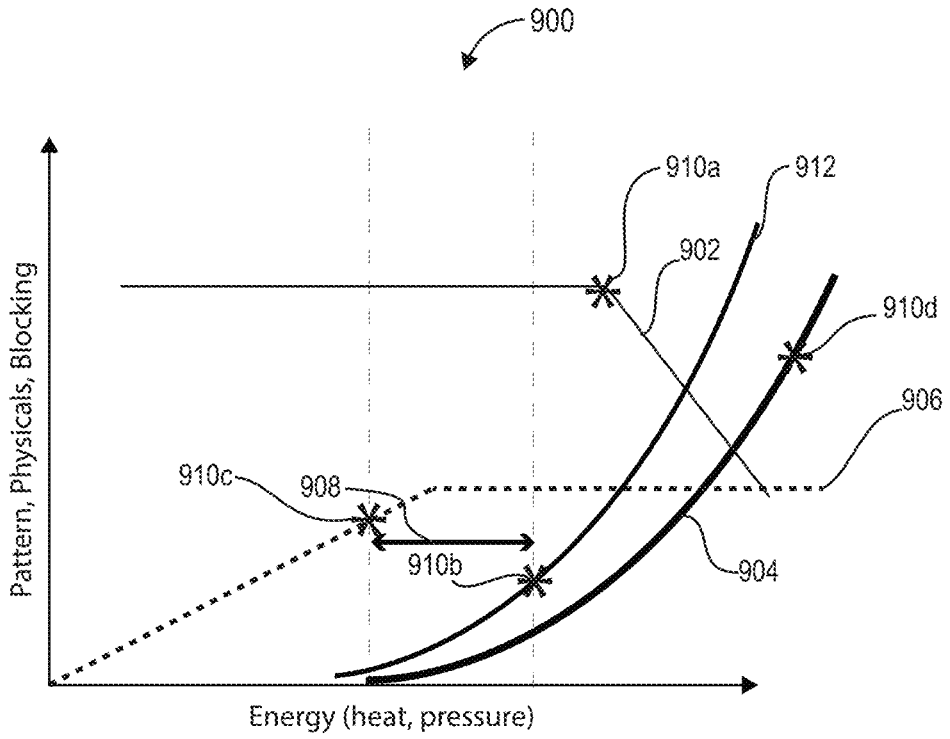
FIG. 9 shows a chart illustrating levels of heat and pressure applied during the contact area creation process according to one or more implementations of the present disclosure.

As mentioned above, in at least one implementation, the contact areas between portions of thermoplastic film layers of a multi-film thermoplastic structure are formed passing through contact rollers in a process that includes applying heat and pressure to the portions of thermoplastic film layers. FIG. 9 includes a chart 900 illustrating an optimal amount of heat and pressure applied during the heat embossing process that results in preferred quality measures (e.g., visual or pattern, physicals, blocking, and holes) of the resulting multi-film thermoplastic structure.

For example, as shown in FIG. 9, as heat and pressure increase, the physical properties of a multi-film thermoplastic structure indicated by the curve 902 remain the same until a drop off point 910*a* (e.g., yield point). After the drop off point 910*a*, the continued increase of heat and pressure cause the physical properties of the multi-film thermoplastic structure to deteriorate rapidly. As used herein, the "physical properties," "physical parameters," or "physicals" of a multi-film thermoplastic structure refer to the molecular strength of the multi-film thermoplastic structure. In particular, the physicals indicated by curve 902 can comprise transverse direction tensile strength, transverse or machine direction tear resistance, or puncture resistance (e.g., as measured by a dart drop test).

As further shown in FIG. 9, as heat and pressure increase in the process, the blocking of the multi-film thermoplastic structure indicated by the curve 904 increases in approximately an exponential manner. As used herein, "blocking" refers to the level with which a thermoplastic film sticks to itself. As indicated by the point 910*b* on the curve 912, there is an amount of heat and pressure beyond which the amount of blocking exhibited by a multi-film thermoplastic structure is undesirable. For example, a high level of blocking can cause the multi-film thermoplastic structure to self-stick in such a way that it is unusable for the processes described herein. In particular, by at least point 910*b* the films are sealed together in a manner that they cannot be separated without causing the individual layers to fail.

Moreover, as shown in FIG. 9, as heat and pressure increase in the heat embossing process, the aesthetic value (e.g., the visibility as measured by A E) of the pattern of heated pressure seals formed by the heat embossing process increases, as indicated by the curve 906. For example, as indicated by the point 910*c*, an increasing amount of heat and pressure during the heat embossing process causes the aesthetic value of the pattern of contact areas pressed into the multi-film thermoplastic structure to increase to a desirable level. Below this critical level of energy at 910*c*, the aesthetic value may result in a pattern of contact areas that is difficult to recognize, unnuanced, or otherwise undesirable.

In one or more implementations, increasing heat and pressure during the heat embossing process also increases a flexural rigidity (or stiffness) of the multi-film thermoplastic structure. For example, flexural rigidity refers to a measure of flexibility or rigidity of the multi-film thermoplastic structure. In at least one implementation, the flexural rigidity of the multi-film thermoplastic structure increases in a linearly proportional manner as heat and pressure increase in the contact area formation process until a point where the rigidity plateaus. An increased amount of flexural rigidity in the multi-film thermoplastic structure is desirable as it creates an increased perception of strength and quality of the multi-film thermoplastic bag where the contact areas are incorporated. In one or more implementations, the contact areas can increase the flexural rigidity [microjoule/m] from 1.1 times to 5 times compared to a flat/undeformed film of the same gauge. More particularly, in one or more implementations, the contact areas can increase the flexural rigidity from 1.5 times to 4 times, or 1.5 times to 3 times, or 2 times to 4 times compared to a flat/undeformed film of the same gauge.

Flexural rigidity of the multi-film thermoplastic structure can be measured according to a cantilever test and/or a heart loop test as described in ASTM standard D1388-18. For example, the cantilever test measures flexural rigidity by sliding a strip of the multi-film thermoplastic structure at a specified rate in a direction parallel to its long dimension, until a leading edge of the strip projects from the edge of a horizontal surface. The length of the overhang of the strip is measured when the end of the strip is depressed under its own mass to the point where end of the strip droops by at least a 41.5 degree angle from the horizontal. The flexural rigidity of the multi-film thermoplastic structure is determined based on the length of the overhang. The heart loop test measures flexural rigidity by forming a strip of the multi-film thermoplastic structure into a heart-shaped loop. The length of the loop is measured when it is hanging vertically under its own mass. The flexural rigidity of the multi-film thermoplastic structure is determined based on the length of the loop.

Additionally, as shown in FIG. 9, increasing heat and pressure can cause a creation of holes (e.g., micro pores or larger holes) within a multi-film thermoplastic structure. As illustrated, it is possible for the process to create holes in the multi-film thermoplastic structure prior to any significant loss of other physicals (e.g., the molecular strength of the multi-film thermoplastic structure). For example, an amount of heat and pressure beyond the point 910*d* can cause holes to form within one or more layers of the multi-film thermoplastic structure. Holes within the multi-film thermoplastic structure are generally undesirable as they may make the multi-film thermoplastic structure unfit for its intended purpose (e.g., lead to leaks in a trash bag).

Thus, as shown by the arrow 908 in the chart 900, there is a range of heat and pressure that can be applied during the contact area creation process that results in optimized levels for physicals, blocking, pattern (i.e., visual), flexural rigidity, and holes. In one or more implementations, this range includes heating at least one contact roller to a range of 125-325 degrees Fahrenheit. Furthermore, the range includes pressure in the tooling nip at a range of 100-1800 pounds per square inch. Moreover, in at least one implementation, the range also includes speeds of the contact rollers at a range of 500-1200 feet per minute. In alternative implementations, the preferred range may include heats, pressures, or speeds at other ranges.

When operated within the ranges of heat and pressure indicated by the arrow 908 in the chart 900, the contact areas creation process described herein produces contact areas with optimized qualities. For example, in at least one embodiment, a contact area created by the process operating within the optimal heat and pressure ranges exhibits a pattern where the Delta E of the pattern versus separated areas of the films is 0.3 to 50 points higher and more specifically 1.0 to 10.3 points higher. For example, Delta E can refer to the visibility of the contact area and can include one or more of a change in L luminance value associated with the contact area, a change in a-measure of red/green lightness/darkness associated with the contact area, or a change in a b-measure of blue/yellow lightness/darkness associated with the contact area. In one or more implementations, a contact area created by the process operating within the optimal heat and pressure range indicated by the arrow 908 exhibits a pattern where the Delta E of the pattern versus adjacent separated areas of film is 3.1 points higher on average.

Similarly, in at least one embodiment, a contact area created by the process operating within the optimal heat and pressure range indicated by the arrow 908 exhibits physicals where the peak load ratio of the areas including the contact area is between 38% and 100% of the transverse direction (TD) tensile strength the films prior to formation of the contact area when measured on a one-inch TD tensile pull test. More specifically the contact area is between 54% and 100% of the TD tensile strength the films prior to formation of the contact area. In one or more implementations, a contact area created by the process operating within the optimal heat and pressure range indicated by the arrow 908 exhibits physicals where the peak load ratio of the contact area is 92% of the TD tensile strength of the pre-processed film. In at least one embodiment, the contact area created by the process operating within the optimal heat and pressure range indicated by the arrow 908 can also exhibit desired levels of puncture resistance and tear values (in the machine and/or transverse direction).

Moreover, in at least one embodiment, a contact area created by the process operating within the optimal heat and pressure range indicated by the arrow 908 exhibits blocking where the peel strength [g/mm] is between 0.00 and 2.60, between 0.00 and 1.70, or between 0.00 and 0.88 when peel forces are exerted on a three-inch T peel between inner bag layers. Specifically, a contact area created by the process operating with the optimal heat and pressure ranges exhibits blocking where the peel strength [g/mm] is 0.29 when peel forces are exerted on a three-inch T peel between inner bag layers. Additionally, in at least one implementation, the contact areas are configured to separate before any layer of the multi-film film or bag fails when subjected to peel forces.

Additionally, as shown in FIG. 9, a contact area created by the process operating within the optimal heat and pressure range indicated by the arrow 908 also exhibits minimal holes. For example, in at least one embodiment, holes may be identified by inflating the multi-film thermoplastic structure including the contact area and checking for light show-through. Holes and blocking associated with multi-film thermoplastic structure may be minimized while maximizing visual and physicals by operating the process within the heat and pressure range indicated by the arrow 908.

Although the implementations shown in the figures show multi-film thermoplastic bags with multiple regions, additional or alternative implementations can include a single region or more than two regions. Additionally, although the implementations (e.g., such as shown in FIG. 8A) illustrate at least one continuous pattern of contact areas with one or more machine direction (MD) stripes, other implementations can include a discrete pattern of contact areas. For example, alternative implementations can include a discrete pattern of contact areas with MD, TD, or angled orientation including pattern elements resembling dots, dashes, or any other shapes.

Figure 10:
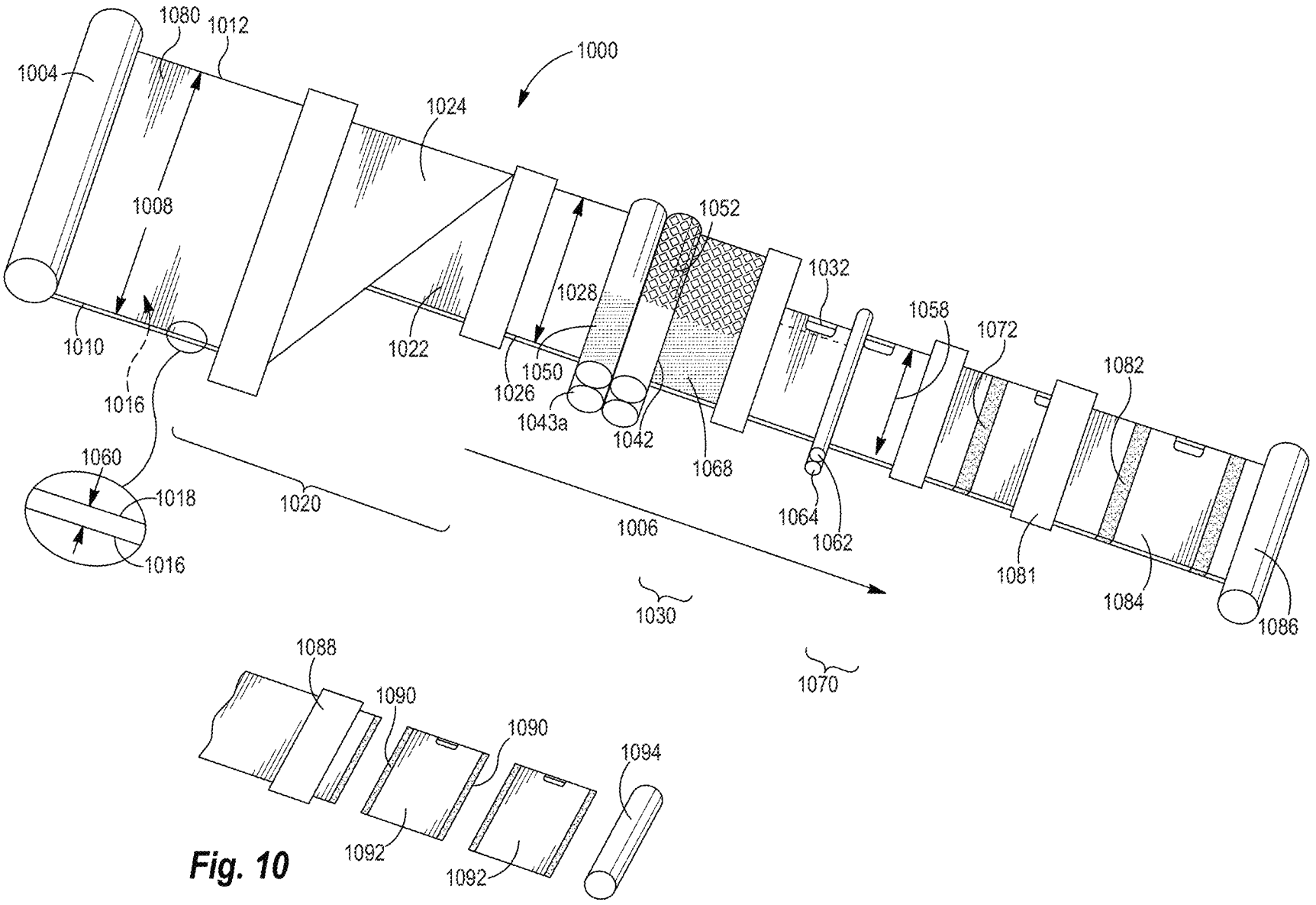
FIG. 10 illustrates a schematic diagram of a process of manufacturing a multi-film thermoplastic bag with contact areas in accordance with one or more implementations of the present disclosure.

To produce a bag having a one or more contact areas as described, continuous webs of thermoplastic material may be processed through a high-speed manufacturing environment such as that illustrated in FIG. 10. In the illustrated process 1000, production may begin by unwinding a first continuous web or film 1080 of thermoplastic sheet material from a roll 1004 and advancing the web along a machine direction 1006. The unwound web 1080 may have a width 1008 that may be perpendicular to the machine direction 1006, as measured between a first edge 1010 and an opposite second edge 1012. The unwound web 1080 may have an initial average thickness 1060 measured between a first surface 1016 and a second surface 1018. In other manufacturing environments, the web 1080 may be provided in other forms or even extruded directly from a thermoplastic forming process. To provide the first and second sidewalls of the finished bag, the web 1080 may be folded into a first half 1022 and an opposing second half 1024 about the machine direction 1006 by a folding operation 1020. When so folded, the first edge 1010 may be moved adjacent to the second edge 1012 of the web. Accordingly, the width of the web 1080 proceeding in the machine direction 1006 after the folding operation 1020 may be a width 1028 that may be half the initial width 1008. As may be appreciated, the portion mid-width of the unwound web 1080 may become the outer edge of the folded web. In any event, the hems may be formed along the adjacent first and second edges 1010, 1012.

To form a SELFing pattern 1050, the processing equipment may include SELF'ing intermeshing rollers 1043*a* such as those described herein above. Referring to FIG. 10, the folded web 1080 may be advanced along the machine direction 1006 between the SELF'ing intermeshing rollers 1043*a*, which may be set into rotation in opposite rotational directions to impart the resulting SELF'ing pattern 1050. To facilitate patterning of the web 1080 the first and second rollers 1043*a* may be forced or directed against each other by, for example, hydraulic actuators. The pressure at which the rollers are pressed together may be in a first range from 30 PSI (2.04 atm) to 100 PSI (6.8 atm), a second range from 60 PSI (4.08 atm) to 90 PSI (6.12 atm), and a third range from 75 PSI (5.10 atm) to 85 PSI (5.78 atm). In one or more implementations, the pressure may be about 80 PSI (5.44 atm).

In the illustrated implementation, the SELFing pattern 1050 formed intermeshing rollers 1043*a* may be arranged so that they are co-extensive with or wider than the width of the folded web 1080. In one or more implementations, the SELFing pattern 1050 formed by intermeshing rollers 1043*a* may extend from proximate the folded edge 1026 to the adjacent edges 1010, 1012. To avert imparting the SELFing pattern 1050 onto the portion of the web that includes the drawtape 1032, the corresponding ends of the rollers 1043*a* may be smooth and without the ridges and grooves. Thus, the adjacent edges 1010, 1012 and the corresponding portion of the web proximate those edges that pass between the smooth ends of the rollers 1043*a* may not be imparted with the SELFing pattern 1050.

More particularly, passing the folded web 1080 between the first and second intermeshing rollers 1043*a*, wherein at least one of the first intermeshing roller and the second intermeshing roller comprises a repeat unit of a plurality of ridges, a plurality of notches, and a plurality of grooves. The repeat unit causes creation of a SELFing pattern in the thermoplastic film, the SELFing pattern comprising a plurality of raised rib-like elements and a plurality of land areas positioned that extend in a first direction. The plurality of raised rib-like elements and the plurality of land areas are sized and positioned such that, when subjected to the applied force in the first direction, the thermoplastic film provides a low force extension.

Figure 11:
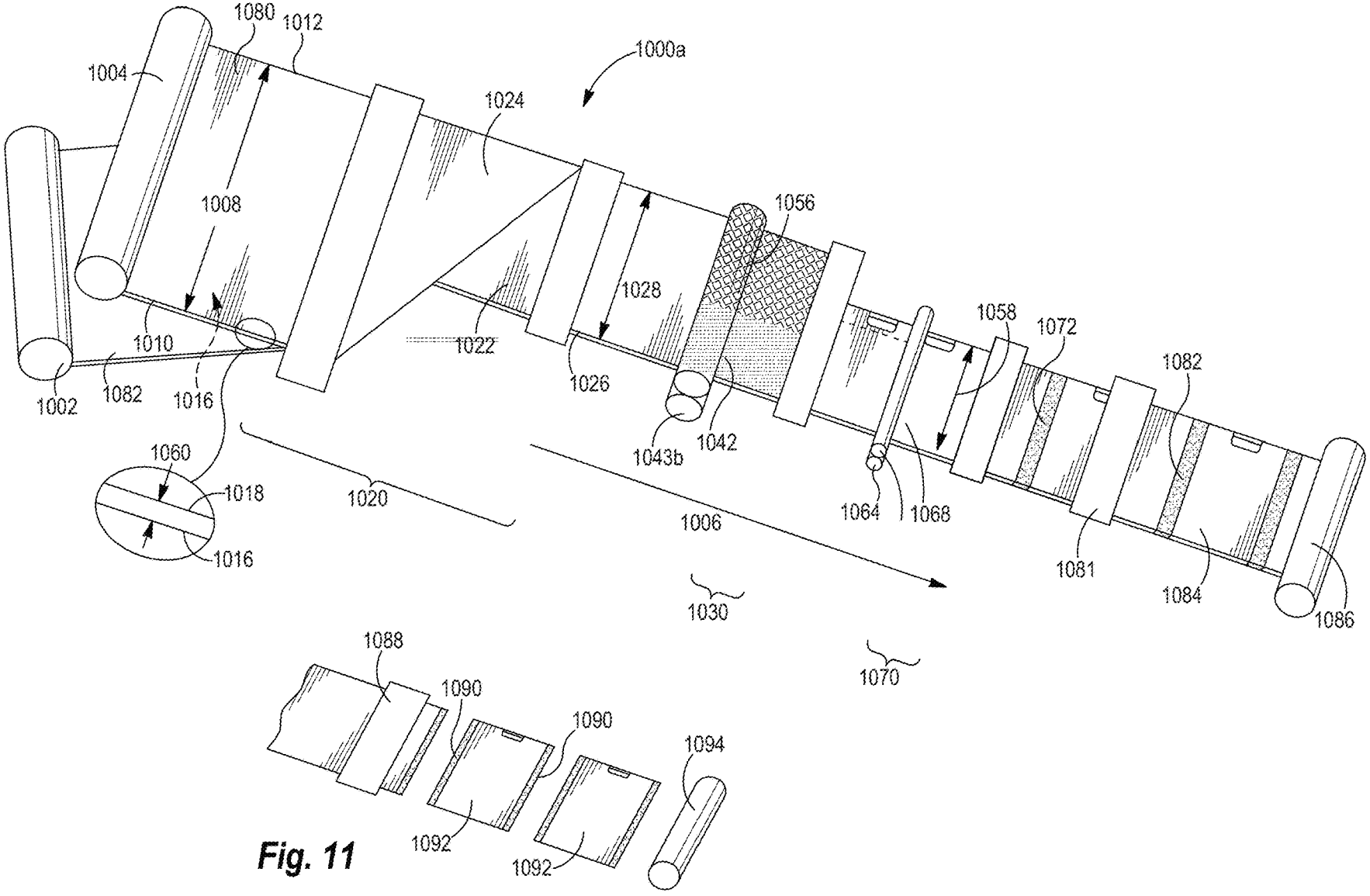
FIG. 11 illustrates a schematic diagram of another process of manufacturing a multi-film thermoplastic bag with contact areas in accordance with one or more implementations of the present disclosure.

Prior to forming the hem channels, the process involves forming bonds between areas of the first and second thermoplastic layers that will form the hem channels. For example, FIG. 10 and FIG. 11 illustrates using contact rollers 1042 to create bonds in the form of hem channels. Alternatively, the contact rollers 1042 can be replaced by a seal bar, ultrasonic welder, adhesive dispenser, SELFing rollers, ring rollers, embossing rollers, or other means of forming bonds as described above. To form one or more regions of contact areas in a multi-film thermoplastic bag, the processing equipment may include at least one heated set of contact rollers 1042, such as those described herein above. Referring to FIG. 10, the folded web 1080 may be advanced along the machine direction 1006 passing through the heated contact rollers 1042, which impart a pattern 1052 of one or more contact areas between flat portions of the folded web 1080.

As shown in FIG. 10, the pattern 1050 of the intermeshing rollers 1043*a* may be offset from the pattern 1052 of the heated contact rollers 1042, such that the patterns 1050 and 1052 imparted to the resulting folded web 1080 do not overlap. Alternatively, the pattern 1050 of the intermeshing rollers 1043*a* may be partially offset from the pattern 1052 of the heated contact rollers 1042, such that the patterns 1050 and 1052 imparted to the resulting folded web 1080 overlap in a region (e.g., as shown above in FIGS. 6A and 6B).

In at least one embodiment, the processing equipment may include a vision system or sensor system in connection with the heated contact rollers 1042. For example, the vision system or sensor system may detect pattern presence, placements, and darkness. Similarly, the sensor system may detect the TD placement of the film (e.g., similar to web breakout or guiding systems). Additionally, the processing equipment may include a force gauge probe to measure the drag of the film across the gauge between inner layers.

After imparting one or more patterns, a drawtape 1032 may be inserted during a hem channel and drawtape operation 1030. For example, the hem channel and drawtape operation 1030 includes folding the web 1080 over to form a hem channel and a hem skirt (e.g., indicated by the dashed line). A drawtape 1032 can be inserted into the formed hem channel. As shown in FIG. 10, because the pattern 1052 of contact areas is imparted to the web 1080 prior to the hem channel and drawtape operation 1030, the resulting hem channel includes one or more contact areas from the pattern 1052.

The processing equipment may include pinch rollers 1062, 1064 to accommodate the width 1058 of the web 1080. In one or more implementations, the nip rollers can be modified into contact rollers to produce contact areas. For example, in implementations with continuous contact areas, the pinch rollers 1062, 1064 can be heated and act as contact rollers.

In one more implementations, the heat and pressure of the contact rollers can ensure that there is little to no bonding between the folded halves 1022, 1024 to ensure that the bag 1084 can be opened.

To produce the finished bag, the processing equipment may further process the folded web with at least one region of contact areas. For example, to form the parallel side edges of the finished multi-film thermoplastic bag, the web may proceed through a sealing operation 1070 in which heat seals 1072 may be formed between the folded edge 1026 and the adjacent edges 1010, 1012. The heat seals may fuse together the adjacent halves 1022, 1024 of the folded web. The heat seals 1072 may be spaced apart along the folded web and in conjunction with the folded outer edge 1026 may define individual bags. The heat seals may be made with a heating device, such as, a heated knife. A perforating operation 1081 may perforate 1082 the heat seals 1072 with a perforating device, such as, a perforating knife so that individual bags 1092 may be separated from the web. In one or more implementations, the webs may be folded one or more times before the folded webs may be directed through the perforating operation. The web 1080 embodying the bags 1084 may be wound into a roll 1086 for packaging and distribution. For example, the roll 1086 may be placed in a box or a bag for sale to a customer.

In one or more implementations of the process, a cutting operation 1088 may replace the perforating operation 1081. The web is directed through a cutting operation 1088 which cuts the webs at location 1090 into individual bags 1092 prior to winding onto a roll 1094 for packaging and distribution. For example, the roll 1094 may be placed in a box or bag for sale to a customer. The bags may be interleaved prior to winding into the roll 1094. In one or more implementations, the web may be folded one or more times before the folded web is cut into individual bags. In one or more implementations, the bags 1092 may be positioned in a box or bag, and not onto the roll 1094.

FIG. 11 illustrates a modified high-speed manufacturing 1000*a* that involves unwinding a second continuous web or film 1082 of thermoplastic sheet material from a roll 1002 and advancing the web along a machine direction 1006. The second film 1082 can comprise a thermoplastic material, a width, and/or a thickness that is similar or the same as the first film 1080. In alternative one or more implementations, one or more of the thermoplastic material, width, and/or thickness of the second film 1082 can differ from that of the first film 1080. The films 1080, 1082 can be folded together during the folding operation 1020 such that they pass through the heated contact rollers 1042 to form one or more regions of contact areas and resulting multi-filmed thermoplastic bags.

As shown by FIG. 11, the contact rollers can comprise hybrid rollers 1043*b* with a first portion that forms the pattern 1056 of one or more contact areas and a second portion that forms the pattern 1042 of deformations (e.g., via ring rolling, SELFing, embossing). For example, the hybrid rollers 1043*b* are shown before the hem channel and drawtape operation 1030 such that, when the edges 1010, 1012 of the films 1080, 1082 pass through the hem channel and drawtape operation 1030, the pattern 1056 of one or more contact areas is included in the resulting hem channel and hem skirt (e.g., indicated by the dashed line).

The present disclosure may be embodied in other specific forms without departing from its spirit or essential characteristics. For example, the illustrated and described implementations involve non-continuous heated pressure bonding (i.e., discontinuous or partially discontinuous heated pressure bonding) to provide the weak or light bonds between two or more contrasting layers. In alternative implementations, the heated pressure bonding may be continuous. For example, multi-film structures could be co-extruded so that the layers have a bond strength that provides for delamination prior to film failure to provide similar benefits to those described above. Thus, the described implementations are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

We claim:

1. A multi-film thermoplastic bag comprising:

a first sidewall comprising a first outer thermoplastic film layer and a second inner thermoplastic film layer;

a first hem channel along a top of the first sidewall, the first hem channel extending from a fold of both of the first outer thermoplastic film layer and the second inner thermoplastic film layer at the top of the first sidewall to a first hem seal extending across a width of the first sidewall, wherein the first hem seal bonds the first outer thermoplastic film layer, the second inner thermoplastic film layer, and a portion of the second inner thermoplastic film layer folded into an interior of the multi-film thermoplastic bag together;

a drawtape positioned within the first hem channel;

a first tape seal securing the drawtape to a first side of the first sidewall;

a second tape seal securing the drawtape to a second side of the first sidewall;

one or more first bonds securing together the first outer thermoplastic film layer and the second inner thermoplastic film layer in the first hem channel, wherein the one or more first bonds do not extend through the first hem channel, the one or more first bonds being positioned between the first and the second tape seals;

a second sidewall comprising a third outer thermoplastic film layer and a fourth inner thermoplastic film layer;

a second hem channel along a top of the second sidewall, the second hem channel extending from a fold of both of the third outer thermoplastic film layer and the fourth inner thermoplastic film layer at the top of the second sidewall to a second hem seal extending across a width of the second sidewall, wherein the second hem seal bonds the third outer thermoplastic film layer, the fourth inner thermoplastic film layer, and a portion of the fourth inner thermoplastic film layer folded into the interior of the multi-film thermoplastic bag together; and one or more second bonds securing together the third outer thermoplastic film layer and the fourth inner thermoplastic film layer in the second hem channel, wherein the one or more second bonds do not extend through the second hem channel, the one or more second bonds being positioned between the first and the second tape seals.

2. The multi-film thermoplastic bag as recited in claim 1, wherein the one or more first bonds and the one or more second bonds are configured to separate before either of the first sidewall or the second sidewall fail when subjected to peel forces.

3. The multi-film thermoplastic bag as recited in claim 1, wherein the one or more first bonds reduce a drag force on the drawtape by preventing the second inner thermoplastic film layer from separating from the first outer thermoplastic film layer and bunching in the first hem channel when the drawtape is pulled to cinch the multi-film thermoplastic bag.

4. The multi-film thermoplastic bag as recited in claim 1, wherein:

the first sidewall forms a first hem skirt extending down an inner surface of the first sidewall from the first hem channel toward a bottom of the multi-film thermoplastic bag; and the second sidewall forms a second hem skirt extending down an inner surface of the second sidewall from the second hem channel toward the bottom of the multi-film thermoplastic bag.

5. The multi-film thermoplastic bag as recited in claim 4, wherein:

the one or more first bonds secure the first outer thermoplastic film layer and the second inner thermoplastic film layer in the first hem skirt together; and the one or more second bonds secure the third outer thermoplastic film layer and the fourth inner thermoplastic film layer in the second hem skirt together.

6. The multi-film thermoplastic bag as recited in claim 5, wherein:

the one or more first bonds extend from the first hem channel for a distance less than a length of the first hem skirt; and the one or more second bonds extend from the second hem channel for a distance less than a length of the second hem skirt.

7. The multi-film thermoplastic bag as recited in claim 1, wherein:

the first sidewall comprises a first area of a plurality of deformations; and the second sidewall comprises a second area of the plurality of deformations, the plurality of deformations comprising one or more of raised rib-like elements in a strainable network or alternating thicker ribs and thinner stretched webs.

8. The multi-film thermoplastic bag as recited in claim 7, wherein:

the one or more first bonds extend from the first hem channel down the first sidewall a first distance toward a bottom of the multi-film thermoplastic bag, the first distance ending before the first area of the plurality of deformations; and the one or more second bonds extend from the second hem channel down the second sidewall a second distance toward the bottom of the multi-film thermoplastic bag, the second distance ending before the second area of the plurality of deformations.

9. The multi-film thermoplastic bag as recited in claim 7, wherein:

the one or more first bonds extend from the first hem channel down the first sidewall a first distance toward a bottom of the multi-film thermoplastic bag, the first distance ending after the first area of the plurality of deformations creating an overlap between the one or more first bonds and the first area of the plurality of deformations; and the one or more second bonds extend from the second hem channel down the second sidewall a second distance toward the bottom of the multi-film thermoplastic bag, the second distance ending after the second area of the plurality of deformations creating an overlap between the one or more second bonds and the second area of the plurality of deformations.

10. The multi-film thermoplastic bag as recited in claim 7, further comprising a first flat and undeformed area on the first sidewall, and a second flat and undeformed area on the second sidewall, wherein:

the one or more first bonds extend from the first hem channel down the first sidewall a first distance toward a bottom of the multi-film thermoplastic bag, the first distance ending before the first flat and undeformed area, the first flat and undeformed area extending a second distance down an outer surface of the first sidewall and ending before the first area of the plurality of deformations; and the one or more second bonds extend from the second hem channel down the second sidewall a third distance toward the bottom of the multi-film thermoplastic bag, the third distance ending before the second flat and undeformed area, the second flat and undeformed area extending a fourth distance down an outer surface of the second sidewall and ending before the second area of the plurality of deformations.

11. The multi-film thermoplastic bag as recited in claim 2, wherein the one or more first bonds and the one or more second bonds comprise contact areas that are flat and visually-distinct from areas in the first and second hem channels that are not bonded together.

12. The multi-film thermoplastic bag as recited in claim 1, wherein the one or more first bonds and the one or more second bonds comprise:

bonds formed from structural elastic-like film (SELF'ing) process;

bonds formed from a ring-rolling process;

heat seals;

adhesive bonds;

a combination of pressure and tackifying agents embedded in one or more of the first outer thermoplastic film layer and the second inner thermoplastic film layer; or ultrasonic welds.

13. A multi-layer thermoplastic bag comprising:

a first thermoplastic bag comprising first and second opposing sidewalls joined together along a first side edge and an opposite second side edge, an open first top edge, and a closed first bottom edge;

a second thermoplastic bag positioned within the first thermoplastic bag, the second thermoplastic bag comprising third and fourth opposing sidewalls joined together along a third side edge and an opposite fourth side edge, an open second top edge, and a closed second bottom edge;

a first tape seal securing a drawtape to a first side of the first sidewall;

a second tape seal securing the drawtape to a second side of the first sidewall;

a first hem channel extending from the open first top edge to a first hem seal on the first sidewall and between the first and the second tape seals, and a second hem channel extending from the open first top edge to a second hem seal on the second sidewall and between the first and the second tape seals, the first hem channel being formed from the first and third sidewalls on a first side of the multi-layer thermoplastic bag and the second hem channel being formed from the second and fourth sidewalls on a second side of the multi-layer thermoplastic bag;

one or more first bonds securing the first and second thermoplastic bags together in the first hem channel, wherein the one or more first bonds do not extend through the first hem channel; and one or more second bonds securing the first and second thermoplastic bags together in the second hem channel, wherein the one or more second bonds do not extend through the second hem channel, wherein the first hem seal bonds the first sidewall, the third sidewall, a portion of the first sidewall folded into an interior of the multi-layer thermoplastic bag, and a portion of the third sidewall folded into the interior of the multi-layer thermoplastic bag together, and wherein the second hem seal bonds the second sidewall, the fourth sidewall, a portion of the second sidewall folded into the interior of the multi-layer thermoplastic bag, and a portion of the fourth sidewall folded into the interior of the multi-layer thermoplastic bag together.

14. The multi-layer thermoplastic bag as recited in claim 13, wherein the one or more first bonds reduce a drag force on the drawtape by preventing the second thermoplastic bag from separating from the first thermoplastic bag and bunching in the first hem channel when the drawtape is pulled to cinch the multi-layer thermoplastic bag.

15. The multi-layer thermoplastic bag as recited in claim 13, wherein the one or more first bonds comprise a plurality of bonds arranged in a pattern that covers an entirety of the first hem channel.

16. The multi-layer thermoplastic bag as recited in claim 13, wherein the one or more first bonds comprise:

a first bond along a top edge of the first hem channel, the first bond extending from a drawtape notch in the first hem channel toward the first tape seal; and a second bond along the top edge of the first hem channel, the second bond extending from the drawtape notch in the first hem channel toward the second tape seal.

17. The multi-layer thermoplastic bag as recited in claim 16, wherein:

the first bond extends from the drawtape notch to the first tape seal; and the second bond extends from the drawtape notch to the second tape seal.

18. The multi-layer thermoplastic bag as recited in claim 13, wherein the one or more first bonds are configured to separate before either of the first sidewall or the second sidewall fail when subjected to peel forces.

19. The multi-layer thermoplastic bag as recited in claim 13, wherein the one or more first bonds comprise contact areas that are flat and visually-distinct from areas in the hem channel that are not bonded together.

20. The multi-layer thermoplastic bag as recited in claim 13, wherein the one or more first bonds:

increase stiffness of the first hem channel; or increase strength or rigidness of the first hem channel.

* * * * *